US011576541B2

(12) United States Patent
Nguyen

(10) Patent No.: US 11,576,541 B2
(45) Date of Patent: Feb. 14, 2023

(54) SURFACE CLEANING APPARATUS

(71) Applicant: BISSELL Inc., Grand Rapids, MI (US)

(72) Inventor: Tom Minh Nguyen, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 36 days.

(21) Appl. No.: 17/407,590

(22) Filed: Aug. 20, 2021

(65) Prior Publication Data

US 2022/0279999 A1 Sep. 8, 2022

Related U.S. Application Data

(63) Continuation of application No. 17/191,876, filed on Mar. 4, 2021, now Pat. No. 11,122,946.

(51) Int. Cl.
*A47L 9/04* (2006.01)
*A47L 11/40* (2006.01)

(52) U.S. Cl.
CPC ..... *A47L 9/0477* (2013.01); *A47L 11/4041* (2013.01)

(58) Field of Classification Search
CPC ..... A47L 9/0477; A47L 11/4041; A47L 5/30; A47L 9/2857; A47L 9/30; A47L 9/325; Y02P 70/10
See application file for complete search history.

(56) References Cited

U.S. PATENT DOCUMENTS 5,233,723 A 8/1993 Hung
5,983,443 A 11/1999 Redding
6,226,832 B1 5/2001 McCormick
6,289,552 B1 9/2001 McCormick
6,446,302 B1 9/2002 Kasper et al.
6,637,067 B2 10/2003 Paterson et al.
9,549,648 B2 1/2017 Lenkiewicz, Jr. et al.
10,092,155 B2 10/2018 Xia et al.
10,272,828 B2 4/2019 White et al.
10,631,702 B2 4/2020 Xia et al.
2006/0096057 A1 5/2006 Chatfield
2008/0148512 A1 6/2008 Beskow et al.
2012/0284950 A1 11/2012 De Wit et al.
2013/0025077 A1 1/2013 De Wit et al.
2014/0182079 A1 7/2014 Van Der Kooi et al.
2014/0215749 A1 8/2014 Van Der Kooi et al.
2015/0250367 A1 9/2015 Van Der Kooi et al.
2015/0297047 A1 10/2015 Van Der Kooi et al.
2016/0278597 A1 9/2016 Braendle et al.
2017/0049288 A1 2/2017 Knutson et al.
2017/0215676 A1 8/2017 Moser et al.
2018/0228331 A1 8/2018 Moser et al.
(Continued)

FOREIGN PATENT DOCUMENTS

CN 205126117 U 4/2016
CN 205126122 U 4/2016
(Continued)

*Primary Examiner* — David Redding
(74) *Attorney, Agent, or Firm* — Warner Norcross + Judd LLP

(57) ABSTRACT

The present disclosure provides a surface cleaning apparatus with a housing, a nozzle cover attached to the housing, a headlight, and a nozzle cover sensing mechanism. The nozzle cover sensing mechanism can determine whether the nozzle cover is present on the housing, and the headlight can accordingly be deactivated. Methods for operating the nozzle cover sensing mechanism are also disclosed.

20 Claims, 38 Drawing Sheets

(56) References Cited

U.S. PATENT DOCUMENTS

| | | | |
|---|---|---|---|
| 2018/0344112 | A1 | 12/2018 | Krebs et al. |
| 2019/0090710 | A1 | 3/2019 | Marcus et al. |
| 2019/0159646 | A1 | 5/2019 | Luyckx et al. |
| 2020/0060503 | A1 | 2/2020 | Davila et al. |
| 2020/0187741 | A1 | 6/2020 | Villaroman |
| 2020/0214527 | A1 | 7/2020 | Resch et al. |
| 2021/0244253 | A1 | 8/2021 | Miller |

FOREIGN PATENT DOCUMENTS

| | | | |
|---|---|---|---|
| CN | 205126125 | U | 4/2016 |
| CN | 205197904 | U | 5/2016 |
| CN | 205197912 | U | 5/2016 |
| CN | 206151378 | U | 5/2017 |
| CN | 207055437 | U | 3/2018 |
| CN | 207384228 | U | 5/2018 |
| DE | 202017104648 | U1 | 12/2018 |
| GB | 2456418 | A | 7/2009 |
| WO | 0228251 | A2 | 4/2002 |
| WO | 2010041184 | A1 | 4/2010 |
| WO | 2014154995 | A1 | 10/2014 |
| WO | 2018177025 | A1 | 10/2018 |
| WO | 2020006182 | A1 | 1/2020 |
| WO | 2020072567 | A1 | 4/2020 |
| WO | 2020082066 | A1 | 4/2020 |

SURFACE CLEANING APPARATUS

CROSS-REFERENCE TO RELATED APPLICATION(S)

The present application is a continuation of U.S. patent application Ser. No. 17/191,876, filed Mar. 4, 2021, which is incorporated herein by reference in its entirety.

BACKGROUND

Multi-surface vacuum cleaners are adapted for cleaning hard floor surfaces such as tile and hardwood and soft floor surfaces such as rugs and carpet. Some multi-surface vacuum cleaners comprise a fluid delivery system that delivers cleaning fluid, usually liquid, to a surface to be cleaned and a recovery system that extracts liquid and debris (which may include dirt, dust, stains, soil, hair, and other debris) from the surface. The delivery system typically includes one or more supply tanks for storing a supply of cleaning liquid, a distributor for applying the liquid to the surface to be cleaned, and a supply conduit for delivering the liquid from the supply tank to the distributor. An agitator can be provided for agitating the liquid on the surface. The recovery system typically includes a recovery tank, a nozzle adjacent the surface to be cleaned and in fluid communication with the recovery tank through a working air conduit, and a source of suction in fluid communication with the working air conduit to draw liquid from the surface to be cleaned and through the nozzle and the working air conduit to the recovery tank. Other multi-surface cleaning apparatuses include "dry" vacuum cleaners that can clean different surface types, but do not dispense or recover liquid.

BRIEF SUMMARY

A surface cleaning apparatus with a cover sensing mechanism is provided herein. By detecting whether the cover is present, a headlight can be turned off or dimmed, and/or a brushroll motor can be turned off to stop the rotation of a brushroll. In certain embodiments, the surface cleaning apparatus is for a multi-surface wet vacuum cleaner that can be used to clean hard floor surfaces such as tile and hardwood and soft floor surfaces such as carpet.

According to one embodiment of the disclosure, a surface cleaning apparatus can include a housing, a brushroll on the housing to agitate a surface to be cleaned, a fluid distributor to deliver cleaning fluid to at least one of the brushroll and the surface to be cleaned, a suction nozzle defining a dirty inlet to a recovery pathway and including a nozzle cover removably attached to the housing to partially enclose the brushroll, a headlight to illuminate the surface to be cleaned, a sensing component to sense whether the nozzle cover is attached to the housing, and a headlight power switch operable to close and supply power to the headlight when the nozzle cover is attached to the housing, and operable to open when the nozzle cover is removed from the housing, wherein, when the sensing component senses that the nozzle cover is separated from the housing, the headlight power switch deactivates the headlight.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF EMBODIMENTS OF THE INVENTION

The invention generally relates to a surface cleaning apparatus, which may be in the form of a multi-surface wet vacuum cleaner.

The functional systems of the surface cleaning apparatus can be arranged into any desired configuration, such as an upright device having a base and an upright body for directing the base across the surface to be cleaned, a portable device adapted to be hand carried by a user, a canister device having a cleaning implement connected to a wheeled base by a vacuum hose, an autonomous or robotic device having an autonomous drive system and an autonomously moveable housing, or a commercial device. Any of the aforementioned cleaners can be adapted to include a flexible vacuum hose, which can form a portion of the working air conduit between a nozzle and the suction source. As used herein, the term "multi-surface wet vacuum cleaner" includes a vacuum cleaner that can be used to clean hard floor surfaces such as tile and hardwood and soft floor surfaces such as carpet.

Figure 1:
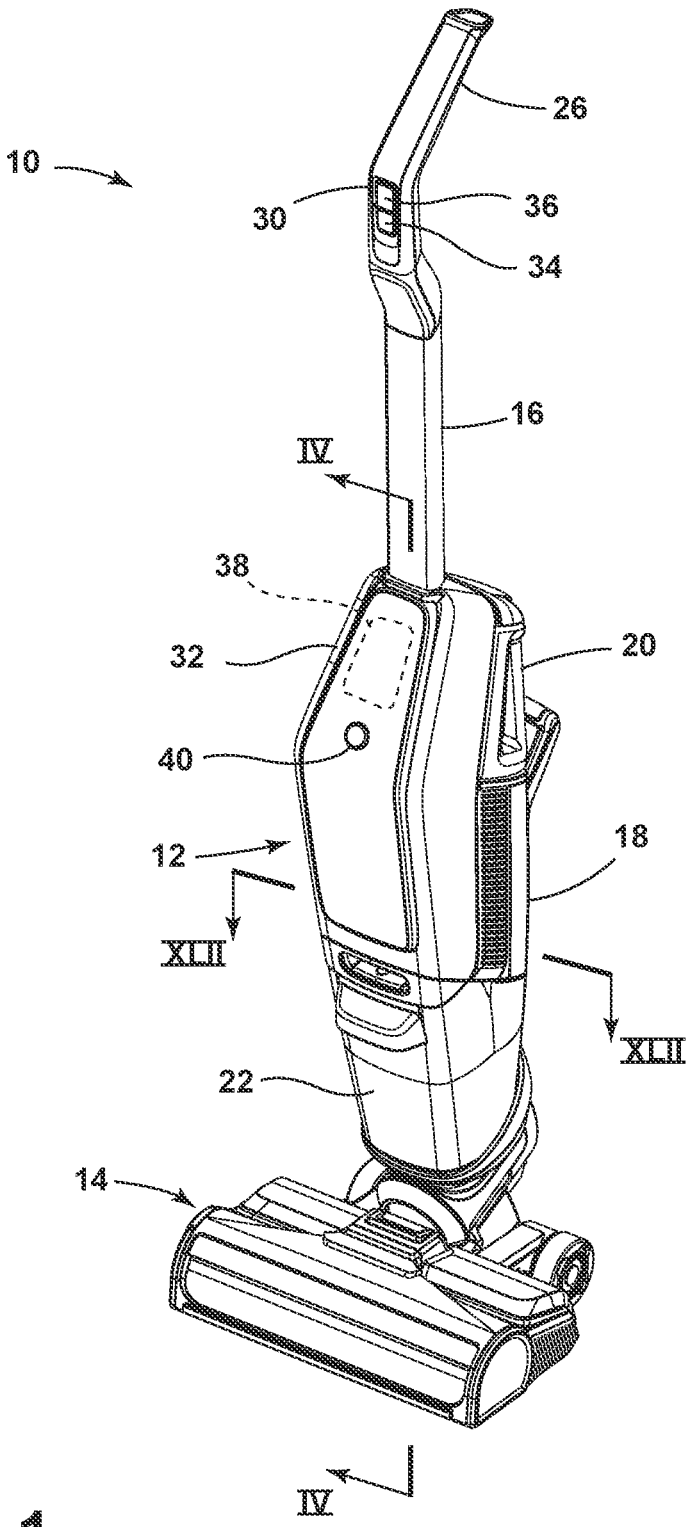
FIG. 1 is a perspective view of a surface cleaning apparatus according to one embodiment of the disclosure, showing the apparatus in an upright or storage position.

FIG. 1 is a perspective view of a surface cleaning apparatus 10 according to one aspect of the present disclosure. As discussed in further detail below, the surface cleaning apparatus 10 is provided with various features and improvements, which are described in further detail below. As illustrated herein, the surface cleaning apparatus 10 can be an upright multi-surface wet vacuum cleaner having a housing that includes an upright handle assembly or body 12 and a cleaning foot or base 14 mounted to or coupled with the upright body 12 and adapted for movement across a surface to be cleaned.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the surface cleaning apparatus 10, which defines the rear of the surface cleaning apparatus 10. However, it is to be understood that the disclosure may assume various alternative orientations, except where expressly specified to the contrary.

The upright body 12 can comprise a handle 16 and a frame 18. The frame 18 can comprise a main support section at least partially supporting a supply tank 20 and a recovery tank 22, and may further support additional components of the body 12. The surface cleaning apparatus 10 can include a fluid delivery or supply pathway, including and at least partially defined by the supply tank 20, for storing cleaning fluid, e.g. cleaning liquid, and delivering the cleaning fluid to the surface to be cleaned and a recovery pathway, including and at least partially defined by the recovery tank 22, for removing liquid and debris from the surface to be cleaned and storing the liquid and debris until emptied by the user.

The handle 16 can include a hand grip 26 and a trigger 28 (FIG. 3) mounted to the hand grip 26, which controls fluid delivery from the supply tank 20 via an electronic or mechanical coupling with the tank 20. The trigger 28 can project at least partially exteriorly of the hand grip 26 for user access. A spring (not shown) can bias the trigger 28 outwardly from the hand grip 26. Other actuators, such as a thumb switch instead of the trigger 28, can be provided for controlling fluid delivery.

The surface cleaning apparatus 10 can include at least one user interface 30, 32 through which a user can interact with the surface cleaning apparatus 10. The at least one user interface can enable operation and control of the apparatus 10 from the user's end, and can also provide feedback information from the apparatus 10 to the user. The at least one user interface can be electrically coupled with electrical components, including, but not limited to, circuitry electrically connected to various components of the fluid delivery and recovery systems of the surface cleaning apparatus 10, as described in further detail below.

In the illustrated embodiment, the surface cleaning apparatus 10 includes a first user interface (UI) 30 having one or more input controls, such as but not limited to buttons, triggers, toggles, keys, switches, or the like, operably connected to systems in the apparatus 10 to affect and control its operation. The first UI 30 comprise a human-machine interface (HMI). The surface cleaning apparatus 10 also includes a second user interface (UI) 32 that communicates a condition or status of the apparatus 10 to the user. The second UI 32 can comprise a status user interface (SUI). The second UI 32 can communicate visually and/or audibly, and can optionally include one or more input controls. The UIs 30, 32 can be provided as separate interfaces or can be integrated with each other, such as in a composite use interface, graphical user interface, or multimedia user interface. As shown, the UI 30 can be provided at a front side of the hand grip 26, with the trigger 28 provided on a rear side of the hand grip 26, opposite the UI 30, and UI 32 can be provided on a front side of the frame 18, below the handle 16 and above the base 14, and optionally above the recovery tank 22. In other embodiments, the UIs 30, 32 can be provided elsewhere on the surface cleaning apparatus 10. Examples of suitable user interfaces are disclosed in International Publication No. WO2020/082066, published Apr. 23, 2020, which is incorporated herein by reference in its entirety. Either UI 30, 32 can comprise a proximity-triggered interface, as described in the '066 publication.

Figure 3:
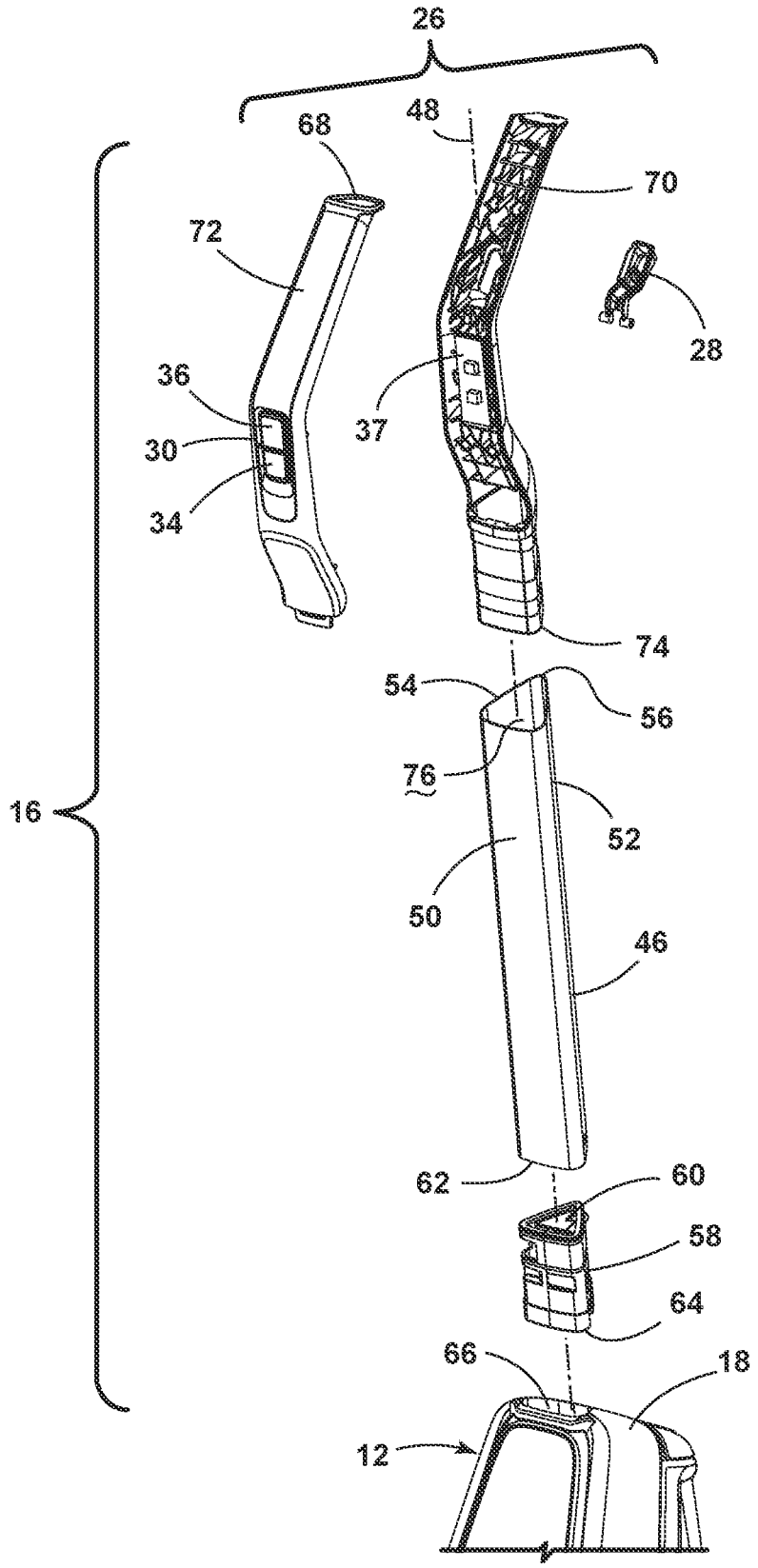
FIG. 3 is an exploded perspective view showing a handle of the apparatus.

The UI 30 can include one or more input controls 34, 36 in register with a printed circuit board (PCB) 37 within the hand grip 26 (FIG. 3). In one embodiment, one input control 34 is a power input control which controls the supply of power to one or more electrical components of the apparatus 10, as explained in further detail below, one of which may be the second UI 32. Another input control 36 is a cleaning mode input control which cycles the apparatus 10 between a hard floor cleaning mode, an area rug or carpet cleaning mode, and an intense cleaning mode or "booster" mode, as described in further detail below. One or more of the input controls 34, 36 can comprise a button, trigger, toggle, key, switch, or the like, or any combination thereof. In one example, one or more of the input controls 34, 36 can comprise a capacitive button.

The UI 32 can include a display 38, such as, but not limited to, an LED matrix display or a touchscreen, and is indicated in phantom line in FIG. 1. In one embodiment, the display 38 can include multiple status indicators which can display various detailed apparatus status information, such as, but not limited to, whether the apparatus is in the hard floor, area rug, or intense/booster cleaning mode, battery status, Wi-Fi connection status, clean water level, supply tank presence, dirty water level, recovery tank presence, filter status, floor type, self-cleaning, or any number of other status information. The status indicators can be a visual display, and may include any of a variety of lights, such as LEDs, textual displays, graphical displays, or any variety of known status indicators.

The UI 32 can include at least one input control 40, which can be adjacent the display 38 or provided on the display 38. The input control 40 can comprise a self-cleaning mode input control that initiates a self-cleaning mode of operation, as described in further detail below. The input control 40 can comprise a button, trigger, toggle, key, switch, or the like, or any combination thereof. In one example, the input control 40 can comprise a capacitive button.

Figure 2:
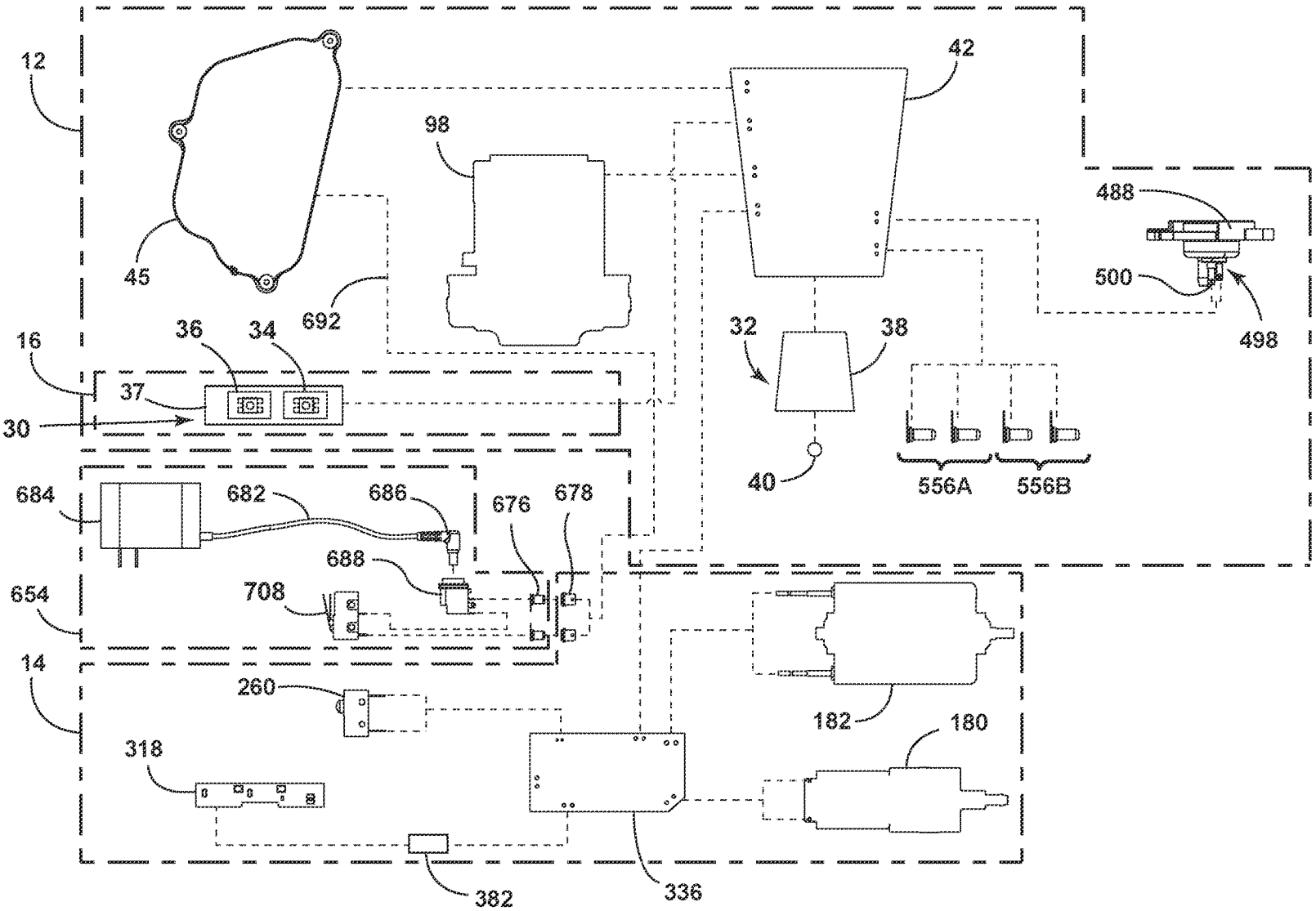
FIG. 2 is a schematic control diagram for the apparatus.

FIG. 2 shows one example of a schematic control diagram for the apparatus 10. The surface cleaning apparatus 10 can include a controller 42 operably coupled with the various functional systems of the apparatus, including, but not limited to, the fluid delivery and recovery systems, for controlling its operation. In one embodiment, the controller 42 can comprise a microcontroller unit (MCU) that contains at least one central processing unit (CPU).

A user of the apparatus 10 can interact with the controller 42 via one or more of the user interfaces 30, 32. For example, the controller 42 can be operably coupled with the first UI 30 for receiving inputs from a user and with the second UI 32 for providing one or more indicia about the status of the apparatus 10. The controller 42 can further be configured to execute a cleanout cycle for the self-cleaning mode of operation. The controller 42 can have software for executing the self-cleaning cycle.

The surface cleaning apparatus 10 can include a wireless communication module that can wirelessly communicate with an external device. Specifically, the wireless communication module may be a Wi-Fi module. The external device may, for example, be a smartphone (not shown) or tablet, which may be running a downloaded application for the apparatus 10, or a networked cloud device. The Wi-Fi module can detect the presence of a Wi-Fi network, signal strength, unique router identification data, or any combination thereof, and is configured to connect the apparatus 10 to the internet via a local Wi-Fi network. The Wi-Fi module can be integrated with the controller 42. Wi-Fi network connection status can be shown on display 38.

Electrical components of the surface cleaning apparatus 10 can be electrically coupled to a power source such as a battery 45, preferably a rechargeable battery 45, for cordless operation. In one example, the rechargeable battery 45 can be a lithium ion battery. In another exemplary arrangement, the battery 45 can comprise a user replaceable battery. In yet another embodiment, the surface cleaning apparatus 10 can comprise a power cord that is pluggable into a household outlet for corded operation.

Figure 4:
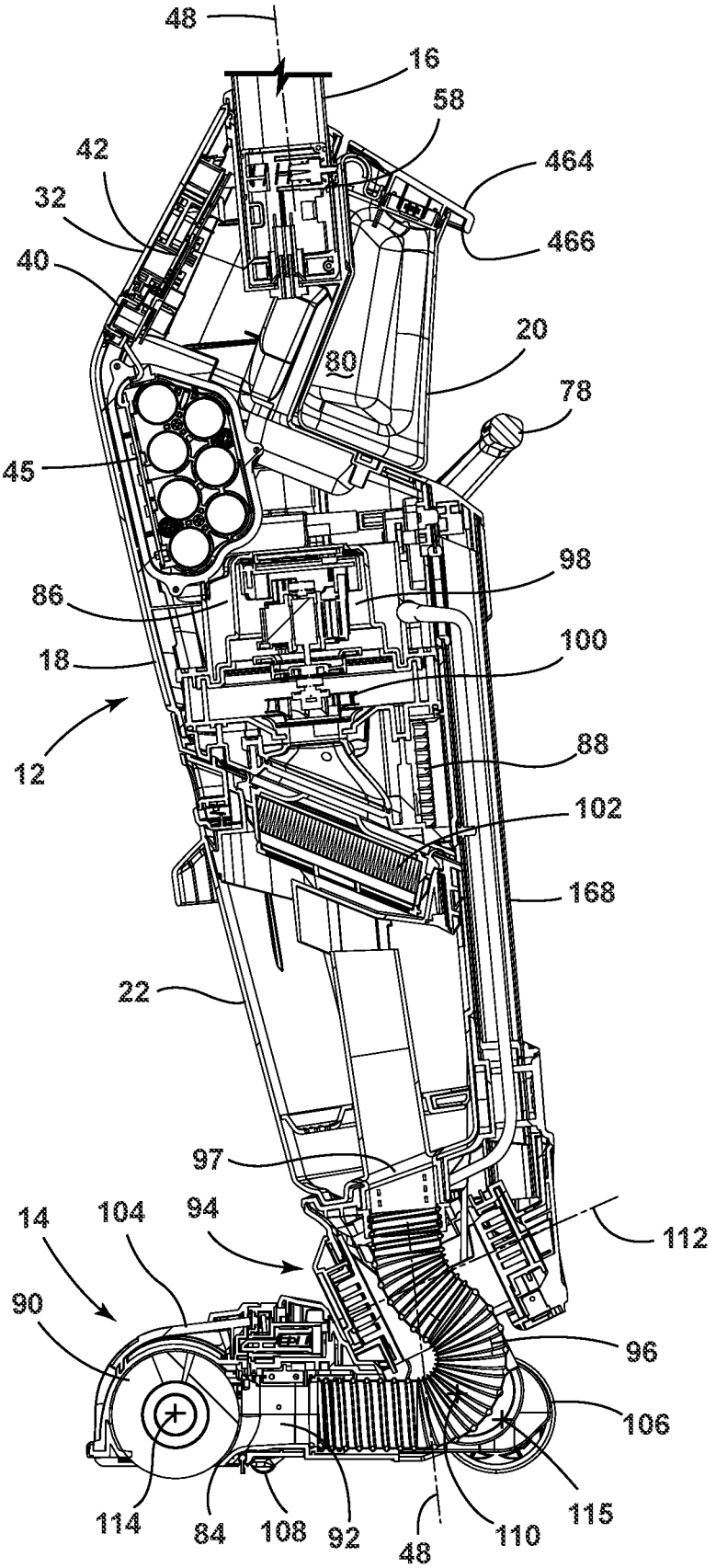
FIG. 4 is a cross-sectional view of the apparatus taken through line IV-IV of FIG. 1.

Referring additionally to FIG. 4, the controller 42 and battery 45 can be provided at various locations on the apparatus 10. In the illustrated embodiment, the controller 42 is located in the upright body 12, within the frame 18, and is integrated with the second UI 32. Alternatively, the controller 42 can be integrated with the first UI 30, or can be separate from both UIs 30, 32.

The battery 45 can be located within the upright body 12 or base 14 of the apparatus, which can protect and retain the battery 45 on the apparatus 10. In one embodiment, the components of the apparatus 10 are arranged with relative positioning that isolates the battery 45 from potential exposure to liquid, such as from leaks from the tanks 20, 22 or other components of the delivery and recovery systems. In the illustrated embodiment, the battery 45 is provided within the frame 18 of the upright body 12, above the recovery tank 22. The supply tank 20, and one or more conduits coupling the tank 20 to components of the delivery system in the base 14, can be disposed to the rear of the battery 45. Other arrangements of the components of the apparatus 10 are possible, while maintaining an isolated battery 45.

In one embodiment, the components of the apparatus 10 are arranged with relative positioning that provides an architecture that is well-balanced and comfortable for the user to operate as the apparatus 10 is moved along a surface to be cleaned. For example, locating the battery 45 above the recovery tank 22 and suction source 86 allows these components to be arranged in a generally linear, stacked orientation, which can provide a slim upright body 12 that is well-balanced and comfortable to operate. Other arrangements of the components of the apparatus 10 are possible, while maintaining a well-balanced and comfortably operable apparatus 10.

FIG. 3 is an exploded perspective view of the handle 16. The handle 16 can include a hollow handle tube 46 that is elongated vertically along a handle axis 48 and connects the hand grip 26 to the body 12. The handle tube 46 can comprise a triangular tube, with a first side 50, a second side 52, and third side 54 connected to each other in a triangle shape. The handle sides 50-54 can be generally planar or slightly curved, and meet at corners or vertices that can be rounded to distribute stress. The first side 50 can define a front side or front of the handle, with the second and third sides 52, 54 meeting at a vertex 56 that defines a rear of the handle tube 46.

A lower end of the handle tube 46 is insertable into to the frame 18. A bracket connector 58 at the lower end of the handle tube 46 can connect the handle tube 46 to the frame 18. The bracket connector 58 can have a triangular first female end 60 that tightly fits within a lower open end 62 of the triangular handle tube 46. The bracket connector 58 can have a triangular second female end 64 that fits within a frame opening 66 in an upper end of the frame 18. The two female ends 60, 64 of the bracket connector 58 can be press fit respectively into the frame tube 46 and 18 to mechanically join these components to one another, or joined using another suitable attachment means. One advantage of a triangular connection between the handle tube 46 and the bracket connector 58 is that it avoid twisting or displacement of the lower end of the tube 46 about axis 48. Other configurations for the handle tube 46 and the connection between the handle tube 46 and the frame 18 are possible.

The hand grip 26 can comprise a non-looped, stick-like grip, contoured for user comfort, and having a free terminal end 68. The UI 30 can be provided on a front side of the hand grip 26 and the trigger 28 can be provided on a rear side of the hand grip 26. In one embodiment, the hand grip 26 can comprise a rear grip portion 70 and a front grip portion 72 mated to the rear grip portion 70. A lower end 74 of the hand grip 26, opposite the free terminal end 68, is insertable into an upper open end 76 of the handle tube 46 to connect the hand grip 26 to the handle tube 46. The lower end 74 of hand grip 26 can have a triangular shape that tightly fits within the upper open end 76 of the triangular handle tube 46. The lower end 74 can be press fit into the tube 46 to irreversibly mechanically join these two components to one another. One advantage of a triangular connection between the hand grip 26 and handle tube 46 is that it avoid twisting or displacement of the upper end of the tube 46 about axis 48. Other configurations for the hand grip 26 and the connection between the hand grip 26 and the handle tube 46 are possible.

FIG. 4 is a cross-sectional view of the surface cleaning apparatus 10 through line IV-IV FIG. 1. The supply and recovery tanks 20, 22 can be provided on the upright body 12. The supply tank 20 can be mounted to the frame 18 in any configuration. In the present embodiment, the supply tank 20 can be removably mounted at the rear of the frame 18 such that the supply tank 20 partially rests in the upper rear portion of the frame 18 and is removable from the frame 18 for filling. The recovery tank 22 can be mounted to the frame 18 in any configuration. In the present embodiment, the recovery tank 22 can be removably mounted at the front of the frame 18, below the supply tank 20, and is removable from the frame 18 for emptying.

A carry handle 78 can be disposed on a rear side of the body 12, below the stick handle 16, and can project at an oblique angle relative to the handle axis 48 of the handle tube 46 to facilitate manual lifting and carrying of the surface cleaning apparatus 10. The carry handle 78 can extend from the body 12 at a location below the supply tank 20, and project upwardly to overlap a lower end of the supply tank 20, as best seen in FIG. 4. With the carry handle 78 overlapping the supply tank 20, the supply tank 20 is protected if the apparatus 10 tips over, but the supply tank 20 can still easily be inserted or removed by lifting the tank 20 up and over the carry handle 78.

The fluid delivery system is configured to deliver cleaning fluid from the supply tank 20 to a surface to be cleaned, and can include, as briefly discussed above, a fluid delivery or supply pathway. The supply tank 20 includes at least one supply chamber 80 for holding cleaning fluid. The cleaning fluid can comprise one or more of any suitable cleaning liquids, including, but not limited to, water, compositions, concentrated detergent, diluted detergent, etc., and mixtures thereof. For example, the liquid can comprise a mixture of water and concentrated detergent. Alternatively, supply tank 20 can include multiple supply chambers, such as one chamber containing water and another chamber containing a cleaning agent. It is noted that while the apparatus 10 described herein is configured to deliver a cleaning liquid, aspects of the disclosure may be applicable to surface cleaning apparatus that deliver steam. Thus, the term "cleaning fluid" may encompass both liquid and steam unless otherwise noted.

The recovery system is configured to remove liquid and debris from the surface to be cleaned and store the liquid and debris on the surface cleaning apparatus 10 for later disposal, and can include, as briefly discussed above, a recovery pathway. The recovery pathway can include at least a dirty inlet and a clean air outlet. The pathway can be formed by, among other elements, a suction nozzle 84 defining the dirty inlet, a suction source 86 in fluid communication with the suction nozzle 84 for generating a working air stream, the recovery tank 22, and at least one exhaust vent 88 defining the clean air outlet.

The suction nozzle 84 can be provided on the base 14 can be adapted to be adjacent the surface to be cleaned as the base 14 moves across a surface. A brushroll 90 can be provided adjacent to the suction nozzle 84 for agitating the surface to be cleaned so that the debris is more easily ingested into the suction nozzle 84. While a horizontally-rotating brushroll 90 is shown herein, in some embodiments, dual horizontally-rotating brushrolls, one or more vertically-rotating brushrolls, or a stationary brush can be provided on the apparatus 10.

The suction nozzle 84 is further in fluid communication with the recovery tank 22 through a conduit 92. The conduit 92 can pass through a moveable joint assembly 94 that connects the base 14 to the upright body 12 for movement of the body 12 about at least one axis, as described in further detail below. At least a portion of the conduit 92 can be flexible to accommodate the movement of the joint assembly 94. In the illustrated embodiment, a portion of the conduit 92 fluidly connecting the suction nozzle 84 with the recovery tank 22 can comprise a flexible tube or hose 96. The hose 96 can have an at least 90 degree bend therein to join a first portion of the conduit 92 connected to the suction nozzle 84 in the base 14 to an inlet 97 to the recovery tank 22 in the body 12.

The suction source 86, which can be a motor/fan assembly including a vacuum motor 98 and a fan 100, is provided in fluid communication with the recovery tank 22. The suction source 86 can be positioned within a housing of the frame 18, such as above the recovery tank 22. The suction source 86 can further be provided below the supply tank 20 and the battery 45. The recovery system can also be provided with one or more additional filters upstream or downstream of the suction source 82. For example, in the illustrated embodiment, a pre-motor filter 102 is provided in the recovery pathway downstream of the recovery tank 22 and upstream of the suction source 86.

In one embodiment, the vacuum motor 98 is a brushless DC motor. The fan 100 is driven by the motor 98 and can spin at a rate of up to 10,000 RPM. Brushless DC motors are more powerful and smaller than conventional motors and do not require the use of post motor filters because no carbon is produced. These motors can also conserve battery life in being light-weight and efficient. Due to the lack of brushes, brushless DC motors run more quietly and reduce operational noise associated with the apparatus 10. Other types of vacuum motors are possible. Depending on the motor-type, such as with a brushed DC motor or AC motor, a post-motor filter can be provided in the recovery pathway downstream of the suction source 86 and upstream of the vent 88.

The base 14 can include a base housing 104 supporting at least some of the components of the fluid delivery and recovery systems. A pair of wheels 106 for moving the apparatus 10 over the surface to be cleaned can be provided on the base housing 104, such as on a portion of the base housing 104 rearward of handle axis 48, optionally rearward of components such as the brushroll 90 and suction nozzle 84. A second pair of wheels 108 can be provided on the base housing 104, forward of the first pair of wheels 106. The second pair of wheels 108 can be forward of the handle axis 48, and rearward of components such as the brushroll 90 and suction nozzle 84.

Figure 5:
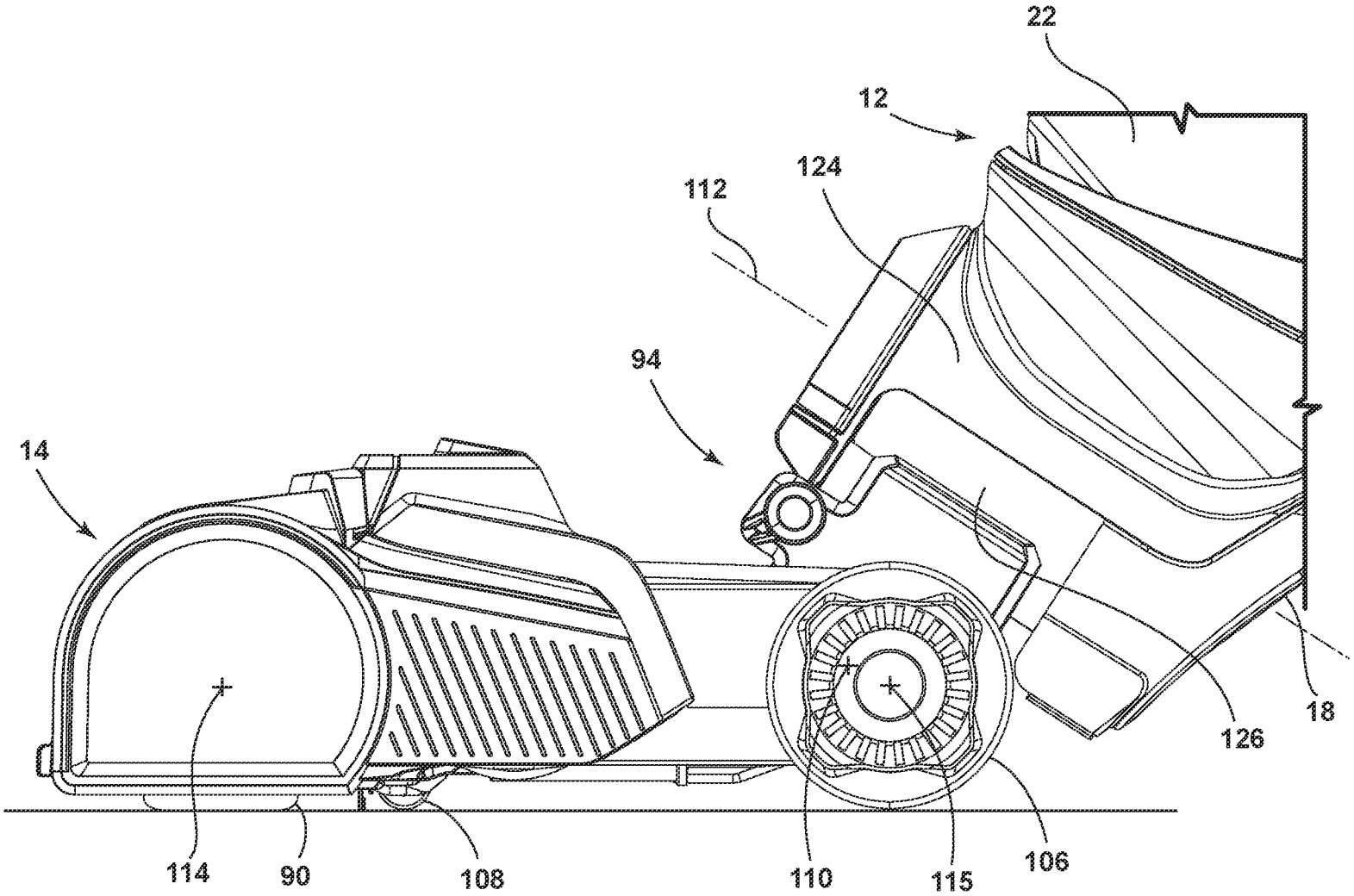
FIG. 5 is a side view of a lower portion of the apparatus from FIG. 1, showing the apparatus in a reclined position.
Figure 6:
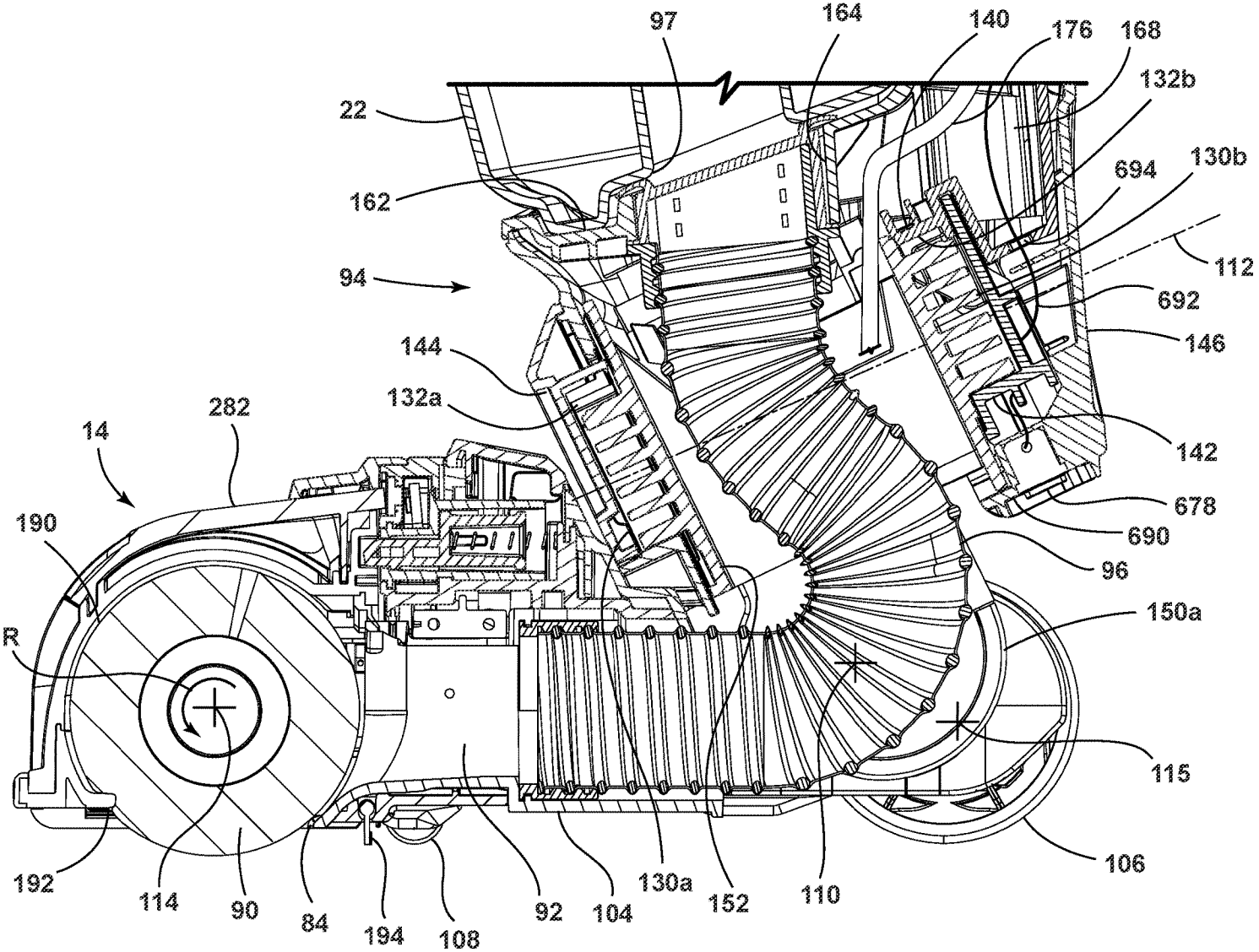
FIG. 6 is an enlarged view of a lower portion of FIG. 4, showing details of a base of the apparatus.

Referring to FIGS. 5-6, the moveable joint assembly 94 can be formed at a lower end of the frame 18 and moveably mounts the base 14 to the upright body 12. In the embodiment shown herein, the upright body 12 can pivot up and down about at least one axis relative to the base 14. The joint assembly 94 can alternatively comprise a universal joint, such that the upright body 12 can pivot about at least two axes relative to the base 14. Wiring and/or conduits can optionally supply electricity, air and/or liquid (or other fluids) between the base 14 and the upright body 12, or vice versa, and can extend though the joint assembly 94. For example, the flexible hose 96 (FIG. 4) can pass internally through the joint assembly 94.

The upright body 12 can pivot, via the joint assembly 94, to an upright or storage position, an example of which is shown in FIGS. 1 and 6, in which the upright body 12 is oriented substantially upright relative to the surface to be cleaned and in which the apparatus 10 is self-supporting, i.e. the apparatus 10 can stand upright without being supported by something else. From the storage position, the upright body 12 can pivot, via the joint assembly 94, to a reclined or use position, in which the upright body 12 is pivoted rearwardly relative to the base 14 to form an acute angle with the surface to be cleaned. One example of a reclined position is shown in FIG. 5. In this position, a user can partially support the apparatus 10 by holding the hand grip 26.

In one embodiment, the joint assembly 94 can comprise a multi-axis joint that couples the base 14 to the upright body 12 for movement about at least two axes of rotation 110, 112. The upright body 12 is pivotable relative to the base 14 about the first axis 110 between the upright storage position (FIGS. 1 and 6) and a reclined use position (e.g. FIG. 5). The body 12 pivotable relative to the base 14 about the second axis 112 to steer the base 14 as the base 14 moves over a surface. The body 12 can be pivoted about the axes 110, 112 by the user using the handle 16.

The first axis 110 can extend generally in a right-to-left direction, and can be defined by a pivot joint, as described in further detail below. The first axis 110 is offset from a brushroll axis 114 about which the brushroll 90 is rotatable relative to the base housing 104. The first axis 110 can be parallel to the brushroll axis 114 in the embodiment illustrated. In addition, in the illustrated embodiment, the first axis 110 can extend through the rear wheels 106 of the base 14. The first axis 110 is offset from a wheel axis 115 about which the wheels 106 rotate relative to the base housing 104. The first axis 110 can be parallel to the wheel axis 115 in the embodiment illustrated. In other embodiments, the first axis 110 can be coaxial with the wheel axis 115.

The second axis 112 can be defined by a swivel joint, as described in further detail below. The second axis 112 can be perpendicular to the first axis 110, and optionally also to the brushroll axis 114 and/or wheel axis 115, and extends generally in a front-to-back direction. In addition, the second axis 112 can be inclined relative to the surface when the body 12 is in the upright storage position such that the second axis 112 is at an acute angle (i.e. less than 90 degrees) relative to the surface as illustrated FIG. 4. In the upright storage position, the second axis 112 can be inclined in a forward, downward direction, such that the second axis 112 insects the surface at a location disposed forwardly of the first axis 110. When the body 12 is in the reclined use position, the second axis 112 in a rearward, downward direction, such that the second axis 112 insects the surface at a location disposed rearwardly of the first axis 110.

Figure 7:
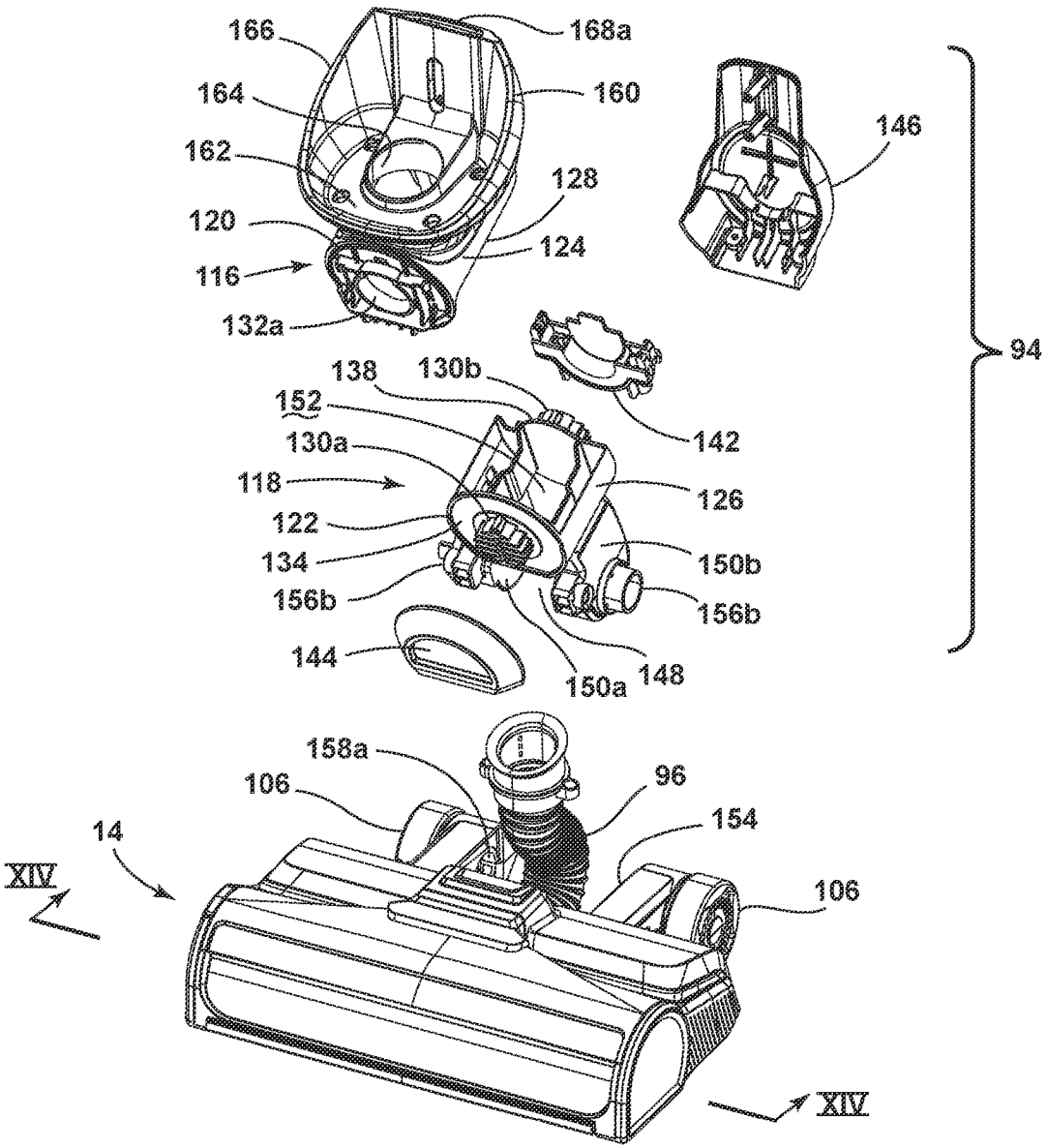
FIG. 7 is a partially exploded front perspective view of the base of the apparatus, showing details of one embodiment of a multi-axis joint assembly of the apparatus.

FIG. 7 shows the joint assembly 94 shown exploded from the base 14. The joint assembly 94 generally includes an upright connector 116 and a base connector 118. The upright connector 116 pivotally couples with the base connector 118 to define the second axis of rotation 112 about which the upright body 12 can rotate in a general side-to-side direction. The base connector 118 in turn pivotally couples with the base 14 and defines the first axis of rotation 110 about which the upright body 12 can rotate in a general front-to-back direction.

The upright connector 116 and base connector 118 have a barrel-in-barrel connection, with the upright connector 116 including an outer barrel 120 that receives an inner barrel 122 of the base connector 118. The outer barrel 120 can swivel about the inner barrel 122, and side-to-side movement of the upright body 12 about the second axis 112 to steer the base 14 results from rotation of the outer barrel 120 with respect to the inner barrel 122. The barrel-in-barrel connection can eliminate gaps pinch points between moving components of the swivel joint.

Each barrel 120, 122 can having a generally cylindrical sidewall 124, 126, with the inner cylindrical sidewall 126 nested within the outer cylindrical sidewall 124. The outer barrel 120 can include an opening 128 disposed at a lower end of the cylindrical sidewall 124 and that is sized for insertion of the inner barrel 122 into the outer barrel 120. The nested cylindrical barrels 120, 122 can have collinear axes that are coincident with the second axis 112.

As can be seen in the side view of FIG. 5, the outer cylindrical sidewall 124 can substantially cover the inner cylindrical sidewall 126. For example, the outer cylindrical sidewall 124 can cover more than 50% of the inner cylindrical sidewall 126, more than 60% of the inner cylindrical sidewall 124, more than 70% of the inner cylindrical sidewall 126, more than 80% of the inner cylindrical sidewall 126, or more than 90% of the inner cylindrical sidewall 126.

The inner barrel 122 can have trunnions 130*a*, 130*b* which are rotatably received in corresponding pivot openings 132*a*, 132*b* of the upright connector 116 for rotation about the second axis 112. The inner barrel 122 can have a forward end wall 134 at a forward side of the cylindrical sidewall 126 and a rearward end wall 136 at a rearward side of the cylindrical sidewall 126. The trunnions 130*a*, 130*b* can be oriented in opposition on the end walls 134, 136. The forward pivot opening 132*a* for the forward trunnion 130*a* can be formed in the outer barrel 120, for example in an end wall 138 at a forward side of the cylindrical sidewall 124. The rearward pivot opening 132*b* for the rearward trunnion 130*b* can be formed by multiple parts to aid in assembly of the barrels 120, 122. In the embodiment shown, the rearward pivot opening 132*b* is formed generally in two sections, a first section 140 disposed at a rearward side of the cylindrical sidewall 124 of the outer barrel 120 and a second section in the form of a clamp 142 that is attached to the first section 140 to clamp the trunnion 132 in place. In another embodiment, the rearward pivot opening 132*b* can be formed in the outer barrel 122 or in another portion of the upright connector 116.

The connection between the forward trunnion 130*a* and the forward pivot opening 132*a* can be enclosed by a front cover 144. The connection between the rearward trunnion 130*b* and the rearward pivot opening 132*b* can be enclosed by a rear cover 146. The rear cover 146 can be attached to the upper connector 116.

The base connector 118 include a yoke 148 pivotally coupled with the base 14. The yoke 148 can extend from the inner barrel 122 and can include a pair of yoke arms 150*a*, 150*b* that extend outwardly and/or downwardly from the inner barrel 122. The yoke arms 150*a*, 150*b* are spaced apart and the hose 96 can pass upwardly between the arms 150*a*, 150*b* and into the inner barrel 122. The inner barrel 122 can include an opening 152 disposed at a lower end of the cylindrical sidewall 126, generally between the yoke arms 150*a*, 150*b*, that is in alignment with the opening 128 of the outer barrel 122 for passage of the hose 96 into the barrel-in-barrel connection. One or both of the yoke arms 150*a*, 150*b* can be hollow for the passage of wiring and/or conduits through the joint assembly 94, as described in further detail below. Other configurations for the yoke 148 are possible, including configurations where the yoke 148 is separate from inner barrel 122.

The base 14 has a cradle 154 for accommodating the yoke 148. The yoke 148 has trunnions 156*a*, 156*b*, for example provided in opposition on the yoke arms 150*a*, 150*b*, which are rotatably received in pivot openings 158*a*, 158*b* (see FIG. 10), of the cradle 154 for rotation about the first axis 110. The opposing trunnions 156*a*, 156*b* can extend generally orthogonally from the yoke arms 150*a*, 150*b* and at least one of the trunnions 156*a*, 156*b* can be hollow for the passage of wiring and/or conduits through the joint assembly 94, as described in further detail below.

A lower end of the frame 18, such as or including a recovery tank support 160 for mounting the recovery tank 22 on the upright body 12, can be integrated with the joint assembly 94. In one embodiment, the support 160 can be carried on the outer barrel 120, such as by being integrally formed with the outer barrel 120, or can be formed separately and attached to the outer barrel 120. Other configurations for supporting the recovery tank 22 are possible, including configurations where the support 160 or other mounting structure for the recovery tank 22 is separate from outer barrel 120, or from the upright connector 116, or from the joint assembly 94 as a whole.

The support 160 can include a base 162 with an opening 164 formed therethrough and to which the hose 96 is fluidly coupled. As previously described, the recovery pathway can include flexible hose 96 extending through joint assembly 94, which will flex as the joint assembly 94 is articulated about its axes of rotation 110, 112. The hose 96 can extend through the 154 and upwardly into the yoke 148 and through the nested barrels 120, 122 to the opening 164 in the support 160 for the recovery tank 22. A wall 166 can extend upwardly from the base 162, partially or fully around the base 162, to help support the recovery tank 22 when seated on the support 160.

Figure 8:
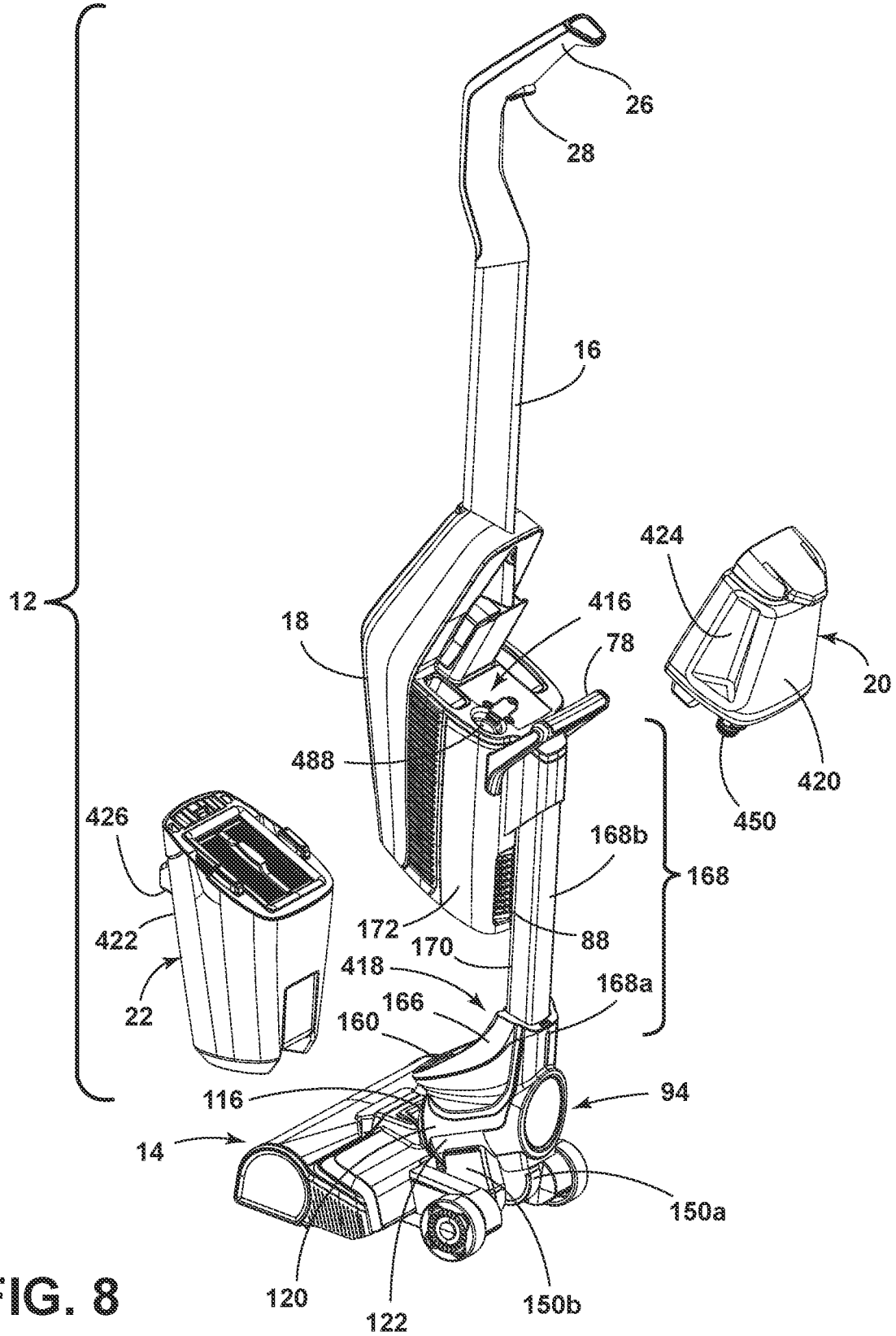
FIG. 8 is a rear view of the apparatus, showing a supply tank and a recovery tank exploded from an upright body.

With reference to FIGS. 4 and 8, in the embodiment illustrated herein, at least a portion of a chase 168 can be integrated with the joint assembly 94 and can comprise a conduit large enough to accommodate wiring and/or conduits which supply electricity, air and/or liquid (or other fluids) between the base 14 and the upright body 12, or vice versa. For example, while not shown herein, wiring for supplying electricity to electrical components in the base 14, for example, a pump 180, brush motor 182, and headlight 316, can extend through the chase 168.

The chase 168 can be disposed at a rearward side of the upright body 12 for routing wiring and/or conduits through a space isolated from potential exposure to liquid, such as from leaks from the tanks 20, 22 or other components of the delivery and recovery systems. For example, the chase 168 can be disposed rearwardly of the recovery tank 22. The chase 168 is also rearward of the suction source 86 and battery. The partial, or full, integration of the chase 168 with the joint assembly 94 can provide a slim upright body 12 that is well-balanced and comfortable to operate.

In one embodiment, the chase 168 can include a lower chase 168*a* integrated with the joint assembly 94 and an upper chase 168*b* connected to the lower chase 168*a*. The lower chase 168*a* can be integrally formed with the upright connector 116 to partially integrate the chase 168 with the joint assembly 94. For example, the lower chase 168*a* can generally extend upwardly with respect to the outer barrel 120. The lower chase 168*a* can be disposed adjacent to or defined by the supporting wall 166, with the chase 168 thereby also defining a portion of the support 160 for the recovery tank 22.

The upper chase 168*b* can be formed by an elongated structural support or spine member 170 of the frame 18. The spine member 170 can at least partially support the recovery tank 22 when mounted on the frame 18, for example, in cooperation with the recovery tank support 160. A frame housing 172, for example enclosing and/or supporting component such as the suction source 86 and the supply tank 20, can be supported by an upper portion of the spine member 170, and can generally project forwardly from the spine member 170 such that the frame housing 172 is disposed to the front of the spine member 170.

A lower end of the chase 168 can be open to or otherwise connectable with one, and optionally both, of the yoke arms 150*a*, 150*b*, which can be hollow for the passage of wiring and/or conduits through the associated trunnion 156*a*, 156*b* and into the base 14.

Figure 9:
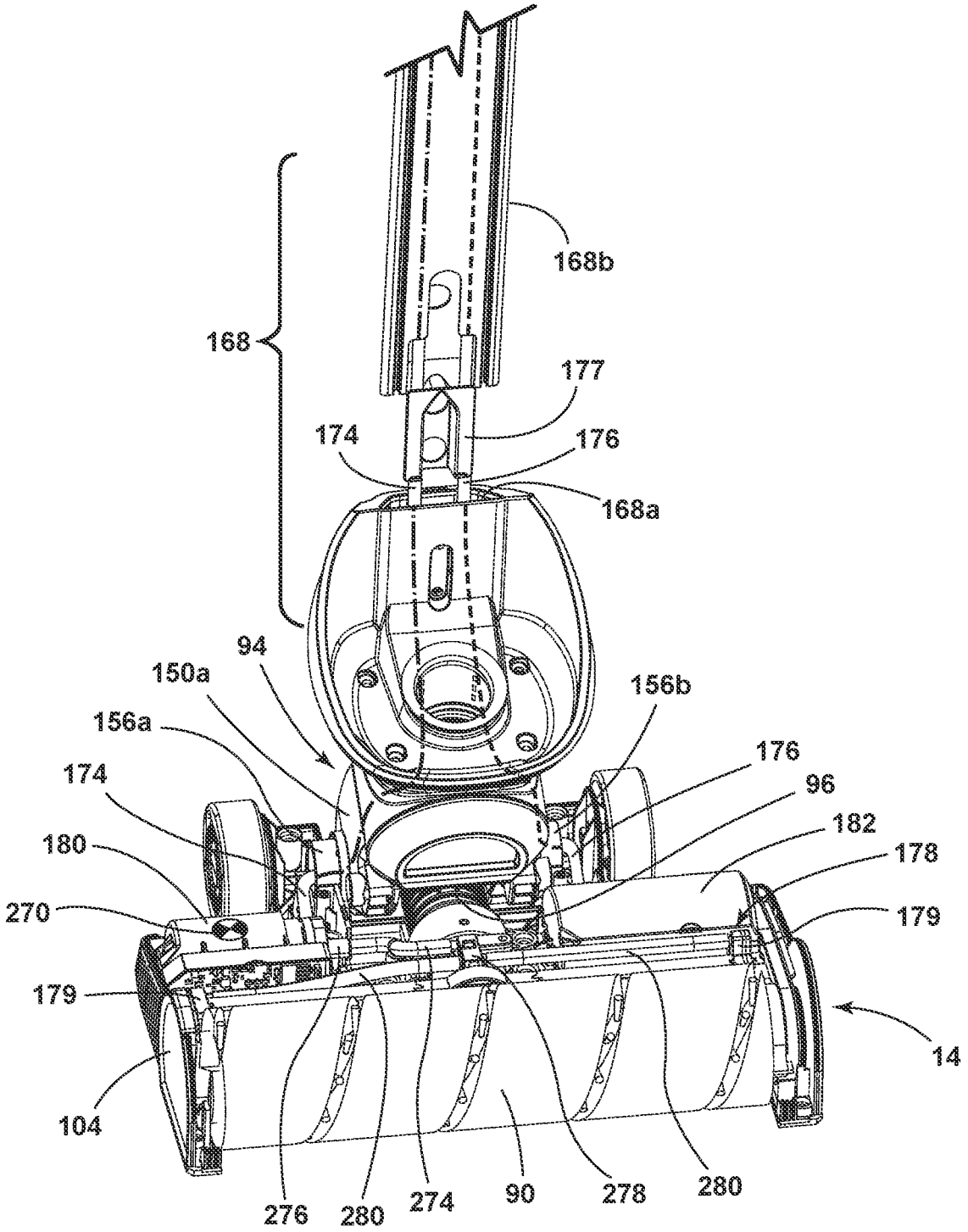
FIG. 9 is a partially exploded view of a lower portion of the apparatus, with an upper portion of a base housing removed and a chase exploded out from the joint assembly for clarity.

FIG. 9 is a partially exploded view showing the base 14, joint assembly 94, and chase 168, where an upper portion of the base housing 104 is removed and the chase 168 is exploded out from the joint assembly 94 for clarity. In one embodiment, the delivery pathway for the delivery system can extend through the joint assembly 94. The delivery pathway can include a conduit 174 extending through the chase 168 and carrying cleaning liquid from the supply tank 20 (FIG. 4) to a pump 180 in the base 14, as described in further detail below. The conduit 174 can comprise a flexible hose or tubing which will flex as the joint assembly 94 is articulated. From the chase 168, the conduit 174 can extend through yoke arm 150*a* and trunnion 156*a* to pass into the base housing 104.

In one embodiment, a motor cooling air path can extend through the joint assembly 94. The motor cooling air path can include a conduit 176 extending through the chase 168 and carrying heated air from a brush motor 182 in the base 14 to the suction source 86 (FIG. 4) in the upright body 12, as described in further detail below. The conduit 176 can comprise a flexible hose or tubing which will flex as the joint assembly 94 is articulated. From the chase 168, the conduit 176 can extend through yoke arm 150*b* and trunnion 156*b* to pass into the base housing 104.

The chase 168 can contain one or more internal features that aid in routing multiple wires and/or conduits through the chase 168. In one embodiment, a splitter 177 can divide the inside the chase 168 into two or more sections, for example to direct at least one wire and/or conduit toward one lateral side of the chase 168 and toward the yoke arm 150*a* on that lateral side of the chase 168 and to direct at least one other wire and/or conduit toward the other lateral side of the chase 168 and toward the other yoke arm 150*b* on that lateral side of the chase 168. In the embodiment shown in FIG. 9, the splitter 177 directs the liquid conduit 174 to one side of a divider and directs the heated air conduit 176 to the other side of the divider.

Figure 10:
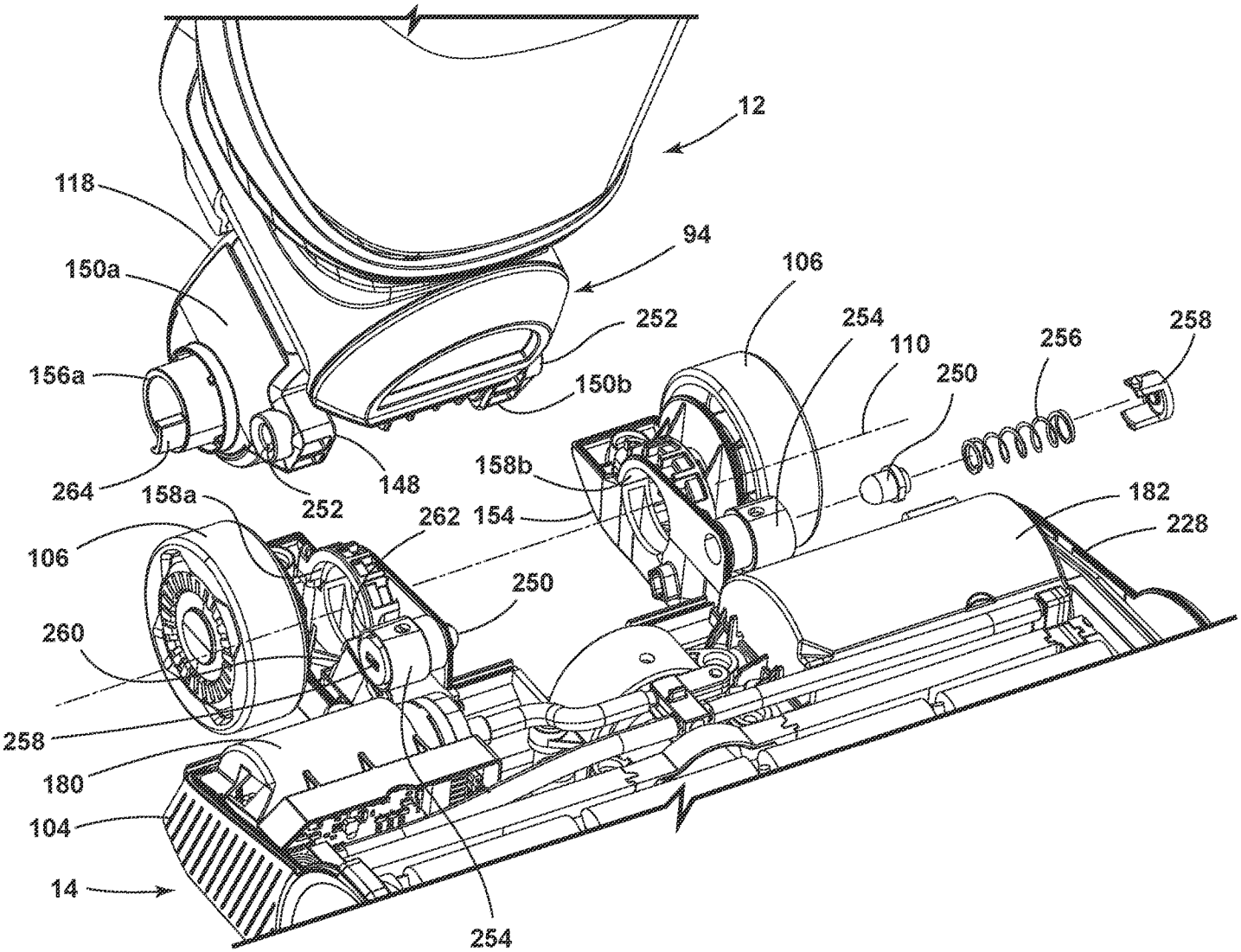
FIG. 10 is a partially exploded view of a lower portion of the apparatus, showing details of one embodiment of a latch for maintaining the apparatus in an upright, storage position.

Referring to FIG. 10, a latching mechanism can be provided to latch and retain the upright body 12 in the storage position, an example of which is shown in FIG. 1, which allows the apparatus 10 to be self-supporting. In one embodiment, the latching mechanism can be integrated with the joint assembly 94, and can include spring-loaded detent pins 250 that selectively engage detent pockets 252 in the joint assembly 94 to prevent movement of the joint assembly 94 about at least one of its axes. The latching mechanism can be configured to releasably latch or retain, but not lock, the upright body 12 to the base housing 104, such that a user can conveniently apply sufficient force to the upright body 12 itself, such as via the handle 16, to pivot the upright body 12 away from the storage position, e.g. to a reclined use position. For example, the user can step on the base 14 while pulling the handle 16 rearwardly to disengage the detent pins 250 from the pockets 252. In FIG. 10, an upper portion of the base housing 104 and conduits running between the upright body 12 and base 14 are removed for clarity.

The pin 250 can be captured in a detent mount 254 formed on, or attached to, the base housing 104. The detent mount 254 can extend generally horizontally and is generally aligned with the detent pocket 252 when the upright body 12 is upright, which permits the pin 250 to move generally horizontally towards and away from the detent pocket 252. The spring-loaded detent pins 250 thereby generally move horizontally along a pin axis, and the pin axis may be parallel to first axis of rotation 110, shown in FIG. 10 as extending through pivot openings 158 of the base cradle 154. The detent mount 254 can be mounted within the base housing 104 to support the detent pin 250 in a generally fixed location on the base 14.

A spring 256 is provided between the pin 250 and an end of the mount 254 to bias the pin 250 in an inward lateral direction, i.e. toward the detent pocket 252. The end of the mount 254 can be formed by an insert 258 attached to the mount 254, with the spring 256 sandwiched between the insert 258 and pin 250. In FIG. 10, the detent pins 250, spring 256, and insert 258 on one side of the base 14 shown exploded from the mount 254.

When the upright body 12 is in the upright storage position, the detent pin 250 is aligned with the detent pocket 252, and the spring 256 moves the pin 250 into the pocket 252. The pin 250 and pocket 252 may be tapered, for example having complementary convex and concave shapes as shown in FIG. 10, so that a sufficient force applied to pivot the upright body 12 backwards relative to the base 14 will force the pin 250 back against the spring 256 and thereby clear the pocket 252. Other contoured configurations for the pin 250 and/or pocket 252 to releasably latch or retain, but not lock, the upright body 12 to the base housing 104 are possible.

The detent pocket 252 can be provided on the yoke 148 of the base connector 118. For example, the detent pockets 252 can be formed on, or otherwise connected to, the yoke arms 150*a*, 150*b*, forward of the trunnions 156*a*, 156*b*. The cradle 154 for accommodating the yoke 148 can include the pins 250. For example, the mounts 254 can support the pins 250 on opposing sides of the cradle 154, with the pins 250 forward of the pivot openings 158*a*, 158*b* of the cradle 154.

In the embodiment shown in FIG. 10, two spring-loaded detent pins 250 and corresponding detent pockets 252 are provided. The pins 250 are arranged in opposition, with their associated springs 256 biasing the pins 250 inwardly. The pockets 252 are formed on opposing sides of the yoke 148. In other embodiments, one spring-loaded detent pin 250 and corresponding detent pocket 252 may be sufficient to provide sufficient retaining force to latch and retain the upright body 12 in the storage position.

The apparatus 10 can include a brush motor switch 260 in the base housing 104 that is configured to supply power to the brush motor 182 when the upright body 12 is reclined and cut off power to the brush motor 182 when the upright body 12 is in the storage position. It is noted that main power to the apparatus 10 is selectively controlled by the power input control 34 on the handle 16 as previously described.

The brush motor switch 260 can be integrated with the detent latching mechanism, or located elsewhere on the base 14. In one embodiment, the brush switch 260 can be mounted to one of the detent mounts 254. For example, one of the detent mounts 254 can include a switch holder 262 for supporting the brush switch 260 in a generally fixed location on the base 14.

A projection 264 on a portion of the joint assembly 94 that moves relative to the base 14, for example the base connector 118, is relatively positioned with respect to the switch 260 to contact an actuator of the switch 260 to turn off the brush motor 182 when upright body 12 moved to storage position. In one embodiment, the projection 264 extends from the trunnion 156*a* of the yoke 148.

The brush motor switch 260 can be configured to close and supply power to the brush motor 182 when the upright body 12 is reclined during use. When the upright body 12 is reclined, the projection 264 releases the actuator of the brush motor switch 260, which closes the brush motor switch 260 and supplies power to the brush motor 182. When the upright body 12 is returned to the upright storage position, the projection 264 engages the actuator, which opens the brush motor switch 260 and cuts off power to the brush motor 182.

Referring to FIG. 9, the fluid delivery system can further comprise a flow control system for controlling the flow of liquid from the supply tank 20 to a distributor 178 configured to distribute or dispense the liquid. In one configuration, the flow control system can comprise a pump 180 that pressurizes the system. The pump 180 can be positioned within a housing of the base 14, and is in fluid communication with the supply tank 20, for example via conduit 174 that may pass interiorly to joint assembly 94.

In addition to the supply tank 20 (FIG. 3), the conduit 174, and pump 180, the fluid delivery pathway can include a distributor 178 having at least one outlet for applying the cleaning liquid to the surface to be cleaned. The trigger 28 (FIG. 1) can be operably coupled with the flow control system such that pressing the trigger 28 will deliver liquid from the pump to the distributor 178.

In one embodiment, the distributor 178 can be one or more spray tips 179 on the base 14 configured to spray cleaning liquid to the surface to be cleaned directly or indirectly by spraying the brushroll 90. Other embodiments of the distributor 178 are possible, such as a spray manifold having multiple outlets or a spray nozzle configured to spray cleaning liquid outwardly from the base 14 in front of the surface cleaning apparatus 10.

In one embodiment, the distributor 178 can include a pair spray tips 179 that can be laterally-spaced from each other and enclosed within the base housing 104. Each spray tip 179 can include at least one outlet to deliver liquid to the surface to be cleaned, and can be in fluid communication with the brushroll 90 to deliver liquid directly to the brushroll 90, or can otherwise be position to deliver liquid directly to the surface to be cleaned. With a pair of laterally-spaced spray tips 179 as shown, the spray tips 179 can optionally be oriented to spray liquid inwardly across a portion of the brushroll 90. Other spray patterns are possible.

The delivery system can include a valve in the fluid pathway extending between the supply tank 20 and the pump 180. In one embodiment of the apparatus 10, the pump 180 can comprise a diaphragm pump with an integrated check valve 270, indicated schematically in FIG. 9, that prevents leaking, for example when the apparatus 10 powered on and the trigger 28 is not depressed. In another embodiment, the check valve 270 can be separate from the diaphragm pump 180. In yet another embodiment, the pump 180 can comprise another type of pump (e.g. other than a diaphragm pump) integrated with check valve 270. Yet other pumps are possible, such as a centrifugal pump or a solenoid pump having a single, dual, or variable speed.

The conduit 174 connects the supply tank 20 with an inlet of the pump 180. In embodiments where the check valve 270 is integrated with the pump 180, the pump inlet can also be the inlet for the check valve 270.

A pump outlet conduit 274 can fluidly connect an outlet 276 of the pump 180 to the distributor 178. In one embodiment, the pump outlet conduit 274 can connect to a Y-connector 278 having outlets for each of the spray tips 179. A delivery conduit 280 is fluidly connected to each of the spray tips 179 at a terminal end thereof. The pump outlet and delivery conduits 274, 280 can comprise flexible hose or tubing.

In another configuration of the supply pathway, the pump 180 can be eliminated and the flow control system can comprise a gravity-feed system having a valve fluidly coupled with an outlet of the supply tank 20, whereby when valve is open, liquid will flow under the force of gravity to the distributor 178.

Optionally, a heater (not shown) can be provided for heating the cleaning liquid prior to delivering the cleaning liquid to the surface to be cleaned. In one example, an in-line heater can be located downstream of the supply tank 20, and upstream or downstream of the pump 180. Other types of heaters can also be used. In yet another example, the cleaning liquid can be heated using exhaust air from a motor cooling air path for the suction source 86 of the recovery system.

The brushroll 90 can be operably coupled to and driven by a drive assembly including a dedicated brushroll motor or brush motor 182 in the base 14. The coupling between the brushroll 90 and the brush motor 182 can comprise one or more belts, gears, shafts, pulleys or combinations thereof. Alternatively, the vacuum motor 98 (FIG. 3) can be configured to provide both vacuum suction and brushroll rotation.

In the illustrated embodiment, the pump 180 and the brush motor 182 are contained within a rear section of the base housing 104. The hose 96 can pass between the pump 180 and the brush motor 182, and can generally bisect the rear of the base housing 104 into a pump cavity in which the pump 180 is located and a brush motor cavity in which the brush motor 182 is located. The cradle 154 for the joint assembly 94 can extend rearwardly from the base housing 104. The pump 180 and brush motor 182 can be located on opposing sides of the second axis of rotation 112 of the joint assembly 94, e.g. the pump 180 and brush motor 182 are laterally spaced from each other in the base 14.

Referring to FIG. 6, the brushroll 90 can be provided at a forward portion of the base 14 and received in a brush chamber 190 on the base 14. The brushroll 90 is positioned for rotational movement in a direction R about rotational axis 114. The brush chamber 190 can be disposed at a forward section of the base 14. In the present embodiment, the suction nozzle 84 is configured to extract liquid and debris from the brushroll 90 and from the surface to be cleaned.

An interference wiper 192 is mounted at a forward portion of the brush chamber 190 and is configured to interface with a leading portion of the brushroll 90, as defined by the direction of rotation R of the brushroll 90. The interference wiper 192 is generally below the distributor 178 (FIG. 9), such that the wetted portion brushroll 90 rotates past the interference wiper 192, which scrapes excess liquid off the brushroll 90, before reaching the surface to be cleaned. Optionally, the interference wiper 192 can be disposed generally parallel to the surface to be cleaned. Other locations for the wiper 192 in relation to the brushroll 90, where the wiper 192 is configured to interface with a portion of the brushroll 90, are possible.

The wiper 192 can be rigid, i.e. stiff, and non-flexible, so the wiper 192 does not yield or flex by engagement with the brushroll 90. Optionally, the wiper 192 can be formed of rigid thermoplastic material, such as poly(methyl methacrylate) (PMMA), polycarbonate, or acrylonitrile butadiene styrene (ABS). In other embodiments, the wiper 192 can be flexible.

A squeegee 194 is mounted to the base housing 104 behind the brushroll 90 and the brush chamber 190 and is configured to contact the surface as the base 14 moves across the surface to be cleaned. The squeegee 194 wipes residual liquid from the surface to be cleaned so that it can be drawn into the recovery pathway via the suction nozzle 84, thereby leaving a moisture and streak-free finish on the surface to be cleaned. Optionally, the squeegee 194 can be disposed generally orthogonal to the surface to be cleaned, or vertically. The squeegee 194 can be smooth as shown, or optionally comprise nubs on the end thereof.

The squeegee 194 can be pliant, i.e. flexible or resilient, in order to bend readily according to the contour of the surface to be cleaned yet remain undeformed by normal use of the apparatus 10. Optionally, the squeegee 194 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the apparatus 10.

Figure 11:
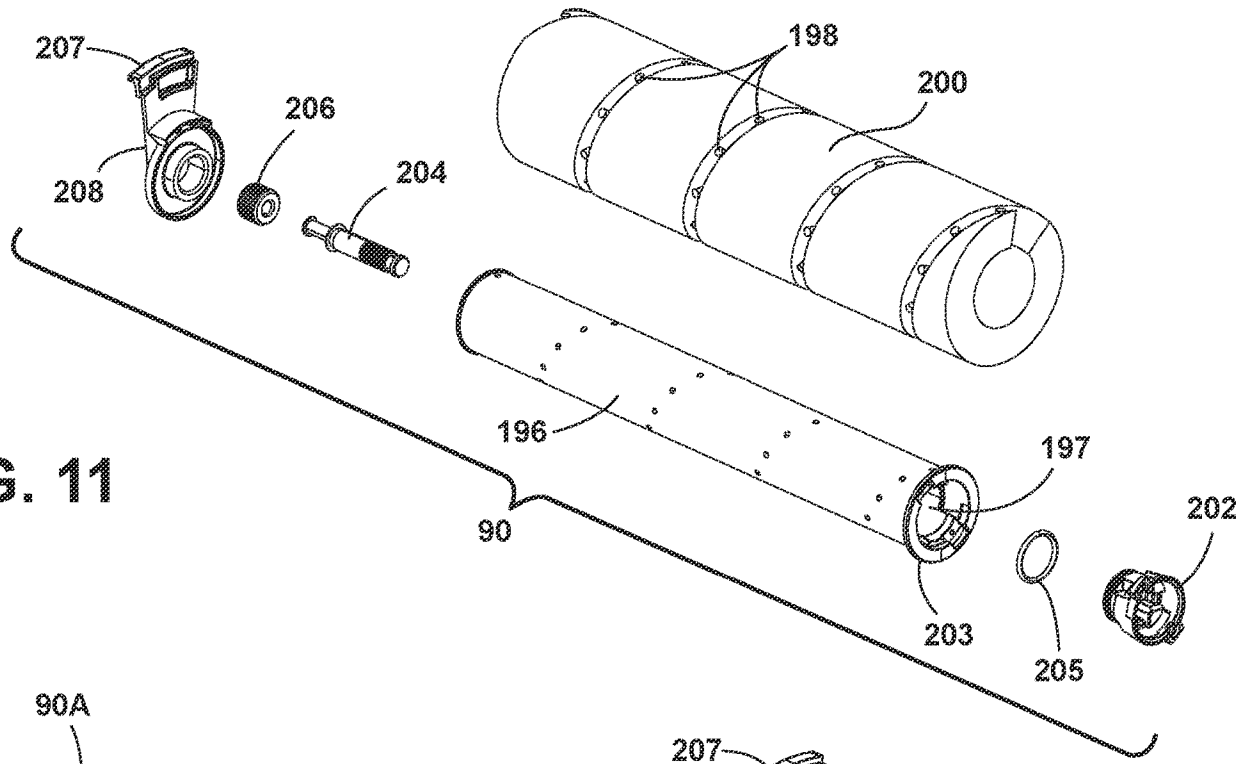
FIG. 11 is an exploded view of one embodiment of a brushroll of the apparatus.

FIG. 11 is an exploded view of one embodiment of the brushroll 90. The brushroll 90 can be a hybrid brushroll suitable for use on both hard and soft surfaces, and for wet or dry vacuum cleaning. In one embodiment, the brushroll 90 comprises a brush bar 196 supporting at least one agitation element. The agitation element can comprise a plurality of bristles 198 extending from the brush bar 196 and microfiber material 200 provided on the brush bar 196 and arranged between the bristles 198. Bristles 198 can be tufted or unitary bristle strips and constructed of nylon, or any other suitable synthetic or natural fiber. The microfiber material 200 can be constructed of polyester, polyamides, or a conjugation of materials including polypropylene or any other suitable material known in the art from which to construct microfiber.

Brush bar 196 can be constructed of a polymeric material such as acrylonitrile butadiene styrene (ABS), polypropylene or styrene, or any other suitable material such as plastic, wood, or metal, and can optionally be a hollow core brush bar 196 that is substantially hollow or cored out to reduce the weight and rotational inertia of the brush bar 196. In one example, the brush bar 196 can be manufactured by injection molding in which the cored out portion of the brush bar 196 is formed by one or more core(s) or protrusion(s) within an injection mold. In being substantially hollow or cored out, the brush bar 196 can have empty space formed therein, particularly at a center of the brush bar 196 which is located on the brushroll axis 114. In one example, there is at least one hollow space or cavity 197 within the brush bar 196, in contrast to brushroll dowels that have solid cores. The hollow space or cavity 197 may extend from end-to-end. In other words, the cavity 197 can extend along the brushroll axis 114 from a first end of the brush bar 196 to a second end of the brush bar 196, including extended through each end so that the ends of the brush bar 196 open to the cavity 197. Alternatively, the cavity 197 may extend inwardly from one or both ends of the brush bar 196 without extending all the way through to the other end of the brush bar 196. In yet another configuration, the cavity 197 may extend within a section of the brush bar 196 between the ends thereof, without actually extending through either end. In yet another configuration, the cavity 197 extends at least 50% of the length of the brush bar 196 and has a diameter of at least 50% of the outer diameter of the brushroll 90. In yet another configuration, the cavity 197 extends 100% of the length of the brush bar 196 and has a diameter of at least 50% of an outer diameter of the brush bar 196. Using a hollow or cored out brush bar 196 to support the agitation element (e.g. bristles 198 and/or microfiber 200) can reduce the overall weight of the brushroll 90, which can reduce the level of torque necessary to drive the brushroll 90, which can in turn extend battery life.

The brush bar 196 includes a drive end cap 202 at one end thereof that couples with a drive assembly or transmission, one embodiment of which is described in further detail below. The drive end cap 202 can be separate feature that is connected or joined to the brush bar 196.

The brushroll 90 includes a ferrule 203 on the first end, or driven end, of the brush bar 196 and the drive end cap 202 is inserted through the ferrule 203 into the cavity 197 of the brush bar 196. Other configurations for insertion of the end cap 202 into the brush bar 196 are possible, including inserting the end cap 202 into a hole drilled or otherwise formed in the end of the brush bar. The ferrule 203 can be integrally molded with the brush bar 196, or can be formed separately and attached to the end of the brush bar 196.

The end cap 202 can be connected or joined to the brush bar 196 in a number of ways such as for example, but not limited to, mechanical interference fit, adhesive, fastening components, and so forth. Optionally, an intermediate seal or gasket 205 may fit therebetween. In any event, the end cap 202 and the brush bar 196 are joined together such that upon rotation of the end cap 202, the brush bar 196 rotates with the end cap 202. In yet another embodiment, the end cap 202 and the brush bar 196 may be combined as a single part. In such a single part configuration the end cap 202 and the brush bar 196 can be integrated into a single part both supporting an agitation element (e.g. bristles 198 and/or microfiber 200) and coupleable with a drive assembly or transmission as described below.

The second end of the brush bar 196 includes an end assembly that rotatably supports the brushroll in the base 14. The end assembly can, for example, include a stub shaft 204 extending from the second end of the brush bar 196 and a bearing 206 having an inner race press fitted on the stub shaft 204 and an outer race fixed in a second end cap 208 that mounts in the base housing 104.

Optionally, the brushroll 90 can be configured to be removed by the user from the base 14, such as for cleaning and/or drying the brushroll 90. The brushroll 90 can be removably mounted in the brush chamber 190 (FIG. 6) by a brushroll latch (not shown), a portion of which can be provided on the second end cap 208, with a mating portion provided in the brush chamber 190. A grip 207 can extend from the second end cap 208 to aid in removal of the brushroll 90 from the brush chamber 190.

Figure 13:
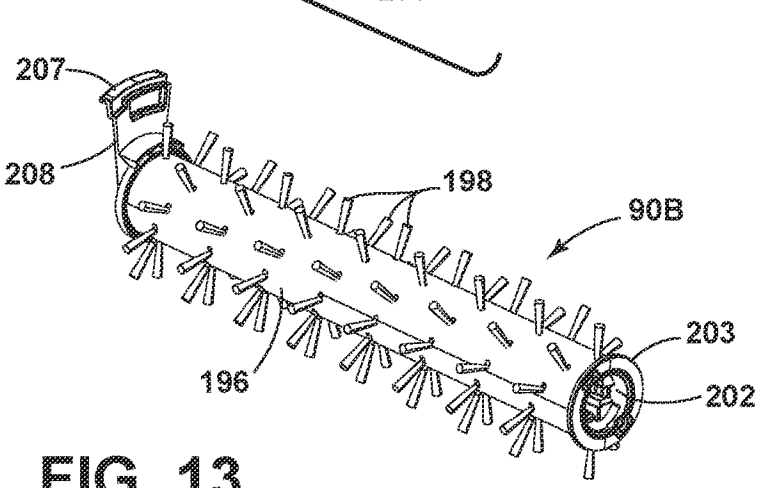
FIG. 13 is a perspective view of yet another embodiment of a brushroll for the apparatus.
Figure 12:
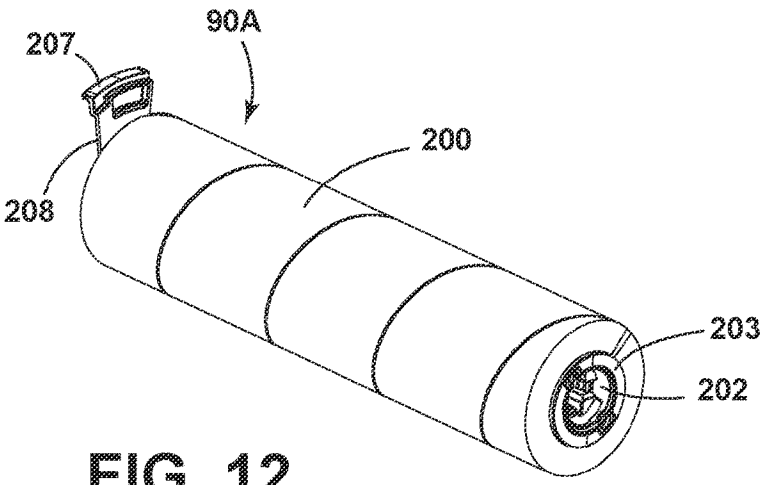
FIG. 12 is a perspective view of another embodiment of a brushroll for the apparatus.

Other embodiments of brushrolls 90A, 90B for the apparatus 10 are shown in FIGS. 12-13. Brushroll 90A is a bristle brushroll suitable for use on soft surfaces, and comprises bristles 198 and no microfiber material 200. Brushroll 90B is microfiber brushroll suitable for use on hard surfaces and comprises microfiber material 200 and no bristles 198.

In one embodiment, the apparatus 10 can be provided with multiple, interchangeable brushrolls, including any or all of brushroll 90, 90A, and 90B, which allows for the selection of a brushroll depending on the cleaning task to be performed or depending on the floor type of be cleaned. The brushroll 90, 90A, and 90B can be removably mounted to the base 14, and can have the same mounting structure such that one brushroll can be swapped out for another brushroll. For example, the brushrolls 90A and 90B can have the substantially the same end assemblies, including end caps 202, 208, as described for the brushroll 90. Yet another advantage of having multiple, interchangeable brushrolls is that cleaning time can be extended by allowing a soiled brushroll to be swapped out for a clean brushroll during a cleaning task.

Figure 14:
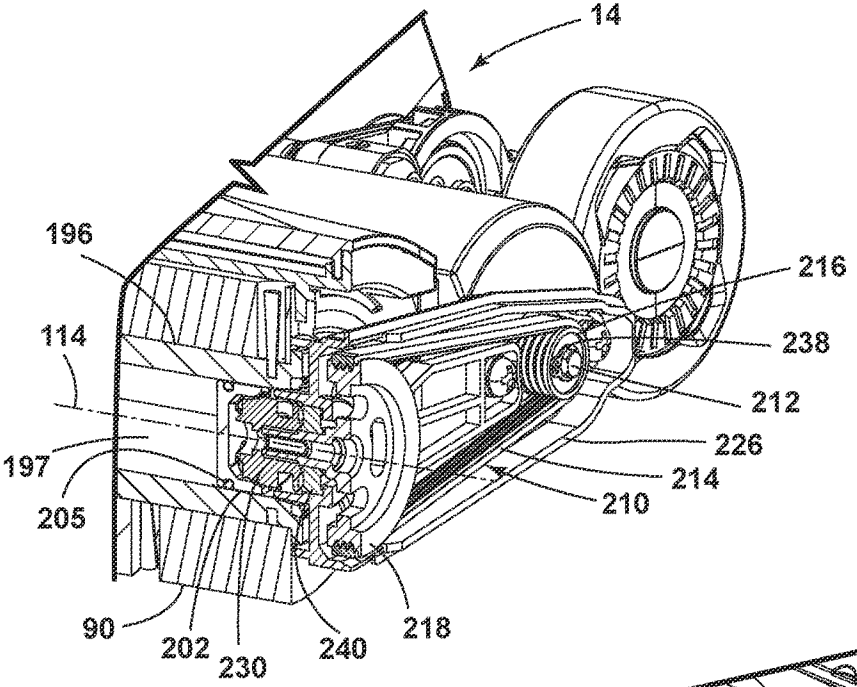
FIG. 14 is an enlarged cross-sectional view of the base taken through line XIV-XIV of FIG. 7, and in which a portion of the base has been removed in order to better show a drive transmission operably connecting the brushroll to a brush motor.
Figure 15:
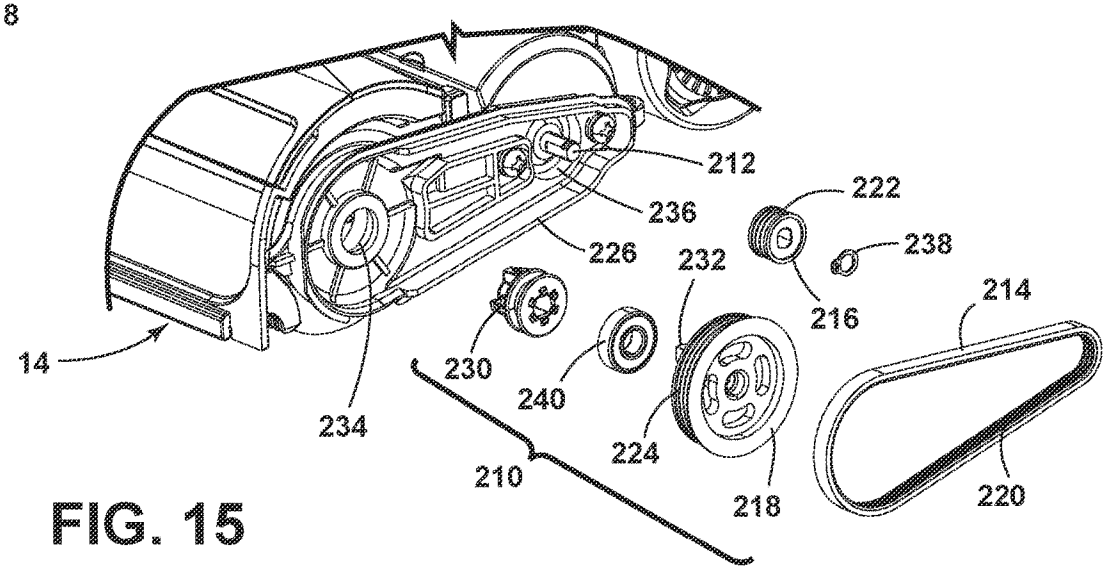
FIG. 15 is a partially-exploded view showing the drive transmission of FIG. 14.

Referring to FIGS. 14-15, one embodiment of a drive assembly or transmission 210 for the brushroll 90 is shown. The transmission 210 connects a motor shaft 212 of the brush motor 182 (FIG. 10) to the brushroll 90 for transmitting rotational motion to the brushroll 90. The transmission 210 can include a drive belt 214, which can optionally be a V-belt (or vee belt) and one or more gears, shafts, pulleys, or combinations thereof. In addition to the belt 214, the transmission 210 can, for example, include a motor pulley 216 coupled with the motor shaft 212 and a brush pulley 218 coupled with brushroll 90, with the belt 214 coupling the motor pulley 216 with the brush pulley 218. In embodiments where the drive belt 214 is a multi-groove or polygroove V-belt 214, with multiple "V" shape ribs 220 alongside each other, the pulleys 216, 218 can have mating grooves 222, 224 on a circumference thereof for tracking the ribs 220.

The transmission 210 can be at least partially enclosed within a drive housing 226. A portion of the base housing 104, such as a lateral side wall 228 (FIG. 10) of the base housing 104, can cooperate with the drive housing 226 to enclose the transmission 210. Other structures for enclosing the transmission 210 within the base 14 are possible. It is noted that in FIGS. 14-15, the lateral side wall 228 and a soleplate of the base housing 104 have been removed in order to view the transmission 210 and the drive housing 226.

The transmission 210 can further include the drive head 230 keyed to or otherwise fixed with the brush pulley 218 by an axle 232. In addition to the drive head 230, a bearing 240 can be carried on the axle 232 to reduce friction between the axle 232 and drive housing 226.

The axle 232 may extend laterally inwardly from the brush pulley 218, through a first opening 234 in the drive housing 226. A second opening 236 can be provided in the drive housing 226, disposed rearwardly of the first opening 234, for extension of the motor shaft 212 therethrough to couple with the motor pulley 216. The motor pulley 216 can be keyed to or otherwise fixed with the motor shaft 212, and secured thereon by a retaining ring 238.

The drive head 230 and bearing 240 can be disposed on an inner or medial side of the drive housing 226 and the brush pulley 218 can be disposed on an outer or lateral side of the drive housing 226. The axle 232 can extend through opening 234 in the drive housing 226 to couple a component on the outer side (e.g. the brush pulley 218) to a component on the inner side (e.g. the drive head 230).

Figure 16:
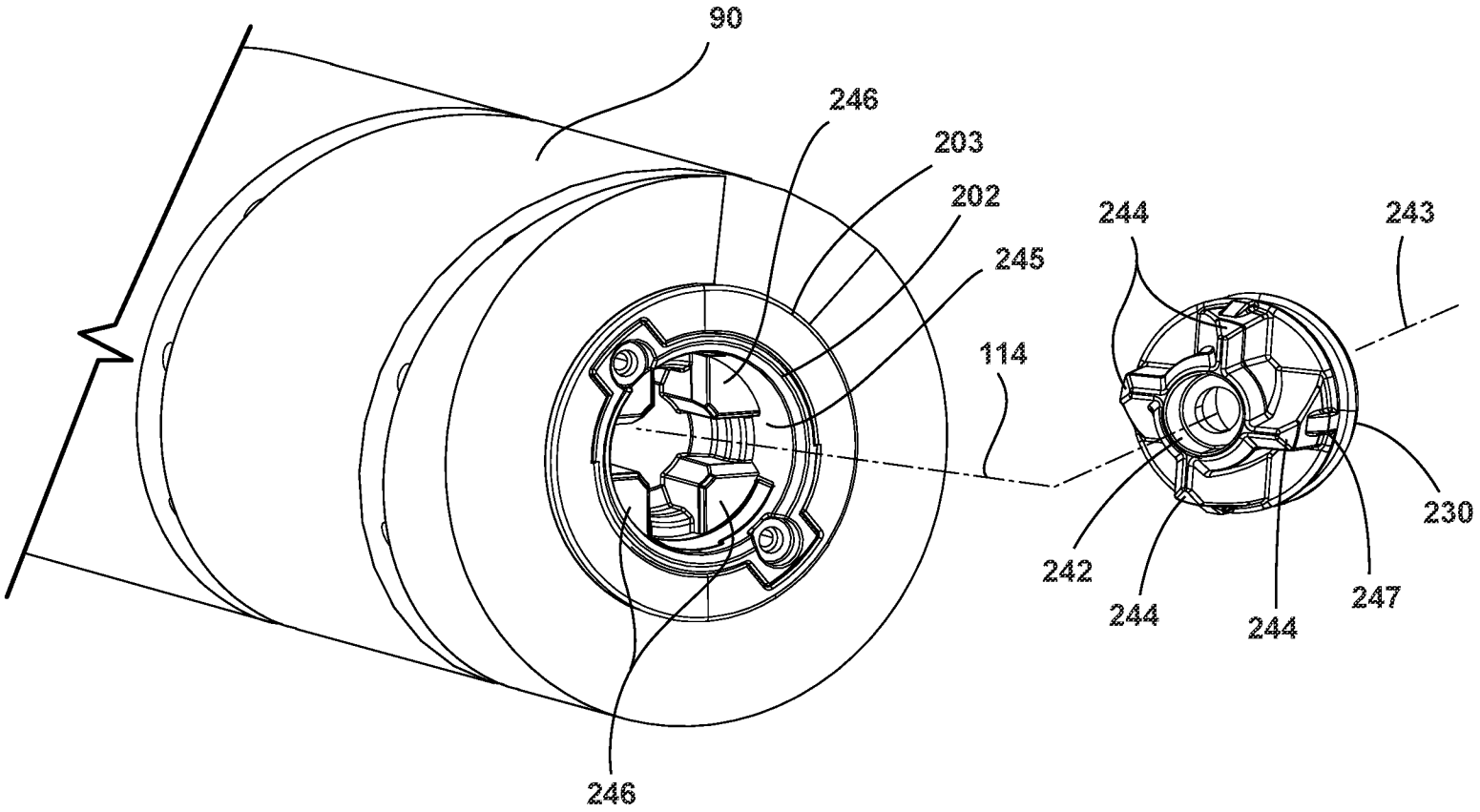
FIG. 16 is an enlarged view of one end of the brushroll, showing details of one embodiment of a drive connection with the drive transmission.

Referring to FIG. 16, the drive head 230 includes a generally cylindrically shaped body with an end 242 adapted for insertion in the end cap 202 on the brushroll 90. When assembled, an axis 243 of the drive head 230 can be coincident with the brushroll axis 114.

The insertion end 242 of the drive head 230 includes a plurality of teeth 244 spaced about the surface of the insertion end 242. These teeth 244 can be axially-inclined, i.e. oblique or inclined with respect to the axis 243. In being axially-inclined, the teeth 244 can have one axially-extending side surface that is oblique or inclined with respect to the axis 243 and another axially-extending side surface that is generally parallel to the axis 243. In other embodiments, both side surfaces of the teeth 244 can be oblique or inclined.

The teeth 244 can have an inward taper adjacent the insertion end 242 to accommodate insertion of the drive head 230 into the end cap 202 of the brushroll 90. Optionally, a width of the teeth 244 can narrow approaching the insertion end 242 to further accommodate insertion of the drive head 230 into the end cap 202. Accordingly, when the drive head 230 is received in the end cap 202, the taper and wedge-shape of the teeth 244 provide a margin of error in initial placement of the insertion end 242 relative to a receiving opening 245 in the end cap 202.

The end cap 202 includes a generally cylindrically shaped body having the axially-extending receiving opening 245 therein and a plurality of axially-inclined teeth 246 disposed in the opening 245. These axially-inclined teeth 246 can correspond in shape to the axially-inclined teeth 244 on the drive head 230, optionally with some additional amount of tolerance, to permit insertion of the drive head 230 into the end cap 202 and operable engagement of the teeth 244, 246. To take up any tolerance between the drive head 230 and end cap 202, a chock 247 can project from an outer surface of one or more of the drive head teeth 246.

To assemble the brushroll 90 with the drive assembly/transmission 210, the end cap 202 is inserted over the drive head 230. Optionally the brushroll 90 can be twisted until the teeth 244, 246 align and enmesh with one another, with the drive head teeth 244 fitting in the spaces between the end cap teeth 246. This alignment can be guided by the incline of the teeth 244, 246 and the taper on the drive head teeth 244. Insertion can be completed at a point when the chocks 247 are wedged into the opening 245 of the end cap 202. This assembled position is illustrated in FIG. 14. With the brushroll 90 installed on the base 14 and assembled with the transmission 210, the brushroll 90 can be rotatably driven by the brush motor 182.

Figure 17:
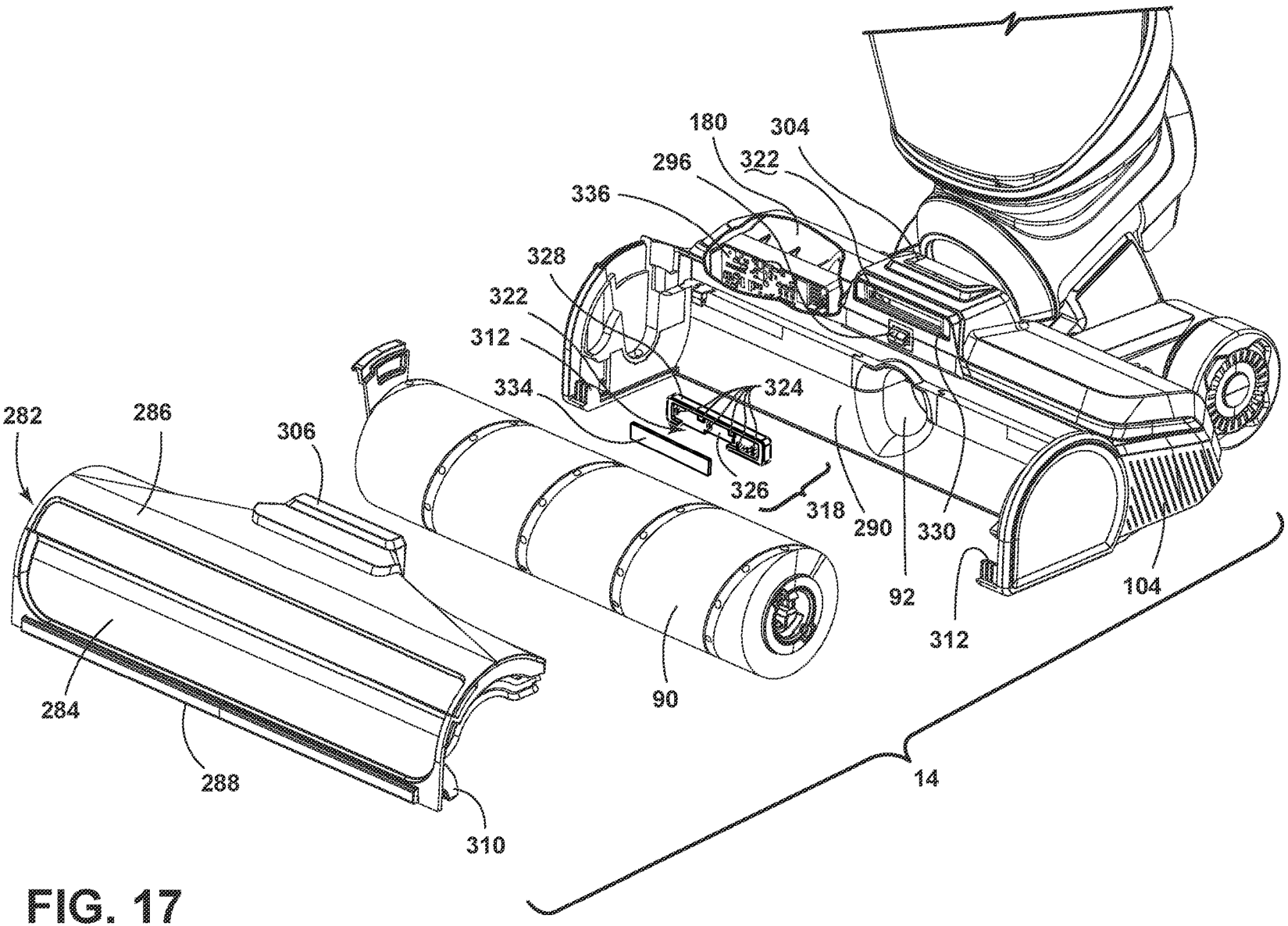
FIG. 17 is a partially-exploded view of the base, showing details of one embodiment of a headlight for the apparatus.
Figure 18:
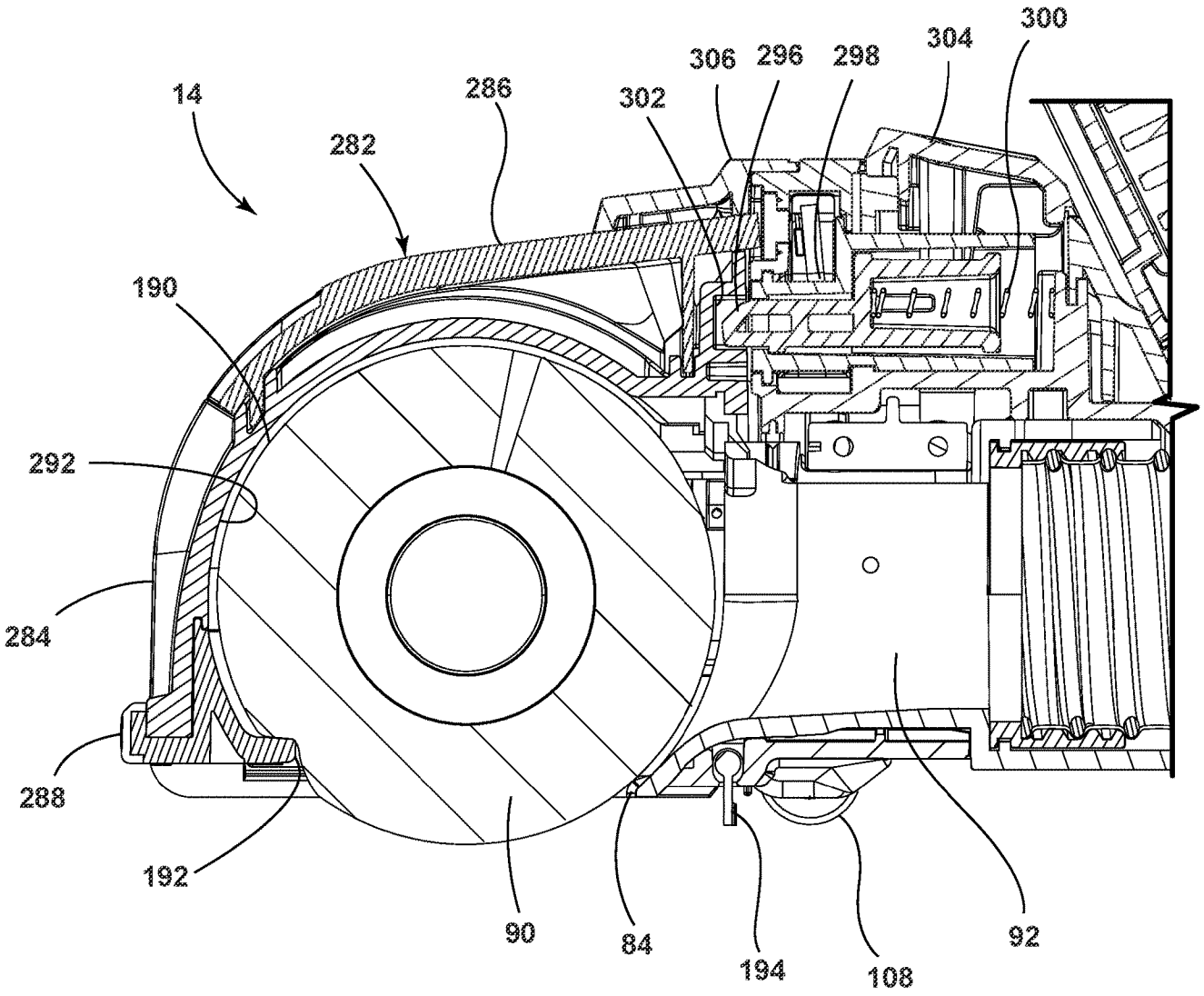
FIG. 18 is an enlarged view of a lower portion of FIG. 4, showing a forward section of the base including the brushroll, a cover, and a headlight.

Referring to FIGS. 17-18, in one embodiment, the base 14 can comprise a cover 282 removably coupled to the base housing 104 and at least partially defining the brush chamber 190 and the suction nozzle 84. An interior surface of the cover 282 can define the brush chamber 190, with the interior surface of the cover 282 proximate to the brushroll 90.

The cover 282 can be curved generally in a forward and downward direction to extend over a top side and front side of brushroll 90. The cover 282 can wrap around and in front of the brushroll 90 to define a front of the base 14 at an exterior side therein and to define a front of the brush chamber 190 at an interior side thereof.

The cover 282 can comprise multi-piece cover, including a first cover part 284 and a second cover part 286. The first cover part 284 is generally disposed below the second cover part 286 in the embodiment shown, and therefore is alternatively referred to herein as lower cover, with the second cover part 286 alternatively referred to herein as upper cover. In other embodiments, the cover 282 can comprise a one-piece cover, or may comprise more than two pieces.

Figure 26:
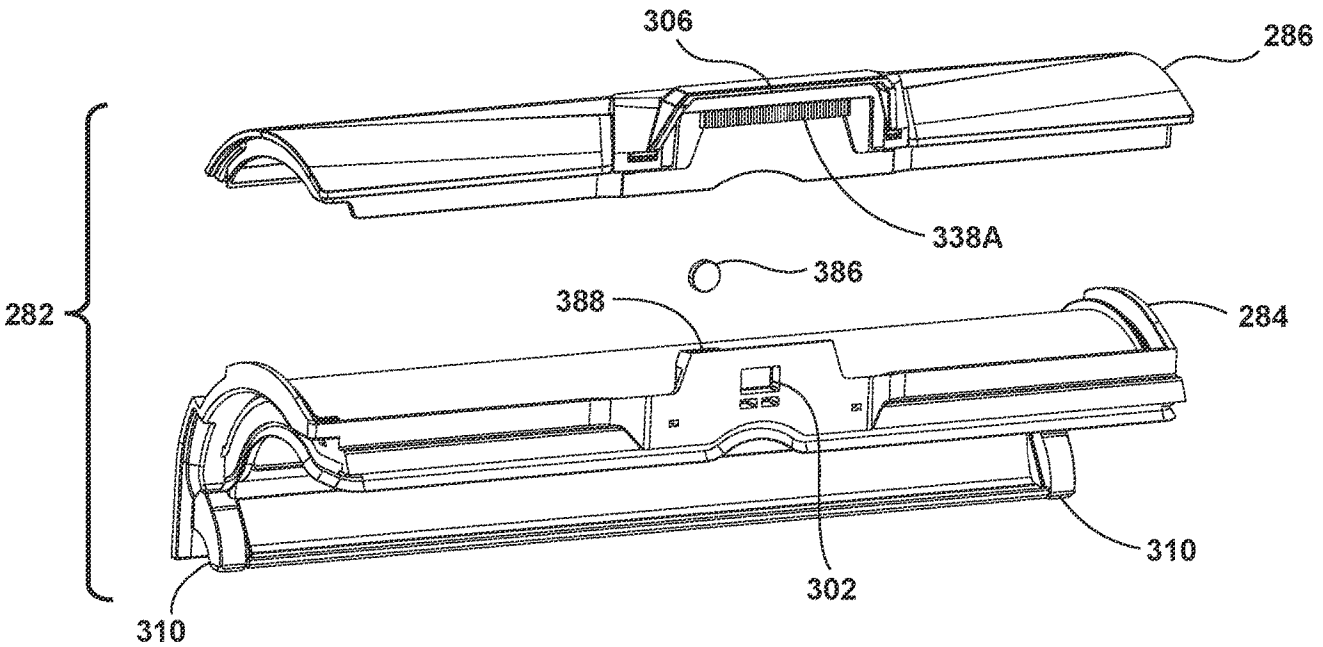
FIG. 26 is an exploded rear perspective view of the cover.

The upper cover part 286 can be secured to the lower cover part 284 by any suitable fastening process such as sonic welding, adhesive, or the like, or can be integrally formed with each other. In the embodiment shown, the lower cover part 284 can define the brush chamber 190 that partially encloses the brushroll 90. In the illustrated embodiment, the lower cover part 284 includes a curved forward end that can wrap around and in front of the brushroll 90 to define a front of the brush chamber 190. The upper cover part 286 can extend at least partially over the lower cover part 284, for example as best seen in FIG. 26. The lower cover part 284 and/or upper cover part 286 can be formed from a translucent or transparent material, such that the brushroll 90 is at least partially visible to a user through the cover 282.

Optionally, the interference wiper 192 is mounted at an interior forward side of the lower cover part 284, and projects into the brush chamber 190. A bumper 288 can be provided on the cover 282, such as at a lower front edge of the lower cover part 284 opposite the interference wiper 192.

The conduit 92 of the recovery pathway can be provided in a portion of the base housing 104 defining a rearward side 290 of the brush chamber 190, and the cover 282, particularly an inner surface of the lower cover part 284, can define a forward side 292 of the brush chamber 190.

The cover 282 can be removable from the base housing 104 without the use of tools. Optionally, the base 14 can have a cover latch 3 that releasably secures the cover 282 on the base housing 104. The cover latch 296 can be provided to releasably secure the cover 282 on the base housing 104, and can be configured to releasably lock the cover 282 to the base housing 104.

In the illustrated embodiment, a forward-facing side of the base housing 104 can include the cover latch 296. The latch 296 can be received in a latch holder 298 provided on the base housing 104, and can be biased by a spring 300 to a latched position. The cover latch 296 can be received in a latch catch 302 provided on the cover 282. A rearward-facing end of the cover 282 can include the latch catch 302.

A latch actuator, such as a release button 304, can be operably coupled with the spring-mounted latch 296 such that pressing down on the release button 304 draws the latch 296 away out of the latch catch 303 provided on the cover 282. The release button 304 can be provided on a top of the base housing 104 so that the user can access the release button 304 from above.

The cover 282 can comprise a handle or hand grip 306 that can be used to lift the cover 282 away from the base housing 104. The hand grip 306 can be provided on the upper cover part 286 so that the user can access the hand grip 294 from above. Alternatively, the hand grip 306 can be provided elsewhere on the cover 282 where a user can apply a separating force.

The cover 282 can be mountable to the base housing 104 via a hook-and-catch mechanism, wherein a hook 310 on the cover 282 engages with a catch 312 on the base housing 104. A user can depress the release button 304 to disengage the cover latch 296 from the latch catch 302 and pivot the cover 282 forwardly about the hook catch 312. Continued rotation of the cover 282 forwardly moves the hook 310 out of engagement with the hook catch 312. The cover 282 can thereafter be lifted away from the base housing 104, for example via the hand grip 306.

Figure 19:
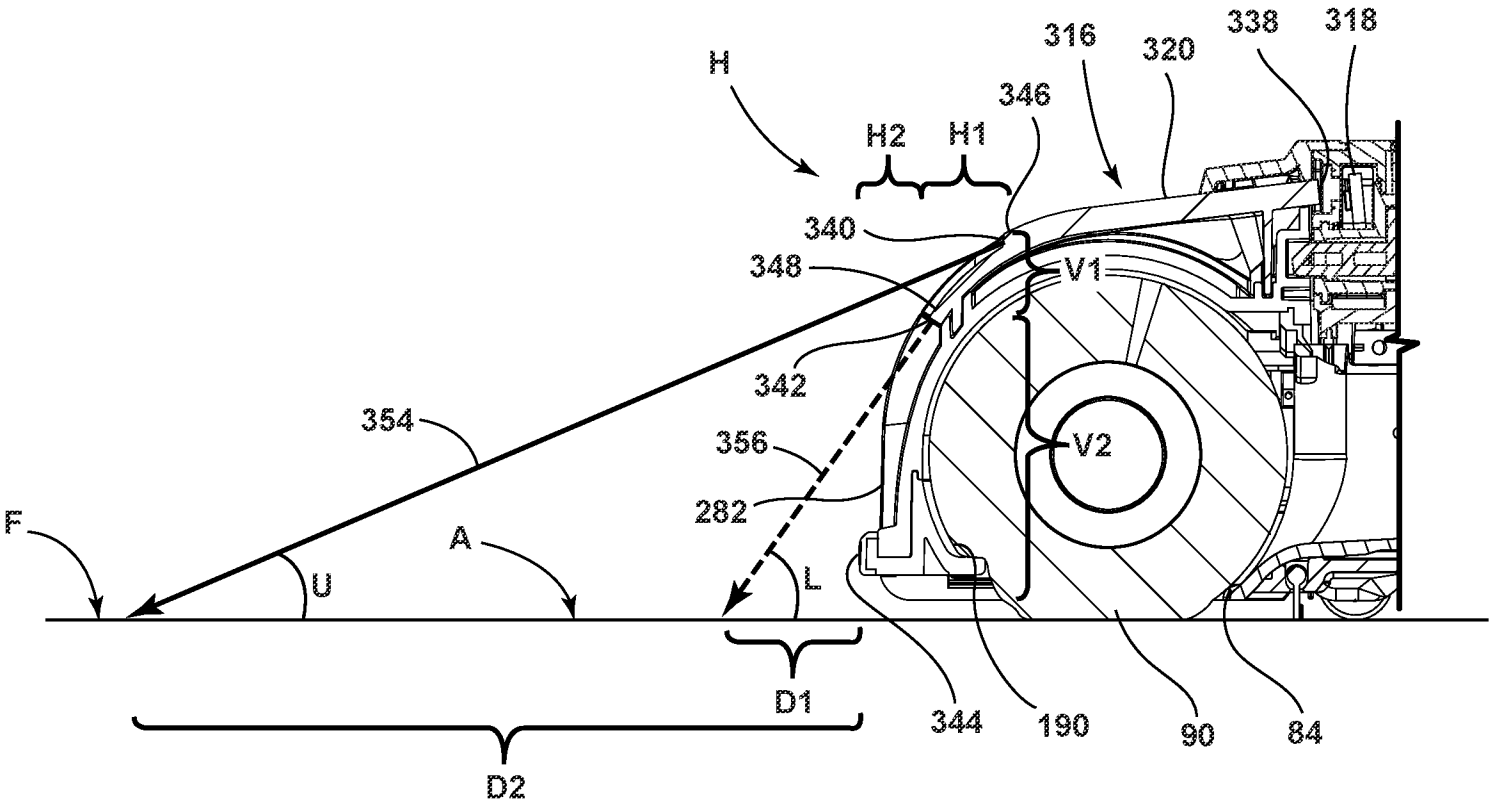
FIG. 19 shows the headlight of FIG. 18 illuminating an area in front of the base.

Referring to FIG. 19, the base 14 can include a headlight 316 that illuminates a surface to be cleaned, or floor surface F, exterior of the base 14. FIG. 19 shows one example of an illumination pattern of the headlight 316, and generally indicates an illuminated area A on the floor surface F in front of the base 14. The headlight 316, in certain embodiments, can illuminate the floor surface F in front of the base 14 along substantially the entire width of the base 14 to increase the ability of the user to see the floor surface in front of the base 14.

In one embodiment, a light source 318 of the headlight 316 is internal to the base 14, and the base 14 includes a light pipe 320 that transmits or conveys light from the light source 318 to the floor surface F in front of the base 14. Thus, the internal light source 318 and light pipe 320 together function as the headlight 316 for illuminating a surface to be cleaned. The light pipe 320, in certain embodiments, can distribute light generated by the light source 318 across a width of the base 14 to increase the ability of the user to see the floor surface in front of the base 14.

Referring to FIG. 17, the light source 318 includes at least one light emitting element. In one embodiment, the light source 318 includes a light emitting diode (LED) module 322. However, in other embodiments, the light source 318 can be an organic LED (OLED), a laser or laser diode, a regular lamp (arc lamp, gas discharge lamp etc.), bulbs, or other light emitting device. As shown in FIG. 17, the LED module 322 can include at least one light emitting element in the form of at least one LED chip 324 mounted on a board or other substrate 326. The LED chip 324 can be mounted as a chip on board (COB) or multiple chips on board (MCOB) package. In another embodiment, the LED chip 324 can be mounted as a surface mounted diode (SMD) package.

The light source 318 can, for example, be mounted on the base housing 104 and covered by the cover 282. Removal of the cover 282 exposes the light source 318. The light source 318 can include a holder 328 for receiving the LED module 322. The holder 328 can mount the LED module 322 to a light source receiver 330 in the base housing 104 and hold the LED chips 324 in alignment with an opening 332 of the light source receiver 330 in the base housing 104. The light source receiver 330 can be positioned generally above the portion of the base housing 104 defining the rearward side 290 of the brush chamber 190, to position the light source 318 generally above and rearward of the brushroll 90. Other configurations and locations for mounting the LED module 322 on the base 14 are possible.

The light source 318 can include a covering 334 located forwardly of the LED module 322 in proximity thereto. The covering 334 can be mounted to the holder 328, in a position ahead of the LED chips 324, or can mounted separately from the holder 328 in proximity to the LED module 322. The covering 334 can be optically translucent or transparent, such that light emitted by the LED module 322 can pass through the covering 334. The covering 334 may function to protect the LED module 322, particularly when the nozzle assembly is removed from the base housing 104, which can expose the light source 318 to impacts. In addition to physical protection, the covering 334 can provide a fluid-tight barrier between the brush chamber 190 and the electronics of the headlight 316. Optionally, the covering 334 may additionally function as a lens to focus the light onto an input end of the light pipe 320.

The light source 318 is operably coupled to a printed circuit board (PCB) 336. The PCB 336 includes the electrical circuitry and components required to illuminate the light source 318 when power is supplied from a power source (e.g. battery 45) to the PCB 336 via electrical wires (not shown). The PCB 336 can be located in the base 14, for example generally between the pump 180 and the brush chamber 190. The PCB 336 is electrically coupled to the LED module 322 for suppling power to the LED chips 324. The PCB 336 can additionally be electrically coupled to other electrical components of the base 14, such as the pump 180, brush motor 182, and brush motor switch 260, as shown in FIG. 2.

Preferably, the light source 318 has a wavelength that falls within the visible optical spectrum, i.e. about 380 to 740 nanometers. The color of the light emitted by the light source 318 can be white or colored. For instance, the LED module 322 can be configured to emit white light or colored light. The LED chips 324 can deliver the same color of light or they can have different colors of light. For instance, the LED module 322 can contain two LED chips 324 emitting different colors of light, for example white and blue. The LED chips 324 can also be selected such that they emit light of a different wavelength within the same color range; for example, the LED chips 324 could emit light having different wavelengths that result in the color white.

A portion of the suction nozzle 84 or brush chamber 190 can form the light pipe 320. In one embodiment, the light pipe 320 can be integrated with the cover 282 defining the suction nozzle 84 and brush chamber 190. The nozzle-integrated light pipe 320 can enhance illumination quality, and adds greater flexibility in mounting arrangements for the light source 318 in the base 14. Unlike previous base designs, the light source 318 does not have to be adjacent an exterior portion of the base 14; instead, the light source 318 can be an interior component, such as one mounted behind the cover 282, with the nozzle-integrated light pipe 320 transporting light to the exterior of the base 14.

Splitting components for the headlight 316 between the base housing 104 and the nozzle cover 282 also accommodates nozzle removability while protecting the electronics against the ingress of water. The mounting of the cover 282 on the base housing 104 both encloses the brushroll 90 within the brush chamber 190 and brings the light pipe 320 into alignment with the light source 318. Utilizing the nozzle cover 282 as a light pipe for the headlight 316 enables the light source 318 and its associated wiring to remain on the base housing 104, while still providing light to the front of the base 14 via the removable cover 282. This further allows the light source 318 and its associated wiring to be isolated from exposure to wet areas of the base 14, such as the distributor 178, brushroll 90, or brush chamber 190. The electronics of the headlight 316 can be protected from wet components by sealing the electronics within the holder 328 and covering 334 against the ingress of water.

The light pipe 320 can be any physical structure capable of transporting or distributing light from the light source 318 and that can be integrated with the suction nozzle 84, brush chamber 190, or cover 282. The light pipe 320 can be a hollow structure that contain the light with a reflective lining, or a transparent solid structure that contain the light by total internal reflection. In the illustrated example, light pipe 320 is a solid structure formed with the cover 282 and configured to distribute light over its length by total internal reflection. In one such embodiment, the light pipe 320 is integrally formed with the cover 282 and, thus, would be considered as being "coupled to the nozzle" during the formation process of the cover, which can be an injection molding process or an additive manufacturing process, for example.

The light pipe 320 can be formed by a light-transmissive polymeric material. In one embodiment, the light-transmissive polymeric material is transparent. In another embodiment, the light-transmissive polymeric material is translucent. In embodiments where the light pipe 320 is integrated with the cover 282, suitable materials for forming the light-transmissive polymeric material include any rigid material suitable for enclosing the brushroll 90, such as a light-transmissive thermoplastic. Suitable light-transmissive thermoplastic include polycarbonate, polyethylene, polypropylene (PP), polyamide, polyester, cellulosic, SAN, acrylic, or ABS.

In one embodiment, the light pipe 320 is formed integrally with the cover 282, using a technique such as injection molding or additive manufacturing. More specifically, the light pipe 320 can be embodied as a solid structure molded with the upper cover part 286, and using a light-transmissive polymeric material to form the upper cover part 286 with an integrated solid structure forming the light pipe 320. In other embodiments where the cover 282 comprises a one-piece cover, the light pipe 320 can be embodied as a solid structure molded with the one-piece cover.

In another embodiment, light-transmissive polymeric material can be formed separately in an appropriate shape to form the light pipe 320 and coupled to the cover 282 using any suitable means, such as adhesion, thermal coupling, sonic welding, overmolding, a snap-fit assembly, a tight-fit assembly, combinations thereof, or other connection techniques.

Figure 20:
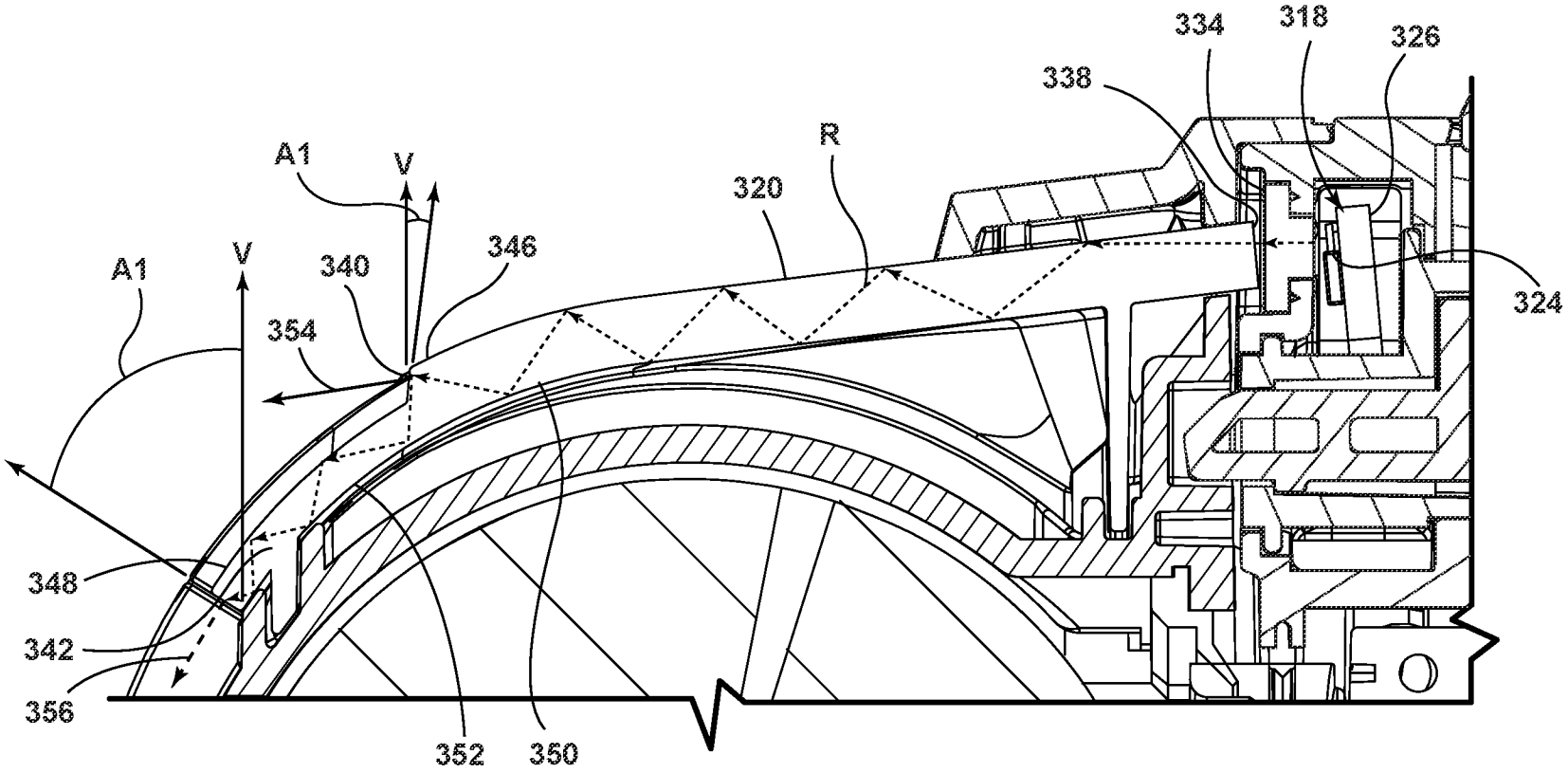
FIG. 20 is an enlarged view of a portion of FIG. 18, showing the cover including a light pipe of the headlight, and showing light radiating from a light source and propagating along the light pipe.

Referring to FIG. 20, the light pipe 320 can have a first end 338 in register with the light source 318, a second end 340 disposed proximate a front of the base 14 for propagating light along a front of the base 14 at a first front portion thereof, and a third end 342 disposed proximate a front of the base 14 for propagating light along a front of the base 14 at a second front portion thereof. The second and third ends 340, 342 are also referred to herein as first and second exit ends.

The first end 338 of the light pipe 320, also referred to herein as the entrance end, can be shaped to allow light emitted by the light source 318 to easily enter the light pipe 320 and to propagate internally. The entrance end 338 can have a prism 338A (FIG. 26), for example comprising a series of undulating curves, or other suitable shapes, at a light input location of the cover 282 to diffuse light through the light pipe 320. The light input location of the cover 282 can be an upper, rearward-facing end of the cover 282 disposed proximate to the light source 318 when the cover 282 is mounted to the base housing 104. The prism 338A can be formed by cutting, molding, forming, or otherwise causing mechanical, chemical, or other deformations in the first end 338.

The exit ends 340, 342 of the light pipe 320 can be shaped to emit light outward from the base 14 to illuminate the floor surface F. The exit ends 340, 342 can each form a light emitting lens surface that emit light beams configured to converge on the floor surface F for enhanced illumination of the area to be cleaned. The exit surface of the light pipe 320 can be diffused to provide a uniform illuminated surface.

Figure 21:
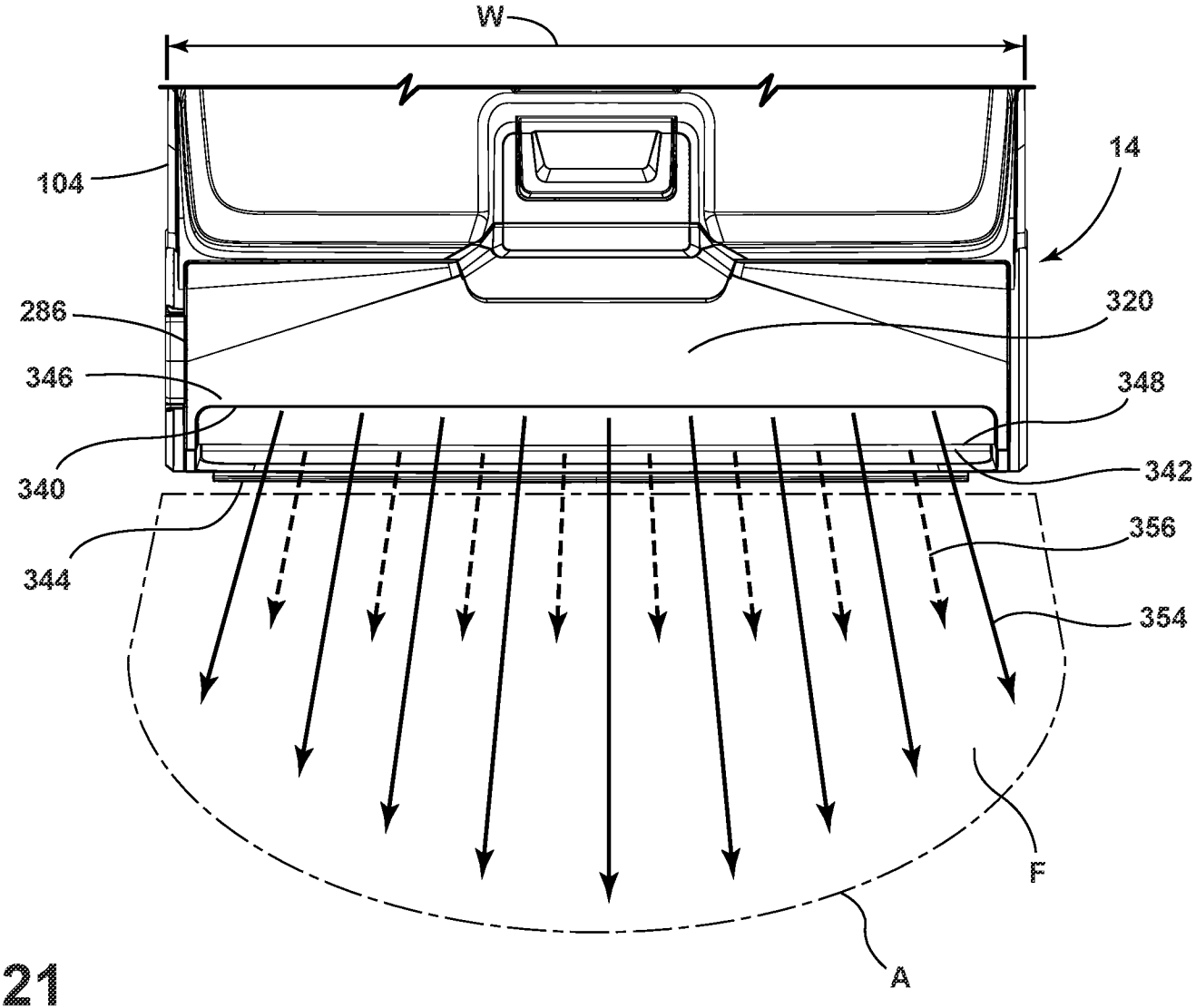
FIG. 21 is a top view of the base, showing the headlight illuminating an area in front of the base.

Referring to FIGS. 20-21, the light pipe 320 includes at least one laterally-elongated portion, e.g. a portion that is elongated along the width W of the base 14, taken in a direction that is generally orthogonal to a direction of forward movement of the base 14. Such a portion can be configured to distribute light onto the floor surface F across a substantial width W of the base 14, the entire width W of the base 14, or across a distance greater than the width W of the base 14, as described in more detail below. In the embodiment shown, the cover 282 includes an upper stepped portion 346 defining the first exit end 340 and a lower stepped portion 348 defining the second exit end 342. Therefore, each stepped portion 346, 348 defines an exit end of the light pipe 320. The stepped portions 346, 348 can have a shape elongated in a lateral direction, which is parallel to a front 344 of the base 14 and generally perpendicular to a direction of forward movement of the apparatus 10. Both stepped portions 346, 348 can extend across a substantial width of the base 14. For example, the stepped portions 346, 348 can extend across at least 50%, at least 60%, at least 70%, at least 80%, at least 90%, or at least 95% of the width of the base 14.

In the embodiment shown, the upper cover part 286 includes the stepped portions 346, 348. The lower stepped portion 348 can be adjacent to or form a lower end of the cover part 286. The upper stepped portion 346 is disposed above the lower stepped portion 348. The upper stepped portion 346 can accordingly be elongated laterally for transmitting light lengthwise along an upper front of the base 14 and the lower stepped portion 348 can accordingly be elongated laterally for transmitting light lengthwise along an lower front of the base 14. This provides uniform illumination over a substantial width of base 14.

One or both of the stepped portions 346, 348 can have diffuser surface. The diffuser surface may be formed along the top side of either or both of the stepped portions 346, 348 and/or on the exit ends 340, 342 of either or both of the stepped portions 346, 348. These diffuser surfaces may vary in depth and/or width along the length of the cover 282, and may comprise a roughened surface, texture, polish, or the like that consists of multiple surface deformities. A texture or roughened surface, for example, may be produced by grinding, sanding, laser cutting, or milling.

As described above, the cover 282 can be curved generally in a forward and downward direction to extend over a top side and front side of brushroll 90. The light pipe 320 can therefore also curve. In one embodiment, the light pipe 320 can include one or more bends between the entrance end 338 and exit ends 340, 342 to accommodate for the curvature of the cover. For example, as shown in FIG. 20, the light pipe 320 can include a first bend 350 disposed between the entrance end 338 and the upper stepped portion 346 and a second bend 352 disposed between the upper and lower stepped portions 346, 348. At the bends 350, 352, some light rays that were previously internally reflected may be emitted.

As shown in FIG. 20, the light R radiating from the light source 318 is incident from the entrance end 338 of the light pipe 320 and propagates inside the light pipe 320. Accordingly, light from the light source 318 is transmitted along the light pipe 320 to the first exit end 340 and second exit end 342, which then emit that light outwardly from the base 14. The light from the light source 318 may be transmitted out of the exit ends 340, 342 of the light pipe 320 directly onto the area in front of the base 14. Alternatively, a light director (not shown) may be operatively connected to the exit end(s) of the light pipe 320 to focus the light onto the area in front of the base 14. Such a director may, for example, include a lens, a prism, a reflector, or a combination thereof.

FIG. 19 shows a side view of the illuminated area A on a surface to be cleaned in front of the base 14. The illuminated area A is illuminated by light from the internal light source 318 transmitted by the light pipe 320 onto the floor surface F to illuminate the area in front of the base 14 and allow the user to see better when cleaning. Accordingly, the illuminated area A, which is in front of the base 14, is illuminated by light ray 354 from the upper exit end 340 of the light pipe 320 and by light ray 356 from the lower exit end 342 of the light pipe 320. The upper light ray 354 extends farther out from the base 14 than the lower light ray 356, with the upper light ray 354 intersecting the floor surface at a distance D2 that is greater than a distance D1 at which the lower light ray 354 intersects the floor surface F. As such, the upper exit end 340 of the light pipe 320 functions to increase the distance illuminated by the headlight 316.

An angle U is made by the upper light ray 354 and the floor surface F and an angle L is made by the lower light ray 356 and the floor surface F. The lower light ray 356 may be directed at the floor surface F at a sharp angle, e.g. such that angle L>angle U, to increase the brightness directly in front of the base 14. Angles U and L can be within a range of 10 to 80 degrees and more preferably from 30 to 60 degrees respectively. Angles U and L are the direct result of the angle at which the exit ends 340, 342 are formed relative to the floor surface F.

Such differences in illumination distance and angle can be achieved, for example, by a vertical and/or horizontal spacing the upper and lower stepped portions 346, 348, and/or by varying the angle of the exit faces 340, 342. In one embodiment, as shown in FIG. 19, the upper stepped portion 346 is vertically spaced from the lower stepped portion 348 by a vertical distance V1, with the lower stepped portion 348 itself vertically spaced from a bottom of the base by a vertical distance V2. The upper stepped portion 346 can further be horizontally spaced from the lower stepped portion 348 by a horizontal distance H1, such that the upper stepped portion 346 is set back farther from the front 344 of the base 14 than the lower stepped portion 348, the with the lower stepped portion 348 itself horizontally spaced from the front 344 of the base 14 by a horizontal distance H2. As best seen in FIG. 20, the lower stepped portion 348 can further have its associated exit face 342 disposed at an angle A1 relative to vertical V, and the upper stepped portion 346 can have its associated exit face 340 disposed at an angle A2 relative to vertical V, where A1>A2. Indeed, as shown in FIG. 20, the lower exit face 342 can be canted forwardly from vertical V such that angle A1 is a positive angle and upper exit face 340 can be canted slightly rearwardly from vertical V such that angle A2 is a negative angle, with magnitude less than angle A1. In other embodiments, the upper exit face 340 can be generally vertical or canted slightly forwardly from vertical. In any of the aforementioned embodiments, the magnitude of angle A2 can be less than that of angle A1.

It is noted that in FIG. 19, one light ray 354, 356 extending from each stepped portion 346, 348 is depicted. In practice, by the reflection inside the light pipe 320 and due to the elongation of the stepped portions 346, 348 and/or the plurality of LED chips 324, multiple light rays from each stepped portion 346, 348 may travel in various directions and at a variety of angles, in addition to the two representative light rays 354, 356 shown, including, but not limited to, angles where the light ray 354, 356 converge with and/or cross each other.

FIG. 21 shows a top view of the illuminated area A on the floor surface F in front of the base 14, depicting the illuminated area A being illuminated by multiple light rays 354 and 356 from the upper and lower stepped portions 346, 348 of the light pipe 320, across the substantially length of the elongated stepped portions 346, 348. As the area in front of the base 14 is covered by light rays from both the upper and lower stepped portions 346, 348, which are elongated across the base 14, uniform and bright illumination can be realized. The light rays 354, 356 are depicted in FIG. 21 as generally travelling in a uniform direction outward from the base 14, however, the light rays 354, 356 may travel in various directions by the reflection inside the light pipe 320, and therefore the light rays 354, 356 may travel at a variety angles, including, but not limited to, angles where one light ray 354, 356 crosses another light ray 354, 356. In one embodiment, the direction of at least some of the light rays 354, 356 can be oblique relative to the lateral direction, such that the area in front of the base 14 can be illuminated over an area wider than the width W of the base 14.

Figure 22:
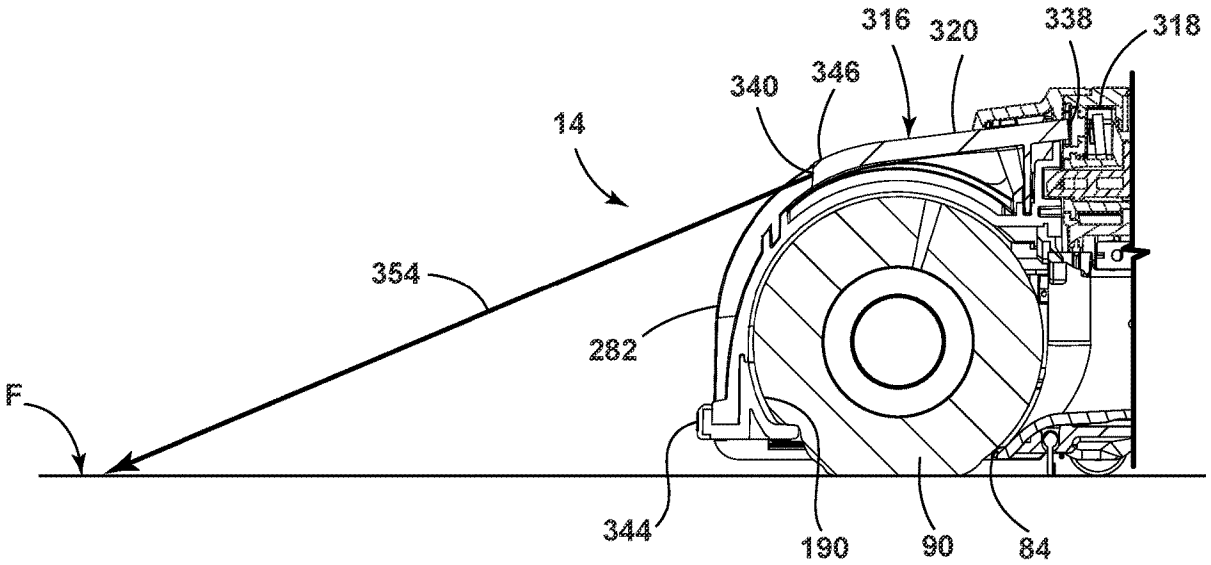
FIG. 22 shows another embodiment of a headlight for the apparatus.
Figure 23:
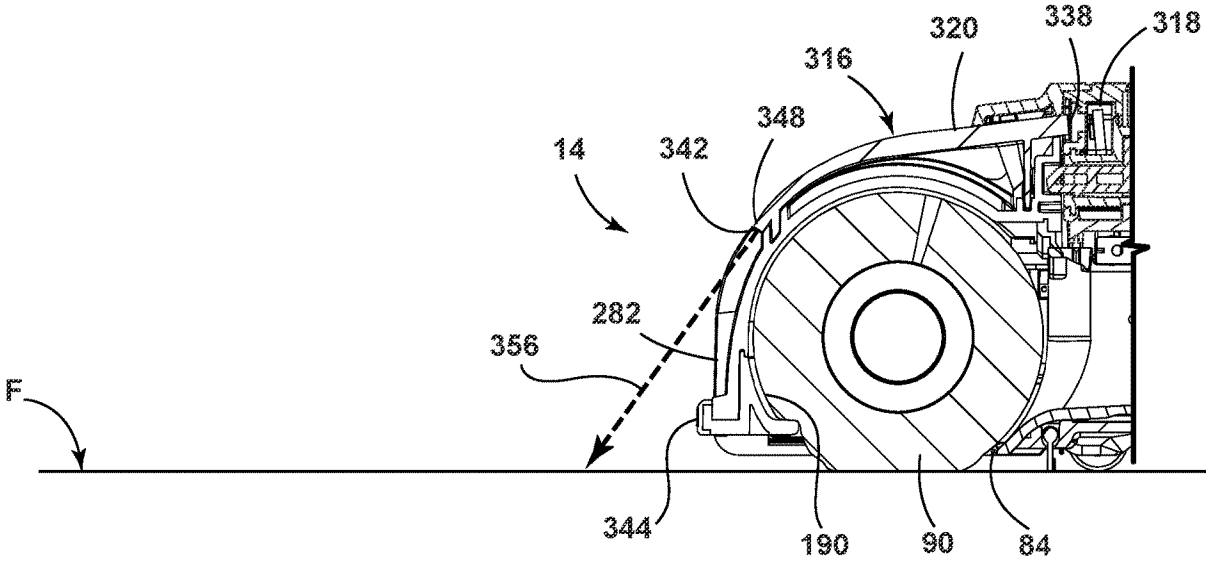
FIG. 23 shows yet another embodiment of a headlight for the apparatus.

Other configurations for the headlight 316 and light pipe 320 are possible. FIG. 22 shows one alternate embodiment for the light pipe 320 where the cover part 286 includes only one exit end 340 disposed higher on the cover 282, and stepped portion 346 defining the exit end 340. FIG. 23 shows another alternate embodiment for the light pipe 320 where the cover part 286 includes only one exit end 342 disposed lower on the cover 282, and stepped portion 348 the exit end 342.

The headlight 316 of any embodiment disclosed herein can be operable to selectively illuminate upon the occurrence of a predetermined condition or communicate a status of the apparatus 10 to the user. For example, the headlight 316 can illuminate when the apparatus is powered, when the upright body 12 is reclined, when liquid is being dispensed, when the apparatus 10 is in the hard floor cleaning mode, when the apparatus 10 is in the area rug cleaning mode, when the apparatus 10 is in the intense/booster cleaning mode, or when the apparatus 10 is in the self-cleaning mode. Status information that can be communicated by the headlight 316 include, but are not limited to, battery status, Wi-Fi connection status, clean water level, supply tank presence, dirty water level, recovery tank presence, brushroll status, filter status, or floor type. Upon illumination of the light source 318, light from the light source 318 is transmitted or "piped" through the nozzle cover 282 to the exterior of the base 14, where can illuminate the surface to be cleaned in front of the base 14. The headlight 316 can be operable to emit light at different wavelengths, in different states or animations, and/or at different brightness depending on the occurrence of a predetermined condition or based on a status of the apparatus 10.

Figure 24:
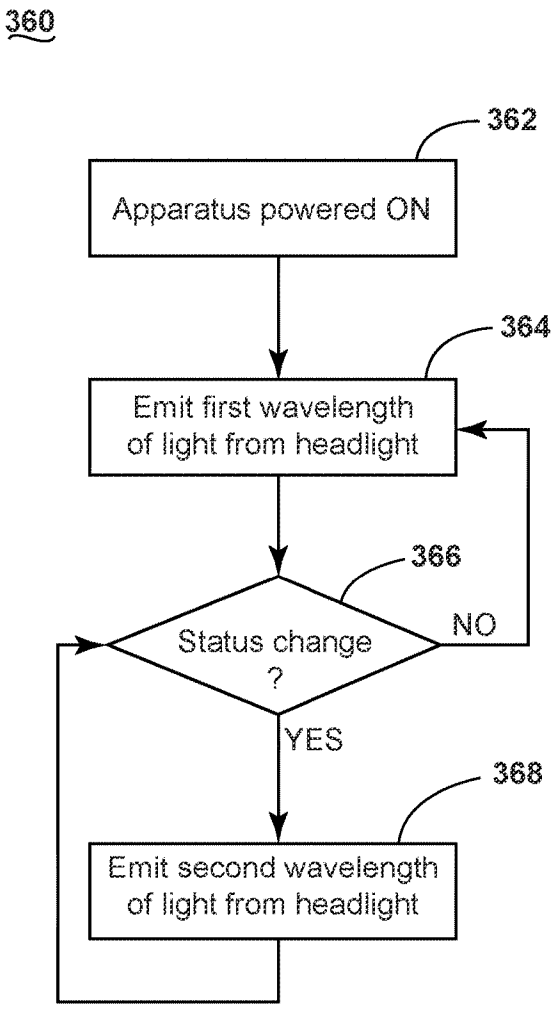
FIG. 24 is a flow chart showing one embodiment of a method for operating the headlight on the apparatus.

Referring to FIG. 24, in one aspect, the headlight 316 can be operable to emit light at a first wavelength depending on the occurrence of a first predetermined condition or based on a first status of the apparatus 10, and can be operable to emit light at a second wavelength depending on the occurrence of a second predetermined condition or based on a second status or status change of the apparatus 10. FIG. 24 depicts one such method 360 for operating the apparatus 10. When the apparatus 10 is powered on at step 362, a first wavelength of light, for example that results in white light, can be emitted by the headlight 316 at step 364. This can be effected by powering one or more white LED chips 324 of the light source 318 when the power input control 34 is pressed to turn the apparatus 10 on. When a condition or status of the apparatus 10 changes, such when the apparatus 10 is dispensing liquid at step 366, a second wavelength of light, for example that results in blue light, can be emitted at step 368. This can be effected by powering one or more blue LED chips 324 of the light source 318 when the trigger 28 is depressed to dispense liquid. White light can continue to be emitted during steps 366-368, with the combination of white and blue LEDS resulting in a bluish light being emitted by the headlight 316. Alternatively, the white LED chips 324 cane powered off when liquid is dispensed. It is noted that while the method of FIG. 22 is described with respect to the headlight 316, in another embodiment, the method can be carried out via a non-headlight light source of the apparatus 10.

Some other examples of conditions or status changes at 366 include, but is not limited to, changing between cleaning modes of the apparatus 10, the battery level falling below a predetermined level, a change in the Wi-Fi connection status (e.g., a Wi-Fi connection being established or lost), a liquid level in the supply tank 20 falling below a predetermined level, a liquid level in the recovery tank 22 reaching a predetermined level, the absence of either tank 20, 22 on the apparatus 10, the brushroll 90 being jammed, or a filter status.

The status change can be indicated for a predetermined period of time, after which the headlight 316 can return to the first wavelength at step 362. In another embodiment, the headlight 316 can remain at the second wavelength until another status change, until an action by a user, such as by pressing a button on a user interface of the apparatus 10 to dismiss the status change notification, or by the user taking action to address the condition or status of the apparatus 10. For example, as long as liquid is being dispensed, the headlight 316 can remain at the second wavelength. When the apparatus 10 ceases dispensing liquid, the headlight 316 can return to the first wavelength. It is noted that while the method of FIG. 23 is described with respect to the headlight 316, in another embodiment, the method can be carried out via a non-headlight light source of the apparatus 10.

Figure 25:
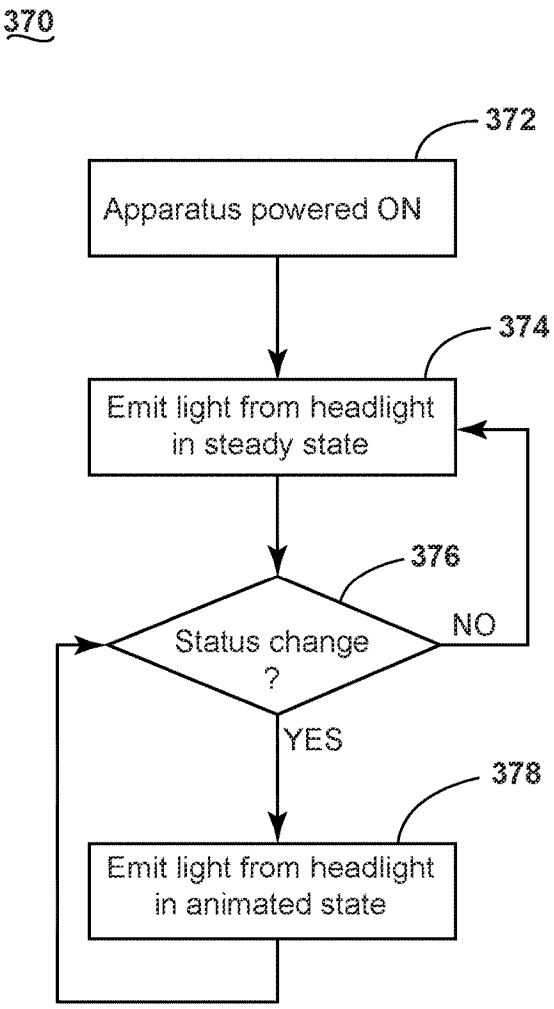
FIG. 25 is a flow chart showing another embodiment of a method for operating the headlight on the apparatus.

Referring to FIG. 25, in another aspect, the headlight 316 can be operable to emit light in a first state depending on the occurrence of a first predetermined condition or based on a first status of the apparatus 10, and can be operable to emit light in a second state depending on the occurrence of a second predetermined condition or based on a second status or status change of the apparatus 10. FIG. 25 depicts one such method 370 for operating the apparatus 10. When the apparatus 10 is powered on at step 372, light can be emitted by the headlight 316 at step 374 in a first state, for example in a steady state where the light source 318 is continuously on. This can be effected by powering one or more LED chips 324 of the light source 318 when the power input control 34 is pressed to turn the apparatus 10 on. During operation of the apparatus 10, when a condition or status of the apparatus 10 changes at step 376, light can be emitted by the headlight 316 at step 378 in a second state, for example in a non-steady state that produces a lighting effect or animation.

Some examples of a condition or status change at 376 include, but is not limited to, changing between cleaning modes of the apparatus 10, the battery level falling below a predetermined level, the trigger 28 being pressed or liquid otherwise being dispensed, a change in the Wi-Fi connection status (e.g., a Wi-Fi connection being established or lost), a liquid level in the supply tank 20 falling below a predetermined level, a liquid level in the recovery tank 22 reaching a predetermined level, the absence of either tank 20, 22 on the apparatus 10, the brushroll 90 being jammed, or a filter status.

Various lighting effects or animations can be employed at step 378, including, but not limited to, continuous illumination, a pulsing effect, or a flashing effect. Specifically, the light source 318, or individual light emitting elements of the light source 318 such as the LED chips 324, may be activated continuously at times, may be flashed at other times, and may be pulsed at still other times. As used herein, the term "pulsing" or its variants refers to controlling the illumination of at least one light emitting element of the light source 318 such that its light intensity increases and decreases in a generally sinusoidal manner. That is, the light gradually gets brighter until it reaches a peak and then gradually gets dimmer until it reaches a nadir (which may include the light completely shut off), and then this cycle repeats. In contrast, the term "flashing" refers to controlling the illumination of at least one light emitting element of the light source 318 such that the intensity of the light emitted generally varies in a square wave fashion. Alternatively, flashing of the lights may be carried out such that the emitted light intensity varies generally as a sawtooth wave, as a triangle wave, or in some other non-sinusoidal manner.

The flashing of light may also be carried out at a higher frequency than the pulsing of light. In at least one embodiment, the pulsing of light repeats itself with a frequency on the order of once every two to five seconds, although other frequencies may be used. By pulsing at this frequency, the emitted light changes intensity with roughly the same frequency as a human breathes, and this relatively low time period creates a non-urgent, yet persistent, visual effect. In contrast, the flashing of light can repeat itself with a frequency faster than once every two to five seconds, such as, but not limited, to, at least once per second, or faster.

The status change can be indicated for a predetermined period of time, after which the headlight 316 can return to the first state, or steady state, at step 372. In another embodiment, the headlight 316 can remain in the second state until an action by a user, such as by pressing a button on a user interface of the apparatus 10 to dismiss the status change notification, or by the user taking action to address the condition or status of the apparatus 10. For example, if the supply tank 20 is empty, the headlight 316 can remain in the second state until the supply tank 20 is refilled. It is noted that while the method of FIG. 25 is described with respect to the headlight 316, in another embodiment, the method can be carried out via a non-headlight light source of the apparatus 10.

Figure 27:
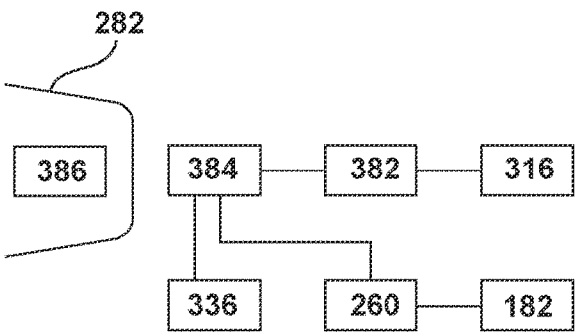
FIG. 27 is a schematic of one embodiment of a headlight and brush motor control system for the apparatus.

Referring to FIGS. 26-27, in some embodiments, the apparatus 10 can include at least one nozzle cover sensing mechanism. Upon removal of the nozzle cover 282, the light emitted from the light source 318 can become very bright due to the absence of the light pipe 320. By detecting whether the nozzle cover 282 is present on the base 14, for example, the light source 318 can optionally be turned off or dimmed.

The nozzle sensing mechanism can include or be operably coupled with a headlight power switch 382 configured to close and supply power to the headlight 316 in the base 14 when the nozzle cover 282 is attached to the base housing 104 and that is configured to open, so that no power is supplied to the headlight 316, when the nozzle cover 282 is removed from the base 14.

In one embodiment, the nozzle sensing mechanism can include a sensing component 384, such as a Hall Effect sensor or a reed switch, provided on one of the nozzle cover 282 and the base housing 104 and a magnet 386 positioned on the other one of the nozzle cover 282 and the base housing 104. The headlight power switch 382 can comprise or be operably coupled with the sensing component 384. In the presence of the magnet 386, the headlight power switch 382 is closed. In the absence of the magnet 386, the headlight power switch 382 is open, such that power cannot be supplied to the light source 318 of the headlight 316.

As shown in FIG. 26, the magnet 386 can be located within a pocket 388 on the nozzle cover 282, otherwise attached or provided on the nozzle cover 282. In one embodiment, the pocket 388 can be provided on the lower cover part 284, and the upper cover part 286 can cover the pocket to enclose the magnet 386 within the cover 282. When the nozzle cover 282 is attached to the base housing 104, the magnet 386 can interact with the sensing component 384, which can be provided in a suitable location on the base housing 104 that will interact with the magnet 386 in the pocket 388. The sensing component 384 can, for example, be positioned within the base housing 104 generally above rearward side 290 of the brush chamber 190, and adjacent the light source receiver 330. Other configurations and locations for mounting the sensing component 384 on the base 14 are possible. As the nozzle cover 282 is brought into position on the base housing 104, the magnet 386 moves toward and eventually interacts with the sensing component 384. Interaction of the magnet 386 with the sensing component 384 causes the headlight power switch 382 to change state, e.g., from open to closed.

FIG. 27 is a schematic of one embodiment of a control system for the apparatus 10. The sensing component 384 detects when the nozzle cover 282 is present and causes the headlight power switch 382 to change state, e.g., from open to closed, to power the light source 318 of the headlight. The sensing component 384 can also send signal to the PCB 336 to cause the UI to provide a status update to the user. In one embodiment, the UI 32 can communicate whether the cover 282 is missing via a visual indicator and/or audible message.

Figure 28:
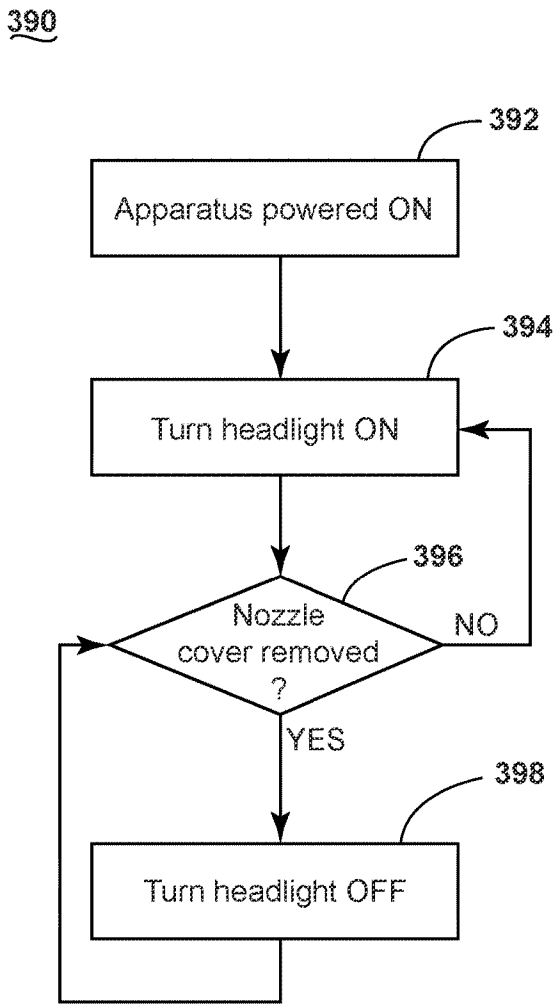
FIG. 28 is a flow chart showing yet another embodiment of a method for operating the headlight on the apparatus.

FIG. 28 depicts one method 390 for operating the light source 318 of the apparatus 10. When the apparatus 10 is powered on at step 392, and with the nozzle cover 282 installed on the base housing 104, the headlight 316 is powered on at step 392. This can be effected by powering one or more LED chips 324 of the light source 318 when the power input control 34 is pressed to turn the apparatus 10 on and the headlight power switch 382 is closed. When removal of the nozzle cover 282 is detected at step 396, the headlight power switch 382 opens, and the headlight 316 is turned off at step 398.

Referring back to FIG. 27, additionally or alternatively to the headlight power switch 382, the nozzle sensing mechanism can include or be operably coupled with the brush motor switch 260 configured to close and supply power to the brush motor 182 in the base 14 when the nozzle cover 282 is attached to the base housing 104 and that is configured to open, so that no power is supplied to the brush motor 182, when the nozzle cover 282 is removed from the base housing 104. For example, in the embodiment illustrated in FIG. 27, interaction of the magnet 386 with the sensing component 384 can causes the brush motor switch 260 to change state (e.g., from open to closed). Upon removal of the nozzle cover 282, the brush motor 182 is turned off and the brushroll 90 will cease rotating. The sensing component 384 can also send signal to the PCB 336 to cause the UI to provide a status update to the user. In one embodiment, the UI 32 can communicate whether the brushroll 90 is rotating and/or whether the cover 282 is missing via a visual indicator and/or audible message.

Figure 29:
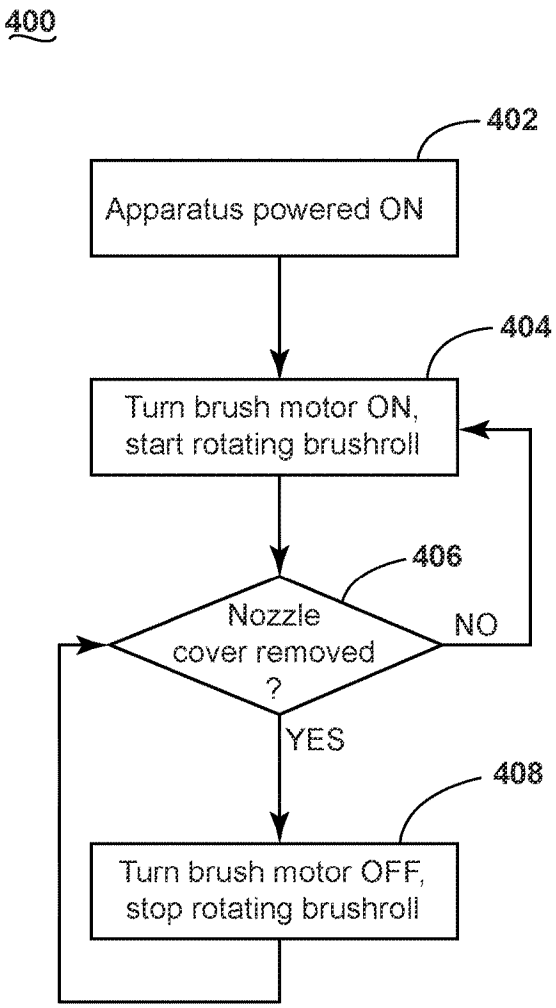
FIG. 29 is a flow chart showing one embodiment of a method for operating the brushroll on the apparatus.

FIG. 29 depicts one method 400 for operating the brushroll 90 of the apparatus 10. When the apparatus 10 is powered on at step 402, and with the nozzle cover 282 installed on the base housing 104, the brushroll 90 begins to rotate at step 404. This can be effected by powering the brush motor 182 when the power input control 34 is pressed to turn the apparatus 10 on and the brush motor switch 260 is closed. When removal of the nozzle cover 282 is detected at step 406, the brush motor switch 260 opens, and the brush motor 182 is turned off at step 408 to stop rotation of the brushroll 90.

It is noted that the methods depicted in FIGS. 24, 25, 28, and 29 may be used together or separately, and may be combined in any order or combination. The methods discussed herein are not mutually exclusive. For example, by supplementing the method 390 of FIG. 28 with the method 400 of FIG. 29, the nozzle sensing mechanism can control both the headlight and the brush motor.

It is noted that with the light pipe 320 including multiple exit ends 340, 342, the base 14 can be considered to include multiple headlights. Each exit ends 340, 342 can form a headlight, and may be referred to herein as first and second headlights, or upper and lower headlights. Thus, the internal light source 318 and light pipe 320 together can function as a headlight assembly with multi-level headlights for illuminating a surface to be cleaned.

In yet another embodiment, instead of a common light source and light pipe, the upper headlight 340 and the lower headlight 342 on the base 14 can each comprise their own light source 318 and light pipe 320. Such a configuration permits the upper and lower headlights to be illuminated together, at the same time, for the upper headlight to be illuminated while the lower headlight is not illuminated, or for the lower headlight to be illuminated while the upper headlight it not illuminated. For example, the controller can be configured to automatically illuminate the upper headlight alone, the lower headlight alone, or both headlights.

Referring to FIG. 8, the upright body 12 comprises tank sockets or receivers 416, 418 for respectively receiving the supply and recovery tanks 20, 22. As shown herein, in one embodiment the tank receivers 416, 418 can be defined by portions of the frame 18, and can be provided on opposing sides of the frame 18, and more particularly on rear and front sides of the frame 18, respectively. The recovery tank receiver 418 can be disposed generally below the supply tank receiver 416 and can include, as previously described, the recovery tank support 160 and spine member 170 forming a portion of the chase 168.

The supply and recovery tanks 20, 22 can include externally-facing surfaces 420, 422, which form external surfaces of the apparatus 10 when the tank 20, 22 are seated in the receivers 416, 418. Optionally, the tanks 20, 22 can have hand grips 424, 426 provided on the externally-facing surfaces 420, 422. As shown herein, the supply tank hand grip 424 comprises hand grip indentations formed in its externally-facing surface 420, and the recovery tank hand grip 426 comprises a handle projecting from its externally-facing surface 422, although other configurations are possible for each tank 20, 22.

Figure 30:
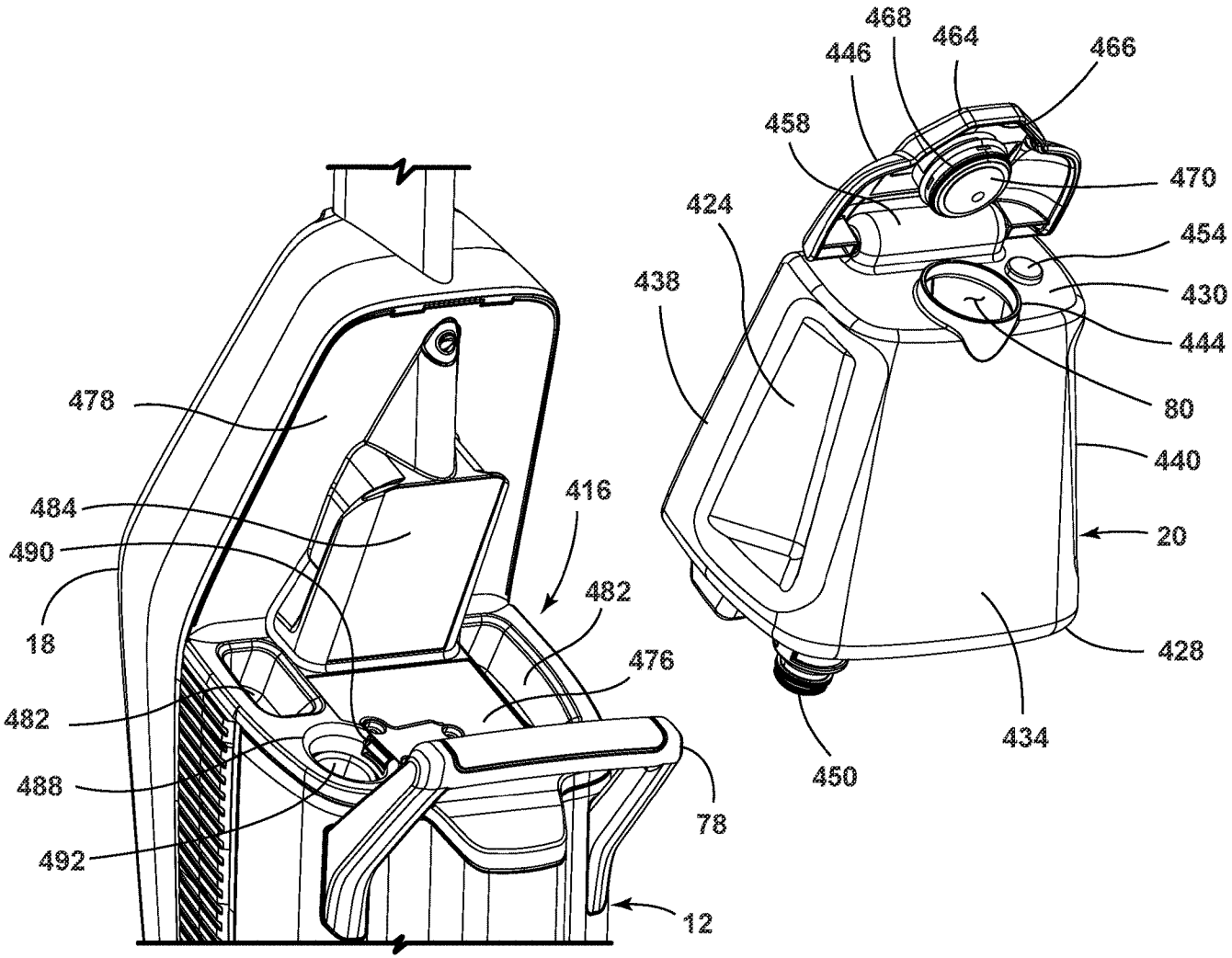
FIG. 30 is a partially-exploded rear perspective view of the apparatus, showing one embodiment of a supply tank, valve receiver, and supply tank latch for the apparatus.
Figure 31:
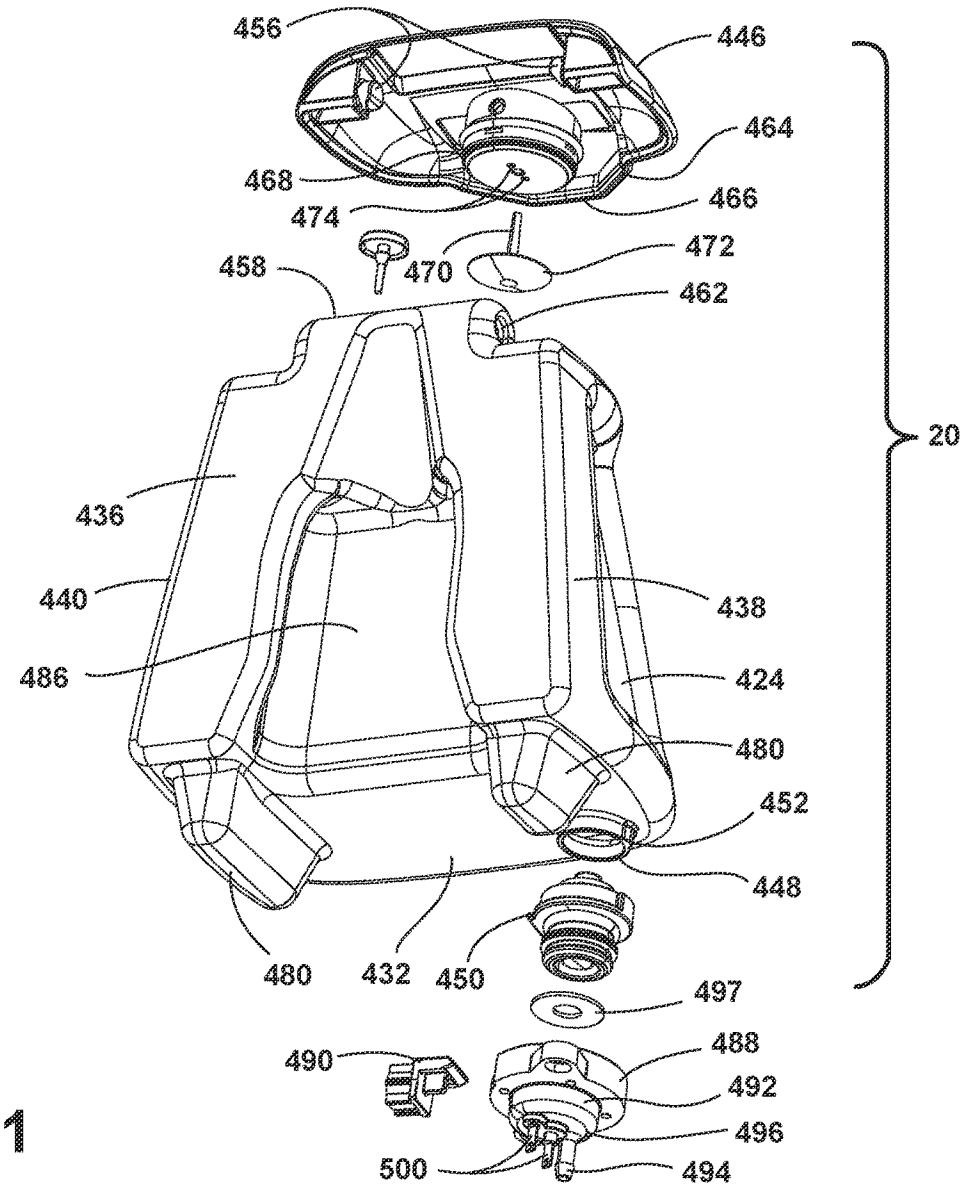
FIG. 31 is an exploded view of the supply tank from FIG. 30, showing details of one embodiment of a connection with the valve receiver.

Referring to FIGS. 30-31, the supply tank 20 includes a tank body 428 having a plurality of walls, such as an upper wall 430, a lower wall 432, and a peripheral side wall, which itself can be formed as a plurality of side walls, such as an outwardly-facing front wall 434, an inwardly-facing rear wall 436, first lateral side wall 438, and second lateral side wall 440. The tank body 428 defines a supply chamber 80 for storing a cleaning liquid. In one embodiment, the tank body 428 is blow-molded. The supply tank hand grip indentations 424 can be formed in the left and right lateral side walls 438, 440.

A fill inlet 444 is formed in the upper wall 430 of the tank body 428 for filling the supply tank 20. The fill inlet 444 is covered by a tank lid 446 to allow selective access to the interior of the body 428.

A tank outlet 448 is formed through the lower wall 432 of the tank body 428. For a removable supply tank 20, the receiving assembly on the frame 18 can be configured to automatically open the tank outlet 448 when the supply tank 20 is seated on the frame 18 to release liquid to the delivery pathway. An outlet valve 450 can be coupled to the outlet 448 to selectively allow liquid flow out of the tank 20. The outlet valve 450 is configured to automatically open when the supply tank 20 is connected to the apparatus 10 and automatically closes when the supply tank 20 is removed so as to prevent leaks from the tank 20. The tank outlet 448 can be defined by a neck 452 extending from the lower wall 432, with the valve 450 attached to the neck 452, such as by being threaded onto the neck 452 or otherwise attached thereto.

A check valve 454 can be mounted to the tank body 428 and is adapted to selectively vent excess gas within the tank 20. For example, depending on the cleaning liquid in the supply tank 20, in some instances excess gas may be generated inside the supply tank 20 due to reactions between various additives or off-gassing from peroxide formulations. In the illustrated embodiment, the check valve 454 is an elastomeric umbrella valve, but in other embodiments, other suitable types of valves can be used. The check valve 454 can be provided in the upper wall 430 of the tank body 428, spaced from the fill inlet 444. The tank lid 446 can cover the fill inlet 444 and the check valve 454 when the lid 446 is closed. If excess gas is generated inside the chamber, the pressurized gas can momentarily deform the elastomeric umbrella valve, thereby venting the excess gas past the valve 454 and through gaps between the tank body 428 and lid 446, into surrounding atmosphere.

The tank lid 446 can be pivotally coupled to the tank body 428 and can cover the fill inlet 444, and also the check valve 454 in a closed position (see FIG. 8). The tank lid 446 can be pivoted to an open position, an example of which is shown in FIG. 30, in which the fill inlet 444 is exposed and the tank chamber 442 can be filled with cleaning liquid. In an alternate embodiment, not shown, the tank lid 446 can be a removable cover for the supply tank 20.

The lid 446 is pivotally coupled to the tank body 428. The lid 446 can have opposing pivot posts 456 that are received in a sleeve 458 on the tank body 428 to pivotally couple the lid to the tank body 428 for pivoting movement about a pivot axis defined by the pivot posts 456. The pivot posts 456 can extend inwardly toward each other from respective ends of the lid 446. A single sleeve 458 can be formed or otherwise provided on the upper wall 430 of the tank body 428 and can have opposing end openings 462, only one of which is visible in FIG. 31, in which that pivot posts 456 are inserted. In the illustrated embodiment, the tank body 428 is blow molded and the pivot posts 456 are integrally molded with the lid 446 and are snap fit into the end openings 462 in the sleeve 458. In other embodiments, the lid 446 can be connected to the tank body 428 by other structures, including a press-fit coupling or other fastenings.

The tank lid 446 can include a handle 464 or other gripping feature that is made to be grasped or held by the hand. The illustrated handle 464 includes a projecting lip 466 that overhangs the tank body 428 when the lid 446 is closed (see FIG. 4). The handle 464 and/or lip 466 can be integrally formed with the lid 446, or can be separately formed and joined to the lid 446. The lip 466 can be disposed on a side of the lid 446 opposite the pivot coupling with the tank body 428. In the embodiment shown, the lip 466 overhangs the outwardly-facing front wall 434 of the tank body 428.

The tank lid 446 can carry a plug 468 for sealing the fill inlet 444 and preventing spills from the supply tank 20. The plug 468 is aligned with the fill inlet 444 for a fluid-tight closure of the fill inlet 444 when the tank lid 446 is closed. The plug 468 can be at least partially received in the fill inlet 444 to stop up or fill the inlet 444. Other sealing arrangements are possible, including seals that are not received within the fill inlet 444 itself, but which provide a fluid-tight and leak proof engagement between the fill inlet 444 and the tank lid 446.

The supply tank 20 can include a pressure relief valve 470. In the illustrated embodiment, the pressure relieve valve 470 is an umbrella valve, but in other embodiments, other suitable types of valves can be used. The pressure relief valve 470 is adapted to vent ambient atmospheric air into the chamber 442 when liquid therein is released through the tank outlet 448 during use.

The pressure relief valve 470 can be mounted to the tank plug 468, and can, for example, include a resilient circular sealing flap 472 for selectively sealing at least one vent hole 474 in the tank plug 468 of the lid 446. Ambient air enters between the perimeter of the lid 446 and tank body 428. The tank plug 468 includes holes through which ambient air passes to reach the vent holes 474. When negative pressure is generated inside the chamber 442, e.g. via liquid release through the tank outlet 448, the negative pressure momentarily deforms the resilient sealing flap 472, thereby venting ambient air through vent hole(s) 474, past the flap 472 and into the chamber 442.

The supply tank receiver 416 and supply tank 20 can have one more features for aligning and/or retaining the supply tank 20 on the supply tank receiver 416. In the embodiment illustrated herein, the supply tank receiver 416 can include a base support wall 476 and an upstanding support wall 478 provided on the frame 18, below the handle 16. The upstanding support wall 478 can generally extend upwardly from the base support wall 476 and can optionally angle backward over a portion of the base support wall 476.

The lower wall 432 of the supply tank 20 can comprise a plurality of feet 480 adapted to support the supply tank 20 at rest on a horizontal surface, such as when the supply tank 20 is removed from the apparatus 10. The feet 480 can also act as alignment and/or retaining features to assisting in aligning and/or retaining the supply tank 20 on the supply tank receiver 416. In one embodiment, the base support wall 476 can have a plurality of recesses 482 configured to receive the tank feet 480 when the supply tank 20 is mounted to the receiver 416.

The supply tank receiver 416 can have a T-shaped projection 484 on the upstanding support wall 478, and the supply tank 20 can include a corresponding indent 486 in a sidewall thereof, for example the inwardly-facing rear wall 436, which is configured to slide over and receive the T-shaped projection 484 for installation of supply tank 20. The slidable engagement of the indent 486 over the T-shaped projection 484 allows the supply tank 20 to be inserted and removed along a more vertical path that clears the carry handle 78. Other inter-engaging features on the supply tank 20 and receiver 416 are also possible.

The supply tank receiver 416 includes a valve receiver 488, for example formed in the base support wall 476, for receiving the neck 452 on the supply tank 20. The valve receiver 488 is configured to open the outlet valve 450 for liquid flow through the tank outlet 448 when the supply tank 20 is seated within the supply tank receiver 416.

The supply tank receiver 416 include a latch for securing the supply tank 20 to the upright body 12. In one embodiment, the latch for the supply tank 20 can comprise a clamp 490 configured to release the supply tank 20 upon application a sufficient force to overcome the biased latching force of the clamp 490. The clamp 490 facilitates correct installation and better sealing of the supply tank 20, which alleviates user error and misassembly. The clamp 490 can be configured to releasably latch or retain, but not lock, the supply tank 20 on the frame 18, such that a user can conveniently apply sufficient force to the supply tank 20 itself to pull the supply tank 20 off the frame 18. In another embodiment, the supply tank latch can be configured to releasably lock the tank 20 to the frame 18, such that a user must actuate the latch before pulling the tank 20 off the frame 18.

In one embodiment, the clamp 490 can comprise a spring-biased clamp, which projects into the valve receiver 488 and engages a portion of the outlet valve 450 or a portion of the neck 452 of the tank body 428 to secure the supply tank 20. Other configurations for the tank latch are possible. When the supply tank 20 is seated within the supply tank receiver 416, the supply tank 20 slides over the T-shaped projection 484, with the feet 480 received in the recesses 482 on the base support wall 476, and the tank 20 retained in position on the valve receiver 488 by the clamp 490.

The valve receiver 488 can include a receiver well 492 adapted to at least partially, or substantially fully, receive the neck of the supply tank 20 and into which liquid flows when the supply tank 20 is mounted in the tank receiver 416 and the outlet valve 450 is open. The well 492 includes an outlet 494 at a lower end 496 thereof, and the outlet 494 can be in fluid communication with an inlet of the pump 180 via the conduit 174, which can connect the well outlet 494 to the pump 180. A filter 497 can be disposed in the receiver well 492 to filter the liquid passing from the supply tank 20 through the well outlet 494. Other configurations for fluid communication between the well 492 and pump 180 are possible.

Figure 32:
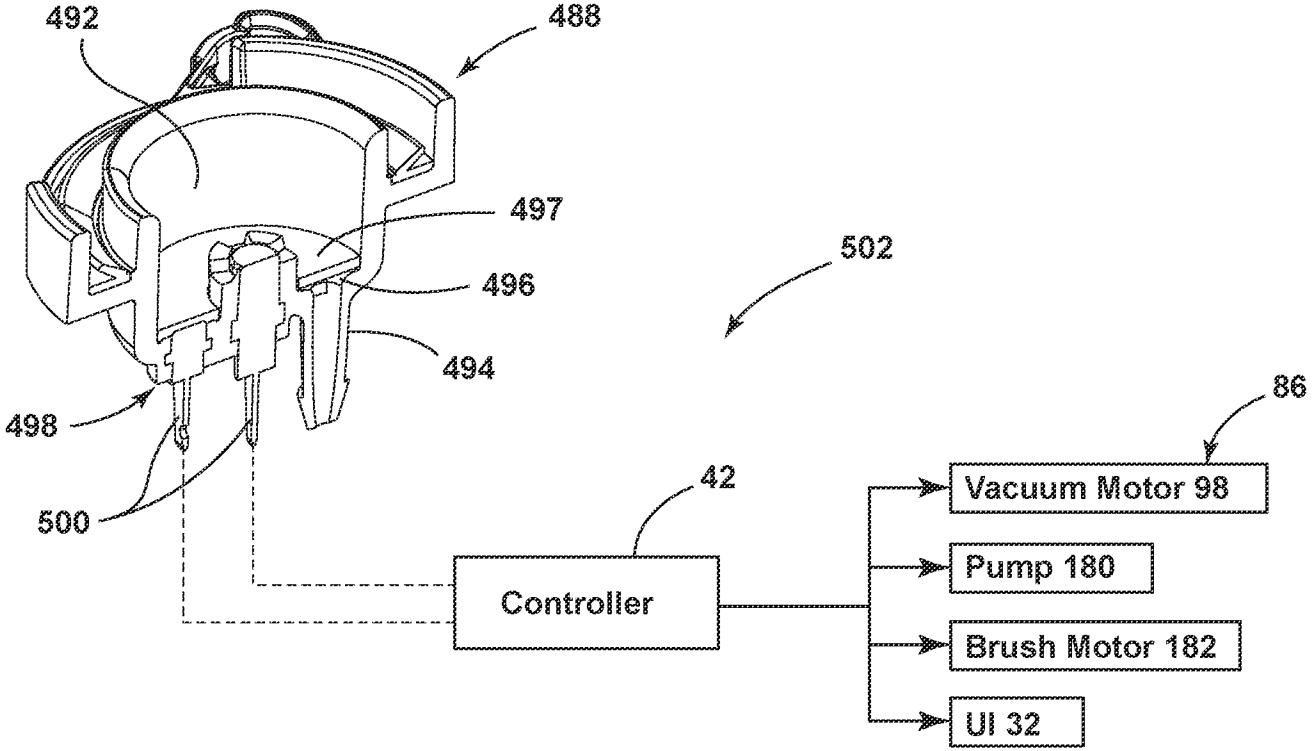
FIG. 32 is a schematic view of one embodiment of a liquid sensing system for the supply system of the apparatus.

Referring to FIG. 32, in one embodiment, the apparatus 10 can have a liquid sensing system 502 configured to detect whether there is liquid available for delivery to the pump 180. The sensing system can include any suitable components for sensing liquid within the supply pathway, such as within the supply tank 20 or within the valve receiver 488. In the illustrated embodiment, the sensing system includes a conductivity sensor 498 can be located in the receiver well 492 in a position to sense the presence of liquid. In the embodiment shown herein, the conductivity sensor 498 includes two contacts 500 located in the lower end 496 of the receiver well 492. When liquid is present in the well 492, a circuit is completed. When liquid is not present in the well 492, e.g. when the supply tank 20 is empty or when the supply tank 20 is missing from the receiver 416, the circuit breaks and a signal is sent to the controller 42. The controller 42 can issue an alert from the user interface 32, visually and/or audibly, that can indicate that the supply tank 20 is empty and/or that the supply tank 20 is missing. Other locations and configurations for the conductivity sensor 498, where the conductivity sensor 498 can sense the presence of liquid in the receiver well 492 or in the supply tank 20, are possible. Yet other sensors for determining whether the supply tank 20 is empty or missing are possible, such as a weight sensor.

Input from the liquid sensing system 502 can further be used by the controller 42 to determine when to shut-off or otherwise interrupt the supply system. When liquid is not present in the well 492, e.g. when the supply tank 20 is empty or when the supply tank 20 is missing from the receiver 416, the circuit between the contacts 500 is not completed, and the controller 42 can turn off at least one electrical component of the apparatus 10, or prevent at least one electrical component from activating. Such components can include the pump 180, and optionally also the vacuum motor 98 and/or the brush motor 182. Additionally or alternatively, the controller 42, based on the empty supply tank 20 or absence of the supply tank 20, can provide a visual or audible status indication such as a light or sound via the UI 32. The visual or audible status indication can alert the user that the supply tank 20 is empty, missing, and/or that a component of the apparatus 10 has been turned off.

Figure 34:
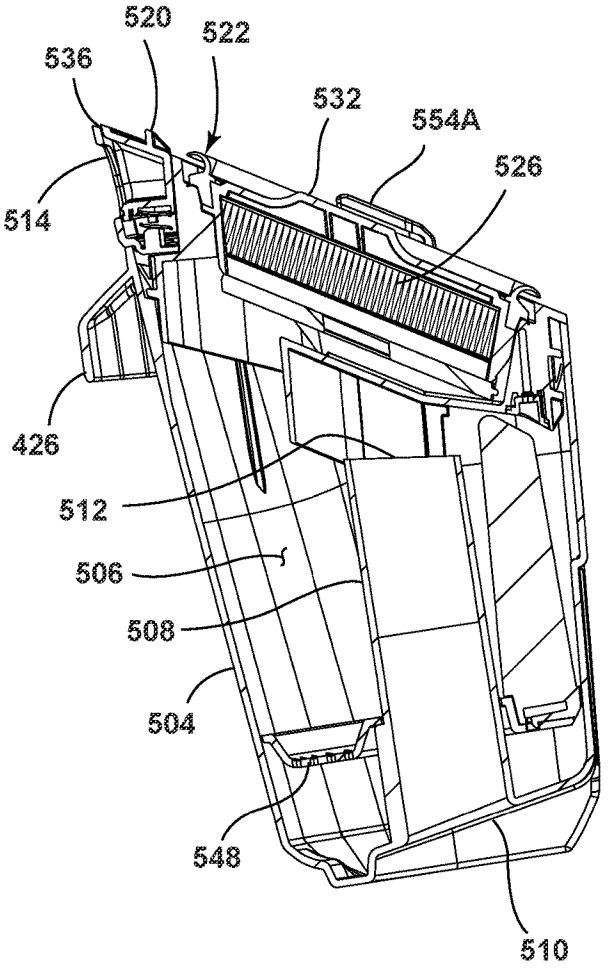
FIG. 34 is a cross-sectional view through the recovery tank of FIG. 33.
Figure 33:
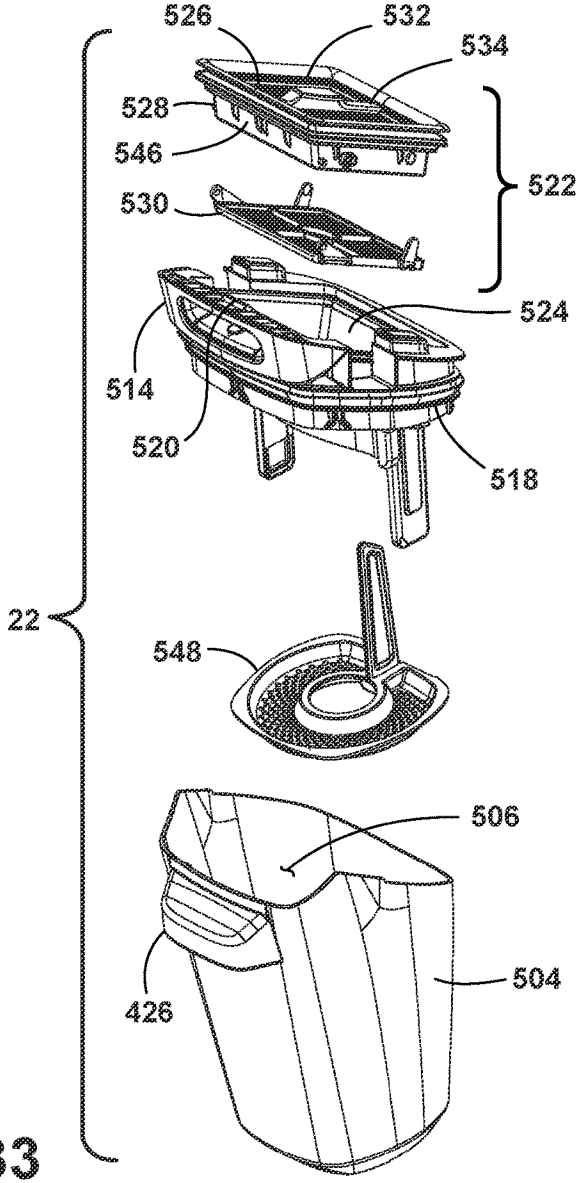
FIG. 33 is an exploded view of one embodiment of a recovery tank for the apparatus.

FIG. 33 is a partially exploded perspective view of one embodiment of the recovery tank 22 and FIG. 34 is a cross-sectional view of the recovery tank 22. The recovery tank 22 can include a recovery tank container 504, which forms a collection chamber 506 for the recovery system, with a hollow standpipe 508 therein. The standpipe 508 can be oriented such that it is generally coincident with a longitudinal axis of the tank container 504. The standpipe 508 forms a flow path between a tank inlet 510 formed at a lower end of the tank container 504 and a tank outlet 512 at the upper end of the standpipe 508 within the interior of the tank container 504. When the recovery tank 22 is mounted to the frame 18 as shown in FIG. 4, the inlet 510 is aligned with the conduit 92 to establish fluid communication between the base 14 and the recovery tank 22. The standpipe 508 can be integrally formed with the tank container 504.

Figure 35:
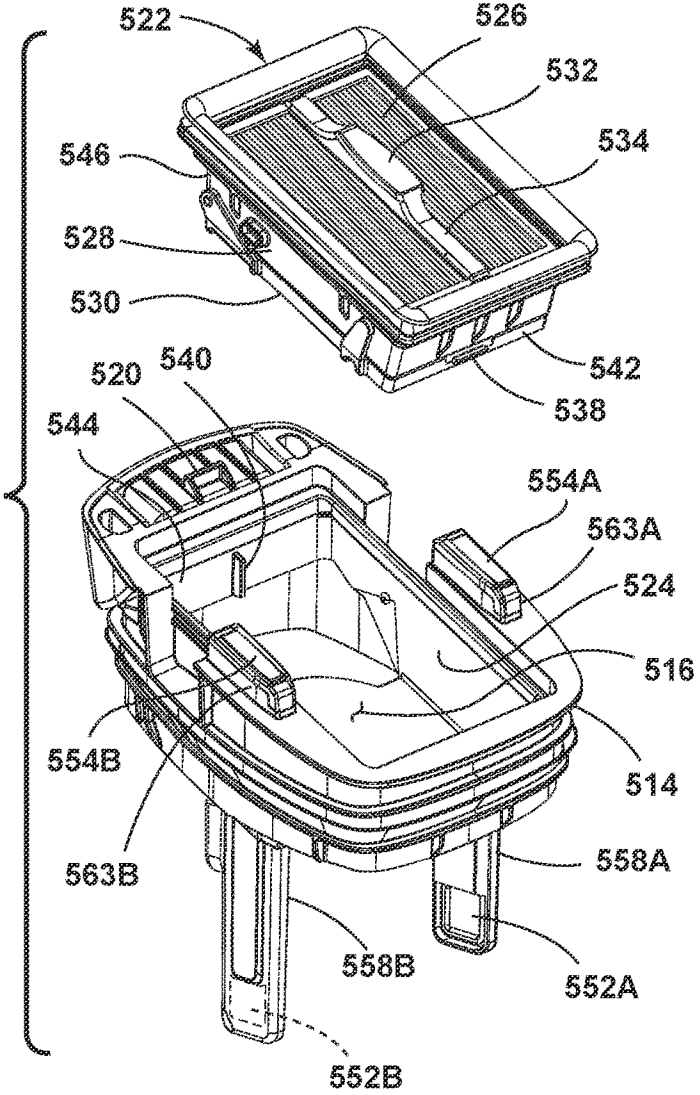
FIG. 35 is an exploded view of a lid for the recovery tank of FIG. 33, showing a poka yoke installation for a filter assembly of the recovery tank.
Figure 39:
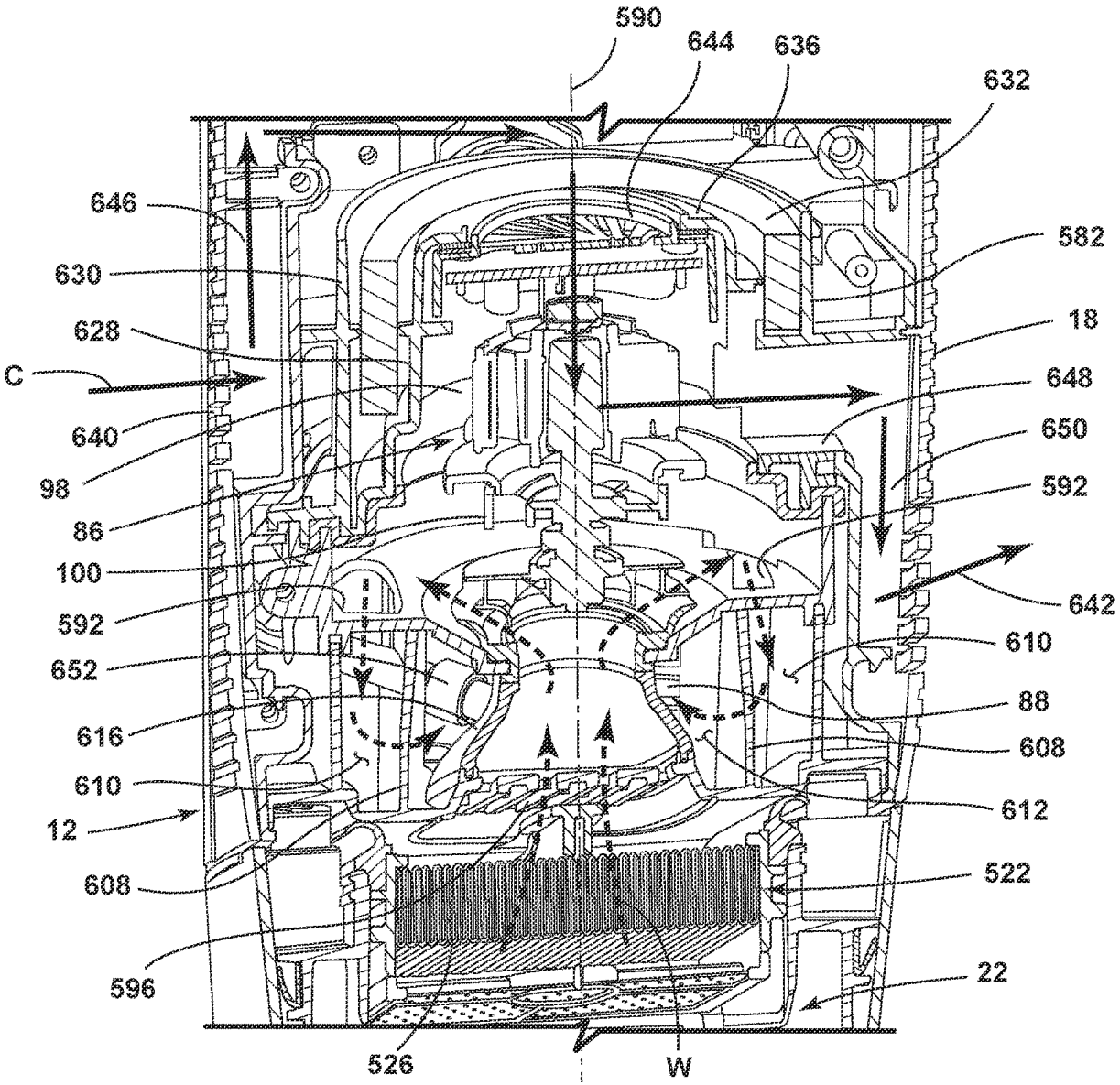
FIG. 39 is a sectional view showing portions of a working air path and a motor cooling air path of the apparatus, including showing one embodiment of an enclosure for a suction source.

Referring additionally to FIG. 35, the recovery tank 22 further includes a lid 514 sized for receipt on the tank container 504. The lid 514 at least partially encloses an open top of the tank container 504, and can further define an air outlet 516 of the recovery tank 22 leading to the downstream suction source 86 (FIGS. 4 and 39). A gasket 518 is positioned between mating surfaces of the lid 514 and the tank container 504 and creates a seal therebetween for prevention of leaks.

Figure 36:
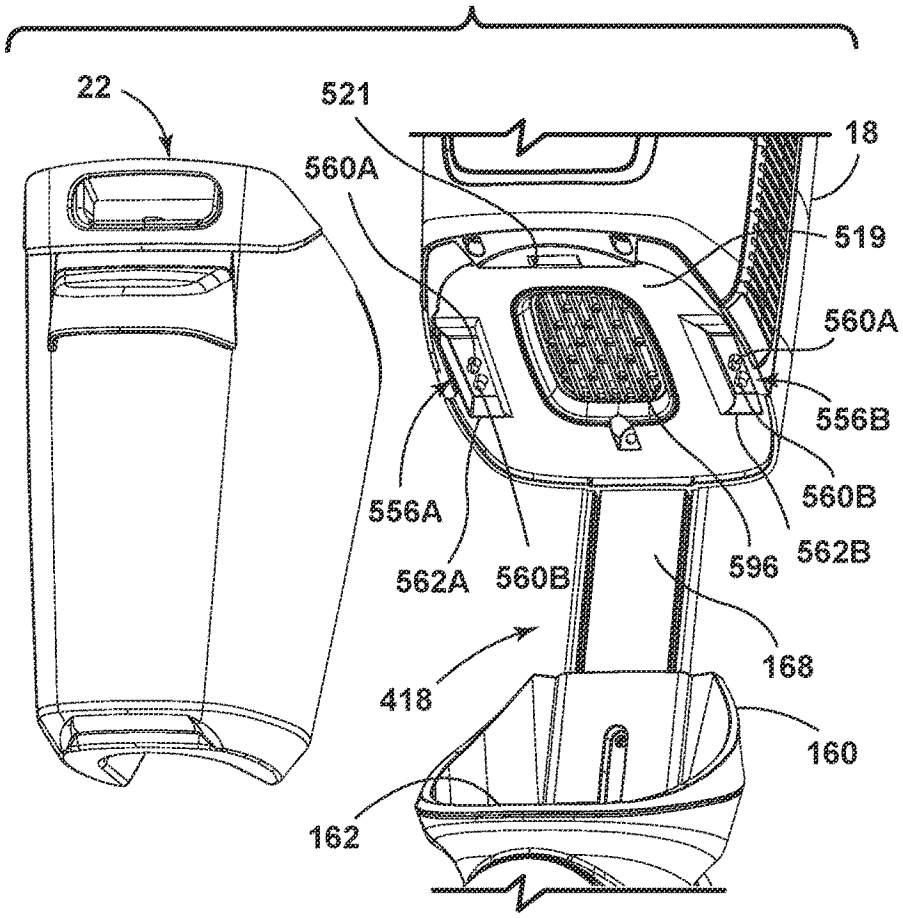
FIG. 36 is an exploded view showing the recovery tank receiver have sensors for detecting the recovery tank and the liquid level within the recovery tank.

A recovery tank latch 520 can optionally be supported by the lid 514 for securing the recovery tank 22 to the upright body 12 within the recovery tank receiver 418, shown in FIG. 36. The recovery tank receiver 418 includes a latch catch 521 in which the tank latch 520 is received. The latch catch 521 can be formed anywhere on the receiver 418 in a suitable position for engagement by the tank latch 520 when the recovery tank 22 is seated in the receiver 418. For example, the latch catch 521 can be provided in a ceiling 519 of the tank receiver 418. The ceiling 519 can generally be disposed in opposition to the support 160, with the recovery tank 22 being held between the base 162 of the support 160 and the ceiling 519 when mounted on the frame 18. The ceiling 519 can be configured to fit tightly against the lid 514 the recovery tank 22 to provide a sealed pathway from the tank 22 to the suction source 86 (FIG. 4), such as via a grille 596 described in further detail below. The ceiling 519 can be angled rearwardly, i.e. toward the chase 168, to facilitate the insertion and sealing of the tank 22.

The latch 520 can be configured to releasably lock the recovery tank 22 to the upright body 12, such that a user must actuate the latch 520 before pulling the tank 22 off the frame 18. The hand grip 426 on the recovery tank 22 can be located below the latch 520 and can facilitate removal of the recovery tank 22 from the frame 18. In another embodiment, the latch 520 can releasably latch or retain, but not lock, the tank 22 on the frame 18, such that a user can conveniently apply sufficient force to the tank 22 itself to pull the tank 22 off the frame 18.

The recovery tank 22 can further include a filter assembly 522 provided at the air outlet 516. The filter assembly 522 can be supported by the lid 514 and the lid 514 can include a filter receiver 524 on an upwardly-facing side thereof that is sized to receive the filter assembly 522. The filter assembly 522 is removably mounted in the filter receiver 524.

The filter assembly 522 can include a filter media 526 supported within a bracket 528. In one embodiment, the filter media 526 is a pleated filter, and can be made of a material that remains porous when wet. The filter assembly 522 can include also include a mesh screen 530 carried by the bracket 528. The mesh screen 530 is positioned on an upstream inlet side of the filter media 526, and can be configured to filter a larger particle size than the filter media 526. In FIG. 33, the mesh screen 530 is shown as exploded from the bracket 528 for clarity. However, it is understood that the filter assembly 522 is removable as a unit from the filter receiver 524 of the lid 514.

The filter assembly 522 can have a grip portion 532 or other gripping feature that is made to be grasped or held by the hand for easy removal of the filter assembly 522. The grip portion 532 can extend from a rib 534 running across a downstream outlet side of the filter media 526. The grip portion 532 can be low profile so that it is flush with or below an uppermost portion 536 of the recovery tank 22 (see FIG. 34) so that the grip portion 532 does not interfere with installation of recovery tank 22 in the receiver 418 on the frame 18. In one embodiment, the uppermost portion 536 of the recovery tank 22 can be defined by a front edge of the tank lid 514.

Referring to FIG. 35, the filter assembly 522 can have a poka yoke installation to prevent a user from inadvertent error in installing the filter assembly 552 on the recovery tank 22. In one embodiment, the poka yoke installation includes at least one projecting feature 538, 540 on the filter assembly 522 and/or on the filter receiver 524 that prevents a user from installing the filter assembly 522 incorrectly by interfering with the insertion of the filter assembly 522 into the filter receiver 524. As shown, a first rib 538 can be provided on an outwardly-facing side 542 of the filter assembly 522 and a second rib 540 can be provided on an inwardly-facing side 544 of the filter receiver 524. In the insertion direction of the filter assembly 522, the ribs 538, 540 can be orthogonal to each other (as shown), oblique to each other, or otherwise positioned relative to each other to prevent the filter assembly 522 from being fully installed into the filter receiver 524 in error. As shown, the first rib 538 can be provided on a first outwardly-facing side 542 of the filter assembly 522 and the second rib 540 can be provided on an inwardly-facing side 544 of the filter receiver 524 that, when correctly installed, lies in opposition to an second side 546 of the filter assembly 522 opposite the first side 542. With the ribs 538, 540 so positioned, a user cannot install the filter assembly 522 backwards in the filter receiver 524. It is noted that the rectangular shape of the filter assembly 522 and filter receiver 524 also provide a means for preventing inadvertent error in installing the filter assembly 522 on the recovery tank 22 as, for example, the filter assembly 522 cannot be inserted into the filter receiver 524 sideways.

Referring back to FIGS. 33-34, the recovery tank 22 can further include a removable strainer 548 configured to strain large debris and hair out of the tank container 504 prior to emptying. The strainer 548 is configured to collect the large debris and hair while draining liquid and smaller debris back into the tank container 504. One example of a suitable strainer is disclosed in U.S. Patent Application Publication No. 2019/0159646, filed Nov. 30, 2017, which is incorporated herein by reference in its entirety. For purposes of this description, large debris are any debris with a maximum dimension, such as a length or diameter, of greater than or equal to 0.5 mm to 6 mm, and preferably 3 mm, whereas small debris are any debris having a maximum dimension, such as a length or diameter, of less than that of the larger debris. An example of a piece of large debris includes a strand of hair with a length greater than 3 mm. Examples of small debris include coffee grounds and crumbs with diameters less than 3 mm.

Figure 37:
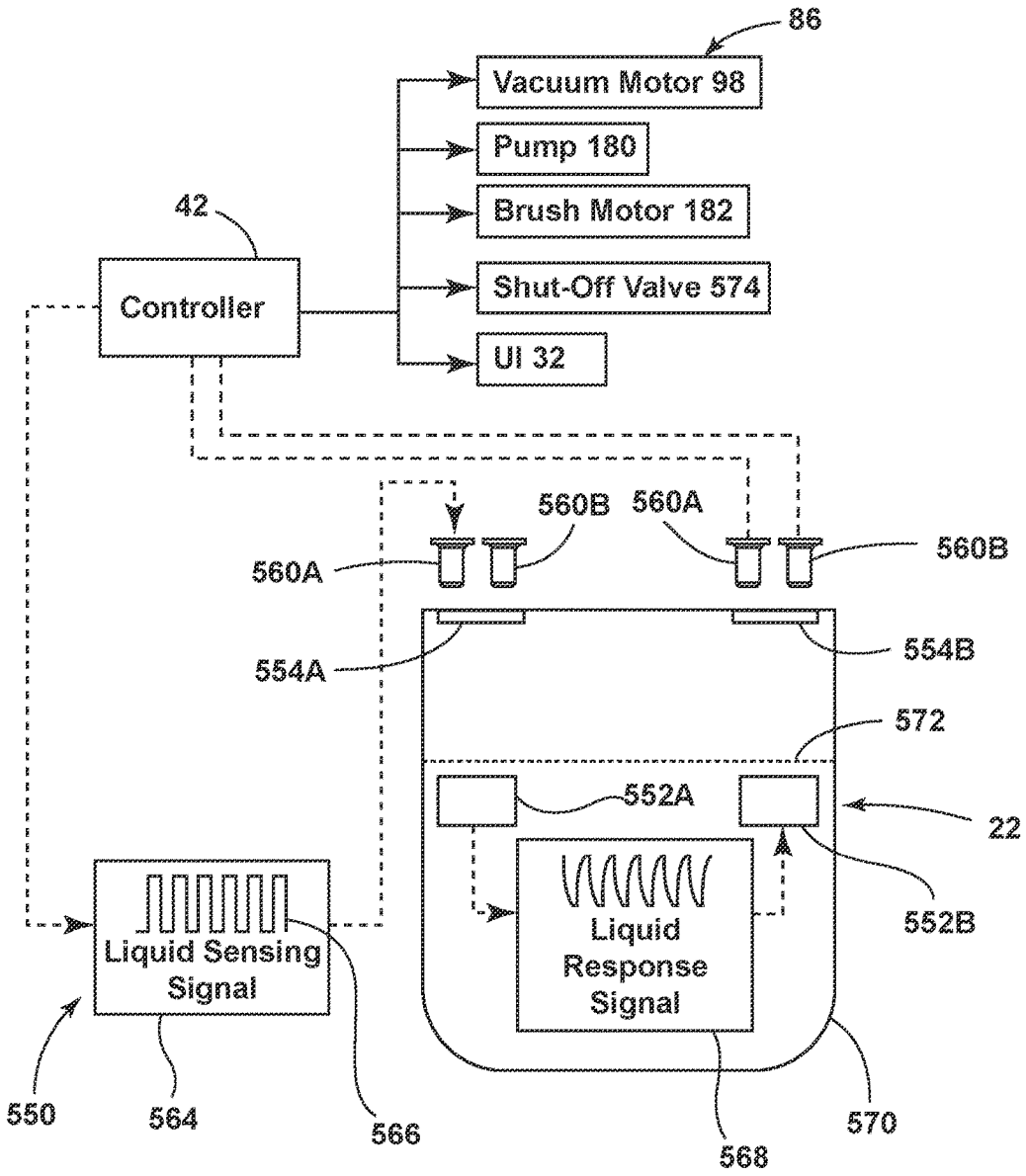
FIG. 37 is a schematic view of one embodiment of a liquid level sensing system for the recovery tank of the apparatus.

Referring to FIGS. 35-37, in one embodiment, the recovery tank 22 can have a sensing system 550 configured to detect liquid at one or more levels within the recovery tank 22 and determine when to shut-off or otherwise interrupt the recovery system. The sensing system 550 can include any suitable components for sensing liquid within the recovery tank 22. With the provision of the sensing system 550, the recovery tank 22 does not require an in-tank float-style shut off. In other words, the recovery tank 22 is a floatless tank.

In the illustrated embodiment, the sensing system 550 includes at least one sensor 552A, 552B, optionally in the form of at least one probe, which can detect liquid. In the illustrated embodiment, two sensors 552A, 552B in the form of probes are included, through other numbers and forms of sensors are possible. The sensors 552A, 552B can be electrically coupled with a conductive pad 554A, 554B, optionally provided on the lid 514, which couple with electrical contacts 556A, 556B on the recovery tank receiver 418 when the recovery tank 22 is mounted on the frame 18 to supply power to the sensors 552A, 552B.

The sensors 552A, 552B can optionally be supported by the lid 514, or more particularly by at least one bracket formed on or otherwise coupled with the lid 514. In the illustrated embodiment, two brackets 558A, 558B depending downwardly from the lid 514 are included, through other numbers and forms of brackets are possible. The brackets 558A, 558B can be offset from the standpipe 508. When the lid 514 is coupled to the container 504, the brackets 558A, 558B can project into the collection chamber 506.

In one embodiment, the sensing system 550 is configured to detect both the presence of the recovery tank 22 on the apparatus 10 and a liquid level within the recovery tank 22. The electrical contacts 556A, 556B on the recovery tank receiver 418 can, for example each comprise a pair of spring-mounted pins, including a first pin 560A and a second pin 560B. First pins 560A can provide input regarding the liquid level in the tank 22, and second pins 560B can provide input regarding the presence of the recovery tank 22, or vice versa. When the recovery tank 22 is mounted in the tank receiver 418, the terminal ends of the pins 560A, 560B are in contact with the conductive pads 554A, 554B on the recovery tank lid 514.

The electrical contacts 556A, 556B can be formed anywhere on the receiver 418 in a suitable position for engagement with the conductive pads 554A, 554B when the tank 22 is seated in the receiver 418. For example, as shown in FIG. 36, the electrical contacts 556A, 556B can be provided in the ceiling 519 of the tank receiver 418. The pins 560A, 560B can project downwardly from the ceiling 519 to contact the conductive pads 554A, 554B. The pins 560A, 560B can be disposed within sockets 562A, 562B in the ceiling 519 to protect the pins 560A, 560B. The sockets 562A, 562B can be sized to fit around the conductive pads 554A, 554B on the tank lid 514. The conductive pads 554A, 554B can be provided on posts 563A, 563B that extend upwardly from the lid 514, for example on opposing sides of the filter receiver 524, such that the filter assembly 522 lies between the conductive pads 554A, 554B when installed on the lid 514. The posts 563A, 563B can be at least partially received by the sockets 562A, 562B when the recovery tank 22 in seated in the tank receiver 418, which can help align and/or retain the tank 22 in the receiver 418.

The electrical contacts 556A, 556B on the recovery tank receiver 418 are coupled with main controller 42. For tank detection, if the spring-loaded pins 560B indicate that the recovery tank 22 is absent, the controller 42 can turn off the at least one electrical component of the apparatus 10. Such components can include the suction source 86 itself, and more particularly the vacuum motor 98, and optionally also the pump 180 and/or the brush motor 182. Additionally or alternatively, the controller 42, based on the absence of the recovery tank 22, can provide a visual or audible status indication such as a light or sound via the UI 32. The visual or audible status indication can alert the user that the recovery tank 22 is missing and/or that a component of the apparatus 10 has been turned off.

For liquid level detection, the first sensor 552A can emit a liquid sensing signal 564 from the controller 42 at a given frequency 566. The liquid sensing signal 564 travels through contents of the recovery tank 22 to form a liquid response signal 314 that can be detected by the second sensor 552B and communicated to the controller 42. The first and/or second sensor 552A, 552B can be located in the recovery tank 22 at a critical liquid level 572. The term critical liquid level is used herein to define a level or location where, if liquid is present, at least one electrical component of the apparatus 10 is shut down to prevent liquid ingress into the suction source 86. If the liquid response signal 568 indicates that the liquid in the recovery tank 22 is at or above the critical level 572, the controller 42 can turn off the at least one electrical component of the apparatus 10. Such components can include the suction source 86 itself, and more particularly the vacuum motor 98, and optionally also the pump 180 and/or the brush motor 182.

In yet another configuration, the controller 42 can additionally or alternatively activate a shut-off valve 574 in response to the liquid response signal 568 to prevent liquid ingress into the suction source 86. The shut-off valve 574 can be provided for interrupting suction when liquid in the recovery tank 22 reaches the critical level 572. The shut-off valve 574 can be positioned in any suitable manner and include any suitable type of valve.

Additionally or alternatively, the controller 42, based on the liquid response signal 568, can provide a visual or audible status indication such as a light or sound via the UI 32. The visual or audible status indication can alert the user that the liquid is too high in the recovery tank 22 or that a component of the apparatus 10 has been turned off.

Optionally, the sensing system 550 can include electronic components to capacitively couple and smooth the response signals such that the rise time or the average amplitude of the voltage of the received signals can be determined. In another non-limiting example, the controller 42 can be configured to perform one or more signal processing algorithms on the received response signals to determine one or more characteristics of the received response signal. Signal processing algorithms incorporated into the controller 42 for assisting in the determination of one or more characteristics of the received signals can include, but are not limited to, blind source separation, principal component analysis, singular value decomposition, wavelet analysis, independent component analysis, cluster analysis, Bayesian classification, etc.

It is contemplated that any of the sensors 552A, 552B of the sensing system 550 can be configured to transmit, receive or transmit and receive one or more sensing signals. The sensing signals can include any waveform useful in sensing liquid, including, but not limited to, square waves, sine waves, triangle waves, sawtooth waves, and combinations thereof. Furthermore, the sensing signals can include any frequency useful in sensing liquid, including, but not limited to, frequencies ranging from approximately 10 kilohertz to 10 megahertz. In one non-limiting example, the liquid sensing signals can be multiplexed and transmitted simultaneously to one or more sensors.

The recovery tank 22 can be periodically emptied of collected liquid and debris by removing the recovery tank 22 from the frame 18, removing the lid 514 from the tank container 504, which also removes the sensors 552A, 552B and brackets 558A, 558B. Next, a user lifts the strainer 548 out of the tank container 504. As the strainer 548 is lifted, large debris and hair is captured while liquid and smaller debris is allowed to drain back into the container 504. The user can then dispose of any debris on the strainer 548 in the trash, and then dispose of the remaining liquid and smaller debris in the tank container 504 in a sink, toilet, or other drain.

Figure 38:
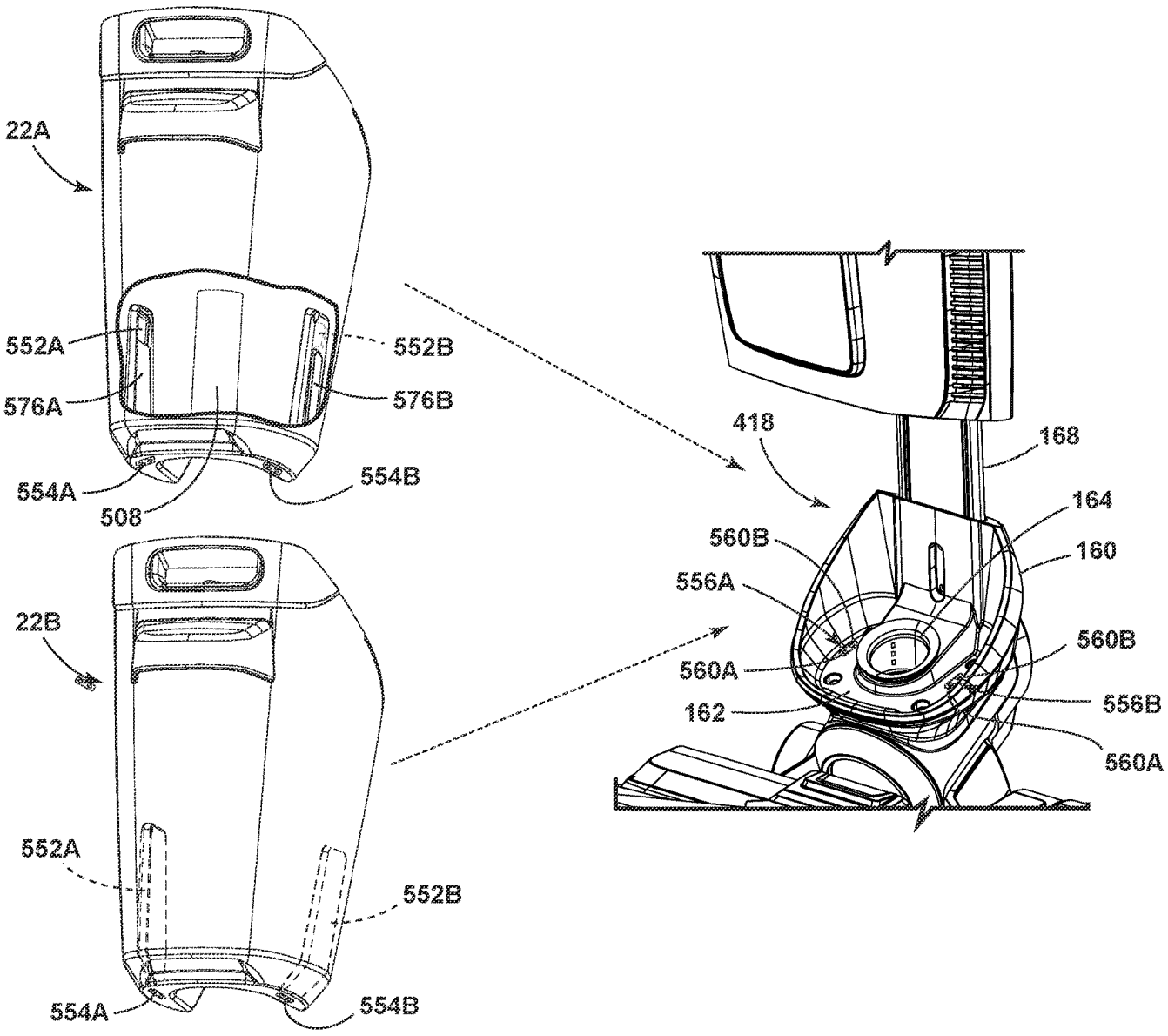
FIG. 38 is a view showing alternative configurations for the liquid level sensing system.

Other configurations for the recovery tank sensors are possible. FIG. 38 shows an embodiment with an alternative recovery tank 22A, where the sensors 552A, 552B can optionally be supported by the container 504, such as by brackets 576A, 578B extending upwardly from a bottom of the container 504. The brackets 576A, 578B can be offset from the standpipe 508, and the strainer 548 (FIG. 33) can have appropriate clearance provided for the brackets 576A, 578B. The conductive pads 554A, 554B for the sensors 552A, 552B can be provided on the bottom wall of the container 504, with the electrical contacts 556A, 556B provided on the recovery tank support 160 of the recovery tank receiver 418. FIG. 38 also shows another alternative recovery tank 22B, where the sensors 552A, 552B can optionally be molded directly into the side walls of the container 504, thereby eliminating separate brackets. The conductive pads 554A, 554B for the sensors 552A, 552B can be provided on the bottom wall of the container 504.

Figure 42:
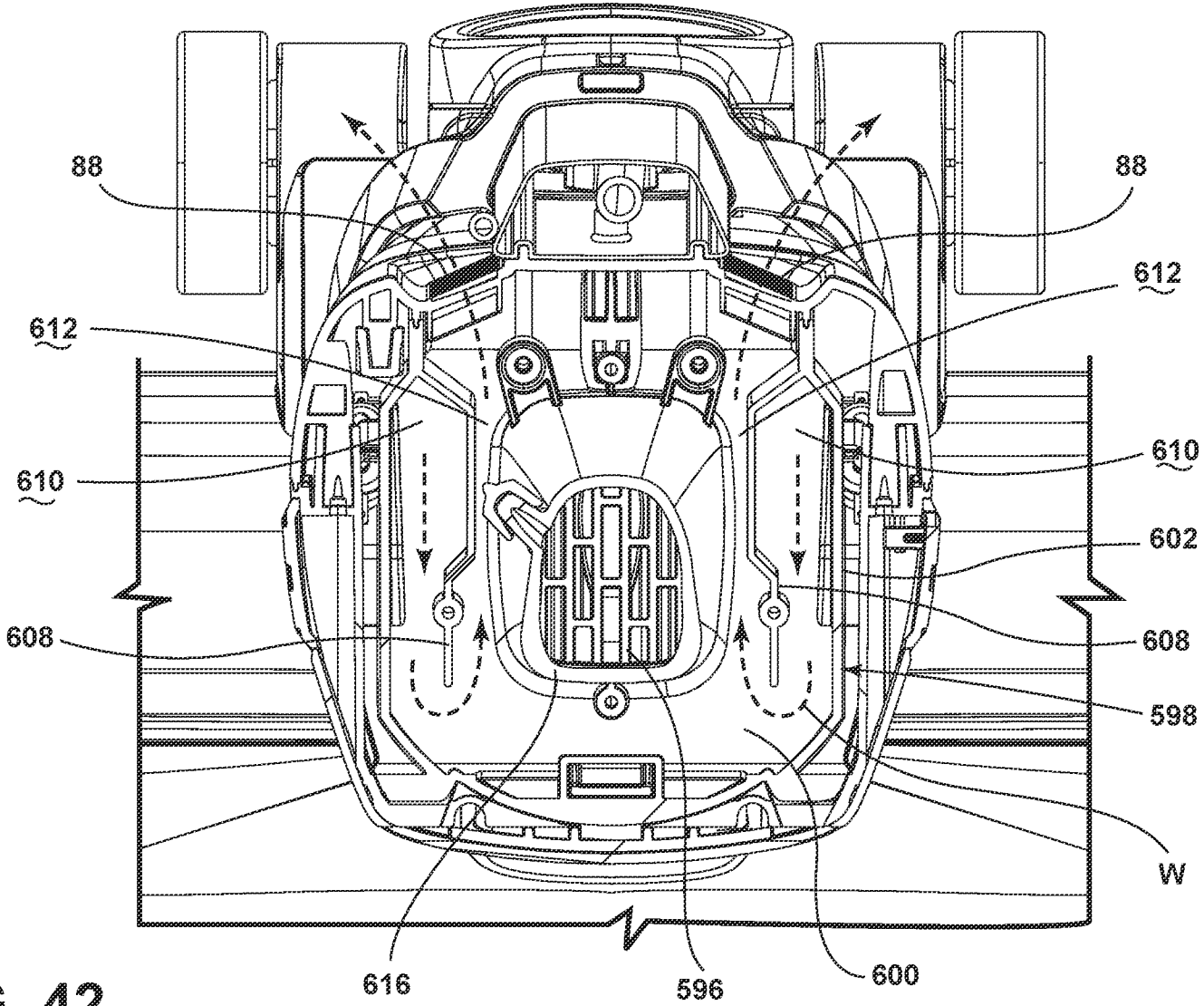
FIG. 42 is a cross-sectional view of the apparatus taken through line XLII-XLII of FIG. 1, showing portions of a working air path of the apparatus.

Referring to FIG. 39, downstream of the recovery tank 22 and filter assembly 522, the recovery pathway can include suction source 86 and at least one exhaust vent 88 defining the clean air outlet (see also FIG. 8). In the illustrated embodiment, two exhaust vents 88 are provided on the rear side of the frame 18, though only one vent 88 is visible in FIGS. 8 and 39, and although other numbers and locations for the exhaust vents 88 are possible. In FIGS. 39 and 42, a working air flow path through the enclosure 580, which defines a portion of the recovery pathway, is generally indicated by arrows W.

Figure 40:
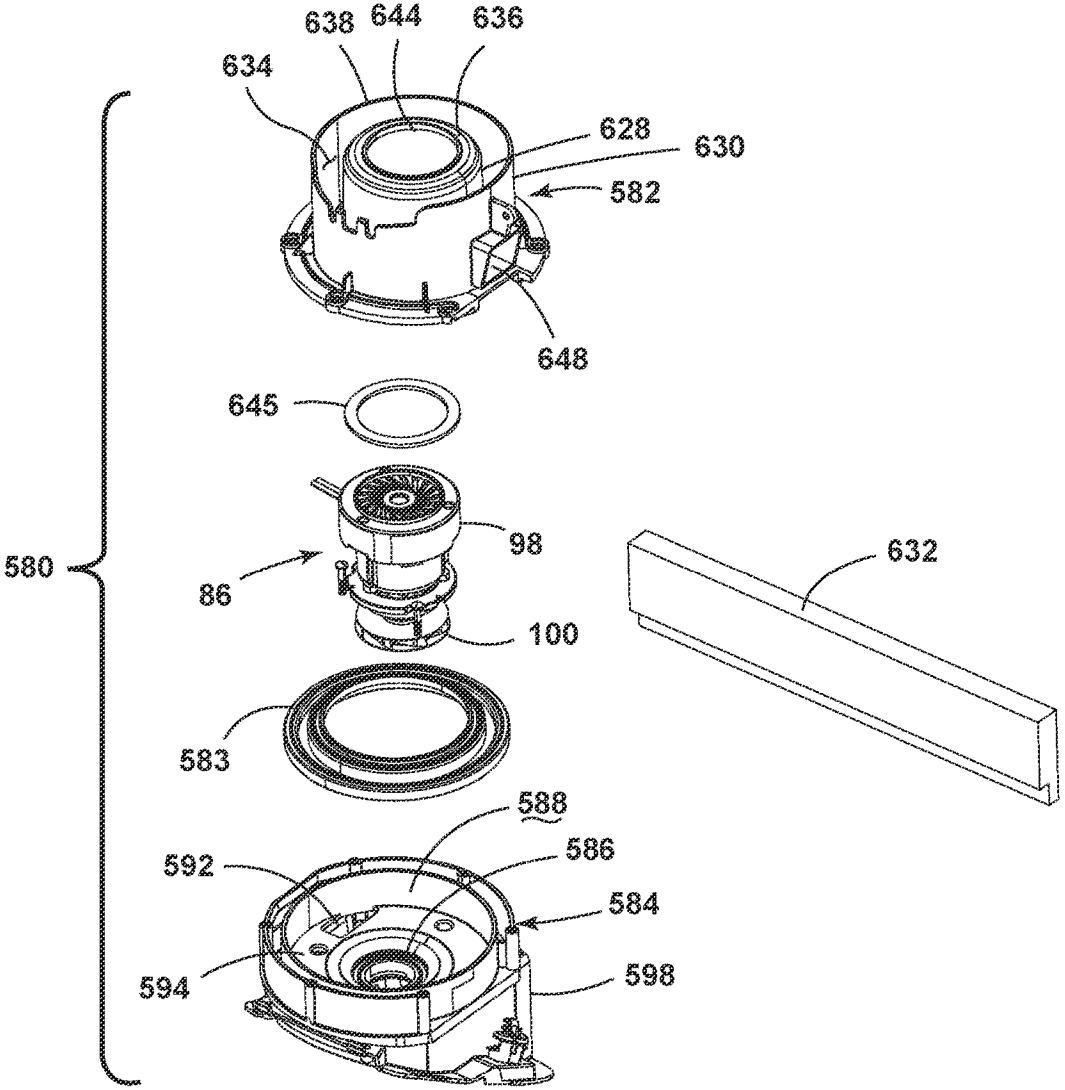
FIG. 40 is an exploded view of the enclosure and suction source from FIG. 39.
Figure 41:
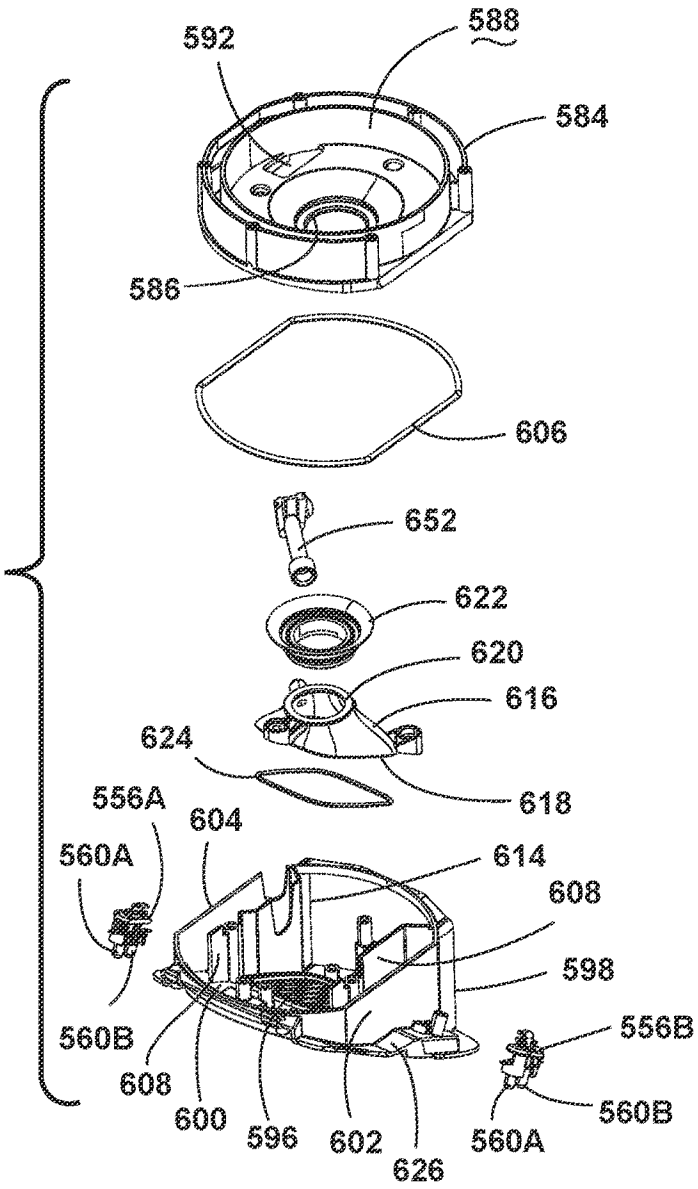
FIG. 41 is an exploded view of a fan housing and muffler of the enclosure from FIG. 39.

Referring additionally to FIG. 40, in one embodiment, the suction source 86 is arranged within an enclosure 580 that reduces the noise generated by the exhaust air flow in the apparatus 10 and/or that reduces the noise due to mechanical vibrations of the motor. The enclosure 580 includes a motor housing 582 and a fan housing 584. The vacuum motor 98 is enclosed within the motor housing 582 and the fan 100 is enclosed within the fan housing 584. The housings 582, 584 can each be made of one or more separate pieces that are connected together, or can be integrally formed. In embodiments where the housings 582, 584 are separate pieces, as shown herein, a seal 583, can be positioned between the housings 582, 584 to provide a fluid-tight joint therebetween.

The fan housing 584 includes at least one air inlet 586 for drawing working air into a fan chamber 588 defined by the fan housing 584 in which the fan 100 is disposed. The inlet 586 can be generally aligned with a central region of the fan 100 and can specifically be centered on an axis 590 of the motor 98. The fan housing 584 further includes at least one air outlet 592 through which air is driven from the chamber 588 by the fan 100.

The fan chamber 588 can be generally circular as shown, and a plurality of air outlets 592 can be disposed at a periphery of the chamber 588. In the illustrated embodiment, two diametrically-opposed outlets 592 are disposed on a bottom wall 594 of the fan housing 584. Other arrangement for air outlets in the fan housing 584 are possible.

The enclosure 580 can include an inlet through which working air can enter the enclosure 580. In one embodiment, the enclosure inlet is formed by a grille 596 in register with the fan inlet 586 and configured for fluid communication with the air outlet 516 of the recovery tank 22. In one embodiment, the outlet side of the filter assembly 522 can be generally aligned with the grill 596, such that air passes from the filter assembly 522 into the enclosure 580. Other configurations for the enclosure inlet are possible.

The enclosure 580 can comprise a muffler 598 that reduces the noise associated with operation of the apparatus 10, and can particularly muffle the noise generated by the exhaust air flow from the fan 100. The muffler 598 can be made of one or more separate pieces that are connected together, or can be integrally formed. The muffler 598 can be disposed internally to the upright body 12, and more specifically can be disposed between housings forming the frame 18, to further reduce noise from the vacuum motor 98.

The muffler 598 can define an air exhaust path, which extends from the fan outlet aperture 592 to the clean air outlet or exhaust vents 88. The muffler 598 can be attached to the fan housing 584, or otherwise positioned to accept exhaust air flow from the fan outlets 592.

The muffler 598 can have a base wall 600 and a peripheral wall 602 extending from the base wall 602. An upper edge 604 of the peripheral wall 602 can mate with, or otherwise be joined to, the fan housing 584. A seal 606 can be provided between the peripheral wall 602 and the fan housing 584 to provide a fluid-tight joint therebetween. The structure of the muffler 598 can vary, but preferably forms a closed path for guiding exhaust air from the fan housing 584 to the exhaust vent 88.

Referring to FIG. 42, in one embodiment, the muffler 598 can have a tortuous channel structure to guide exhaust air in a tortuous path that extends from the fan outlet 592 to the exhaust vents 88. The tortuous exhaust path can comprise multiple turns of at least 90 degrees, and can optionally include at least one turn of greater than 90 degrees, for example 180 degrees or greater. For example, the muffler 598 can include a channel structure with at least one louver or baffle 608 to force the exhaust air to turn by an angle of 180 degrees or more. In the embodiment shown, a 90-degree turn is provided into the muffler 598 at the fan outlet 592, and a 180-degree turn is provided at the baffle 608 separating sections 610, 612 of the muffler 598. The sections 610, 612 of the muffler 598 separated by the baffle 608 can run parallel, or substantially parallel, to each other, which increases the length of the exhaust path to further reduces noise at the exhaust vents 88. The turning of the exhaust air in the muffler 598 has the advantage that the noise from the airflow exiting the enclosure 580 may be reduced due to internal reflections of sound waves that lead to the absorption of energy in the sound waves.

The first section 610 of the muffler 598, which can be an outer section, is in fluid communication with the fan outlet 592 and can thereby form a muffler inlet section. The second section 612 of the muffler 598 can be in fluid communication with a muffler outlet opening 614 through which exhaust air can exit the enclosure 580. The second section 612 of the muffler 598 is divided from the first section 610 by the baffle 608 and can be disposed inwardly of the first section 610. In the embodiment shown, the muffler 598 includes one outlet opening 614 that is wide enough to fit around both exhaust vents 88. Therefore, the two tortuous paths through the muffler 598 merge at their respective inner sections 612 for exhaust air to exit via a common outlet opening 614. In another embodiment, the two tortuous paths can remain separate, with an outlet opening 614 provided for and in fluid communication with each of the exhaust vents 88.

To provide a compact enclosure 580, the air flowing from the recovery tank 22 to the fan chamber 588 can pass through, but be fluidly isolated from, the muffler 598. In one embodiment, a motor inlet conduit 616 can pass interiorly through the muffler 598 and can have a first end 618 coupled to the grille 596 and a second end 620 coupled to the fan inlet 586. A cushioning member, such as a gasket 622, can be positioned between the second end 620 of the conduit 616 and the fan inlet 586, and can dampen vibration between these components.

The grille 596, forming an inlet through which working air can enter the enclosure 580, can be formed, attached, or otherwise provided in the base wall 600 of the muffler 598, with the inlet conduit 616 joined to the grille 596 to isolate the air flowing into the enclosure 580 through the grille 596 from the exhaust air exiting the enclosure 580 via the muffler 598. An underside of the base wall 600 can form the ceiling 519 (FIG. 36) of the recovery tank receiver 418, with the grille 596 disposed in the ceiling 519. A seal 624 can be provided around the grill 596 at the first end 618 of the conduit 616 to seal the interface between the conduit 616 and the grille 596.

With the muffler 598 including the inlet grill 596 that is aligned with the recovery tank 22, the electrical contacts 556A, 556B for detecting the presence and/or liquid level of the recovery tank 22 can be integrated with the muffler 598 as well. The electrical contacts 556A, 556B can be provided on the base wall 600 of the muffler 598, for example on supports 626 that extend outwardly from the peripheral wall 602 of the muffler 598 to position the electrical contacts 556A, 556B outside the working air and exhaust flows.

The motor housing 582 of the enclosure 580 can have a double-wall structure 628, 630 that reduces the noise associated with operation of the apparatus 10, and can particularly muffle the noise generated by the operation of the motor 98. As noted above, the motor 98 may include a brushless DC motor that, while quieter than brushed motors, does not require a post motor filter and therefore does not benefit from the noise absorbing properties of standard post motor filters. In the embodiment of the apparatus 10 illustrated herein, the recovery system lacks a post motor filter, i.e. there is no filter positioned in the air flow path downstream of the suction source 86. The double-wall structure can reduce the operational noise of the 10. The double-wall structure can further accommodate a sound attenuating element 632, described in further detail below, which can absorb sound.

In one embodiment, the double-wall motor housing 582 includes a pair of spaced walls 628, 630 extending circumferentially around the motor 98, including an inner wall 628 and outer wall 630 spaced radially from the inner wall 628, with respect to motor axis 590. The walls 628, 630 are radially spaced apart to define an annular space or gap 634 therebetween. The walls 628, 630 can generally be concentric, thereby defining a gap 634 of a substantially constant width about the periphery of the motor 98, and can extend longitudinally along the motor axis 590.

The inner wall 628 can be joined with an upper wall 636 of the motor housing 582 that encloses the motor 98. The outer wall 630 can have a free upper edge 638, i.e. not joined with or enclosed by a wall, so that the annular gap 634 between the walls 628, 630 is open at an upper end of the motor housing 582 for easy installation of the sound attenuating element 632.

The sound attenuating element 632 can be mounted intermediate to the walls 628, 630 of the double-walled motor housing 582. The sound attenuating element 632 can be formed out of a material that can absorb sound and can preferably be lightweight. In one embodiment, the sound attenuating element 632 can be formed out of an open-cell foam such as polyurethane.

The sound attenuating element 632 can fill, or substantially fill, the annular gap 634 between the walls 628, 630. For example, the sound attenuating element 632 can extend around the majority of the annular gap 634 to substantially fill the gap 634. The sound attenuating element 632 can accordingly be a ring-shaped element or a substantially ring-shaped element (e.g. a C-shaped element). In one embodiment, the sound attenuating element 632 can be provided as an elongated rectilinear material that inserted into the annular gap 634 defined between the walls 628, 630 of the double-walled motor housing 582, thereby wrapping around the periphery of the motor 98. In some embodiments, the length of the elongated rectilinear material can be generally equal to the circumference of the gap 634 such that the ends of the elongated rectilinear material can meet when inserted into the annular gap 634. In other embodiments, a small space may exist between the ends of the elongated rectilinear material when inserted into the gap 634. In yet other embodiments, the sound attenuating element 632 can comprise multiple sections of material that are individually inserted into the gap 634.

It is noted that while the embodiment of the enclosure 580 shown in the figures includes multiple features that reduce noise generated by the exhaust air flow and/or due to mechanical vibrations, other configurations for the enclosure 580 are possible, including, for example, configurations where the enclosure 580 includes the muffler 598 and not the double-wall structure 628, 630, configurations where the enclosure 580 includes the double-wall structure 628, 630 and not the muffler 598, and configurations where the enclosure 580 includes the double-wall structure 628, 630 and not the sound attenuating element 632. The noise reduction features of the muffler 598, the double-wall structure 628, 630, and the sound attenuating element 632 may be combined in any combination. Any one of the noise reduction features of the enclosure 580 disclosed herein reduces operational noise associated with the apparatus 10, and superior noise reduction may be achieved by providing the enclosure with more than one of the noise reduction features on the enclosure 580.

Referring to FIG. 39, in one embodiment, a vacuum motor cooling air path is provided for supplying cooling air to the vacuum motor 98 and for removing heated cooling air (also referred to herein as "heated air") from the vacuum motor 98. In FIG. 39, the cooling air path is generally indicated by arrows C. The motor cooling air path includes a cooling air inlet 640 and a cooling air outlet 642, both of which are in fluid communication with the ambient air outside the apparatus 10. Ambient air is drawn into the apparatus 10 through the cooling air inlet 640, passes through the vacuum motor 98, and is subsequently exhausted through the cooling air outlet 642. In the embodiment illustrated, the cooling air inlet 640 is defined by an inlet vent on one side of the frame 18 and the cooling air outlet 642 is defined by an outlet vent on an opposing side of the frame 18.

The suction source 86 includes at least one inlet aperture 644 for allowing cooling air to enter and pass by the vacuum motor 98. The inlet aperture 644 can be alighted with an opening through the upper wall 636 of the motor housing 582, and can be surrounded by the sound attenuating element 632 and double wall structure 628, 630. The inlet aperture 644 is in fluid communication with the cooling air inlet 640, such as via an at least one cooling air inlet duct 646. The cooling air inlet duct 646 can be formed internally within the upright body 12, and more specifically can be formed by housings forming the frame 18. A seal 645 can be provided between the motor 98 and the upper wall 636 to seal the interface between the motor inlet aperture 644 and the motor housing 582.

The motor housing 582 also includes at least one outlet aperture through which heated cooling air is exhausted The outlet aperture can be defined by an exhaust port 648 which extends through the double-wall structure 628, 630 of the motor housing 582 for allowing heated air to be transported away from the vacuum motor 98. The exhaust port 648 is in fluid communication with the cooling air outlet 642, such as via an at least one heated air exhaust duct 650. The heated air exhaust duct 650 can be formed internally within the upright body 12, and more specifically can be formed by housings forming the frame 18. Routing the heated air exhaust internally within the frame 18 reduces noise from the vacuum motor 98.

Optionally, the motor cooling air path can have a tortuous exhaust path that extends from the motor exhaust port 648 to the outlet vent 642. The motor and airflow noise generated by the apparatus 10 during operation is dampened by the torturous exhaust path. The tortuous exhaust path can comprise multiple turns of at least 90 degrees. In the embodiment shown, exhaust air must turn approximately 90 degrees to enter the exhaust duct 650 from the exhaust port 648, and must turn approximately 90 degrees again to exist the exhaust duct 650 via the outlet vent 642.

In one embodiment, a brush motor cooling air path is provided for supplying cooling air to the brush motor 182 (FIG. 9) and for removing heated cooling air (also referred to herein as "heated air") from the brush motor 182. The brush motor cooling air path can be defined by at least the conduit 176, described above, for allowing heated air to be transported away from the brush motor 182, with the a first end of the conduit 176 in fluid communication with the brush motor 182 and a second end of the conduit 176 in fluid communication with the inlet conduit 616. From the inlet conduit 616, the heated air from the brush motor 182 can join the working air flow path through the enclosure 580, indicated by arrows W in FIG. 39.

In the embodiment shown, a connector tubing 652 for the conduit 176 can extend from a side of the inlet conduit 616 and through the muffler 598 to connect with the conduit 176. The conduit 176 can, as described above, extend through the joint assembly 94, and through the chase 168, and exit the chase 168 at an upper end thereof to connect with the tubing 652.

Returning to FIG. 2, as briefly mentioned above, the controller 42 is operably coupled with the various functional systems, such as the fluid delivery and recovery systems, of the apparatus 10 for controlling its operation. In the embodiment shown, the controller 42 is operably coupled with at least the vacuum motor 98, the pump 180, and the brush motor 182. The controller 42 is also operably coupled with the base PCB 336, light source 318, the brush motor switch 260, and the headlight power switch 382. The controller is also operably coupled to one or more sensing components, such as the conductivity sensor 498 for the supply tank sensing system 502 (FIG. 32) and the electrical contacts 556A, 556B for the recovery tank liquid level sensing system 550 (FIG. 37). The controller 42 is also operably coupled to one or more user input components, such as the user interfaces 30, 32 and associated components, including the hand grip PCB 37 in register with the power input control 34 and cleaning mode input control 36 (FIG. 1), the display 38, and the self-cleaning mode input control 40. Electrical components of the surface cleaning apparatus 10, including the vacuum motor 98, the pump 180, the brush motor 182, and the headlight light source 318 can be powered by the battery 45.

As discussed above, the power input control 34 which controls the supply of power to one or more electrical components of the apparatus 10, and in the illustrated embodiment controls the supply of power to at least the UI 32, the vacuum motor 98, the pump 180, and the brush motor 182. The cleaning mode input control 36 cycles the apparatus 10 between a hard floor cleaning mode, an area rug cleaning mode, and an intense cleaning or "booster" mode.

In one example of the hard floor cleaning mode, vacuum motor 98, the pump 180, and the brush motor 182 are activated, with the with the vacuum motor 98 operating at a first power level and the pump 180 operating at a first flow rate. Both rates can be "low" to provide maximum run time, where run time is the total operation time of the apparatus 10 on a fully-charged battery.

In one example of the area rug cleaning mode, the vacuum motor 98, the pump 180, and the brush motor 182 are activated, with the with the vacuum motor 98 operating at a second power level and the pump 180 operating at a second flow rate. As in the hard floor mode, the second flow rate can be "low." However, the second power level is higher than the first power level rate to increase the amount of suction applied for cleaning an area rug or carpet. Such increased suction may decrease the run time in comparison to the hard floor cleaning mode.

In one example of the intense cleaning or "booster" mode, the vacuum motor 98, the pump 180, and the brush motor 182 are activated, with the with the vacuum motor 98 operating at a third power level and the pump 180 operating at a third flow rate. Both rates can be "high" to deliver high suction and high flow to a surface to be cleaned for a more intense cleaning operation. The third flow rate is higher than the first or second flow rates to increase the amount of cleaning liquid that is released, and the third power level is higher than the first or second power levels rate to increase the amount of suction applied. Such increases may decrease the run time in comparison to the hard floor cleaning mode and to area rug cleaning mode.

Table 1 below lists some non-limiting examples of cleaning modes for the apparatus 10, including vacuum motor power levels, pump flow rates, and average run times for each mode. Other power levels and flow rates for the cleaning modes are possible, with other resulting average run times. It is noted that the flow rates for the hard floor and area rug cleaning modes may be the approximately the same or may differ, but are both considered "low" in comparison to the intense cleaning mode. The second power level for the area rug cleaning mode can be quantified as a "medium" level in comparison to the hard floor and intense cleaning modes. It is further noted that average run time can be affected by other factors, such as battery capacity and apparatus weight, and that different average run times may accordingly be achieved, even with the listed vacuum motor power levels and pump flow rates.

TABLE 1

| Cleaning Mode | Vacuum Motor | Power Level | Pump | Flow Rate | Brush Motor | Avg. Run Time |
|---|---|---|---|---|---|---|
| Hard Floor | LOW | 100 W | LOW | 125 ml/min | ON | 30 min |
| Area Rug | MEDIUM | 120 W | LOW | 125 ml/min | ON | 28-30 min |
| Intense/Booster | HIGH | 140 W | HIGH | 150/min | ON | 20-25 in |

The self-cleaning mode input control 40 initiates a self-cleaning mode of operation, one embodiment of which is described in detail below. Briefly, during the self-cleaning mode, a cleanout cycle can run in which cleaning liquid is sprayed on the brushroll 90 while the brushroll 90 rotates. Liquid is extracted and deposited into the recovery tank 22, thereby also flushing out a portion of the recovery pathway.

Figure 43:
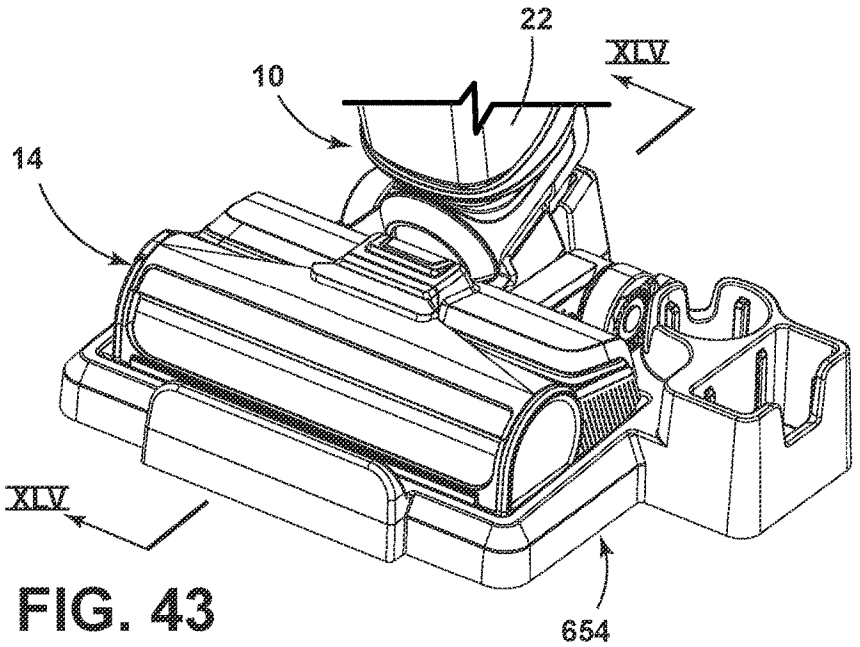
FIG. 43 is an enlarged perspective view of the apparatus docked with a storage tray according to one embodiment of the disclosure.

Referring to FIG. 43, the surface cleaning apparatus 10 can optionally be provided with a storage tray 654 that can be used when storing the apparatus 10. The tray 654 can physically support the entire apparatus 10. More specifically, the base 14 can be seated in the tray 654. The storage tray 654 can further be configured for further functionality beyond simple storage, such as for charging the apparatus 10 and/or for self-cleaning of the apparatus 10. In such cases, the storage tray 654 is also referred to as a docking station.

Figure 44:
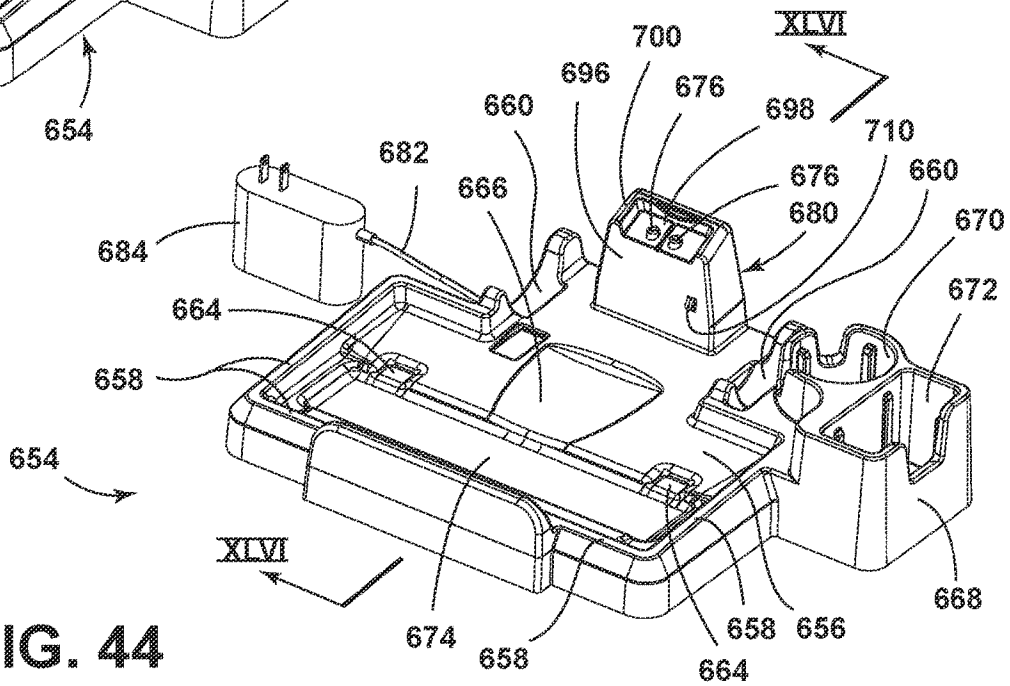
FIG. 44 is a perspective view of the storage tray from FIG. 43.

FIG. 44 is a perspective view of the storage tray 654. The tray 654 can include a tray base 656 and guide walls 658 extending upwardly from the tray base 656 that help to align the base 14 within the tray 654. A rear portion of the tray 654 can comprise rear wheel holders 660 for receiving the rear wheels 106 of the apparatus 10. The rear wheel holders 660 can be formed as arc-shaped members on the storage tray 654, and can be provided on opposite lateral sides of a charging unit 680, described in further detail below. The tray base 656 can include front wheel locators 664 for the front wheels 108 of the apparatus and a joint locator 666 for the joint assembly 94. The locators 664, 666 can be formed as recesses or grooves in the tray base 656 sized to at least partially receive the wheels 108 and joint assembly 94, respectively, to help to properly align the base 14 on the tray 654.

Optionally the storage tray 654 can include an accessory holder 668 for storing one or more accessories for the apparatus 10. The illustrated accessory holder 668 can removably receive the brushroll 90 and the filter assembly 522 for the purposes of storage and/or drying. Accessory holder 668 can comprise a brushroll slot 670 to securely receive the brushroll 90 in a vertical position for drying and storage and a filter slot 672 to securely receive the filter assembly 522 in a vertical position for drying and storage. Alternatively, accessory holder 668 can store the brushroll 90 and filter assembly 522 in a variety of other positions.

Figure 45:
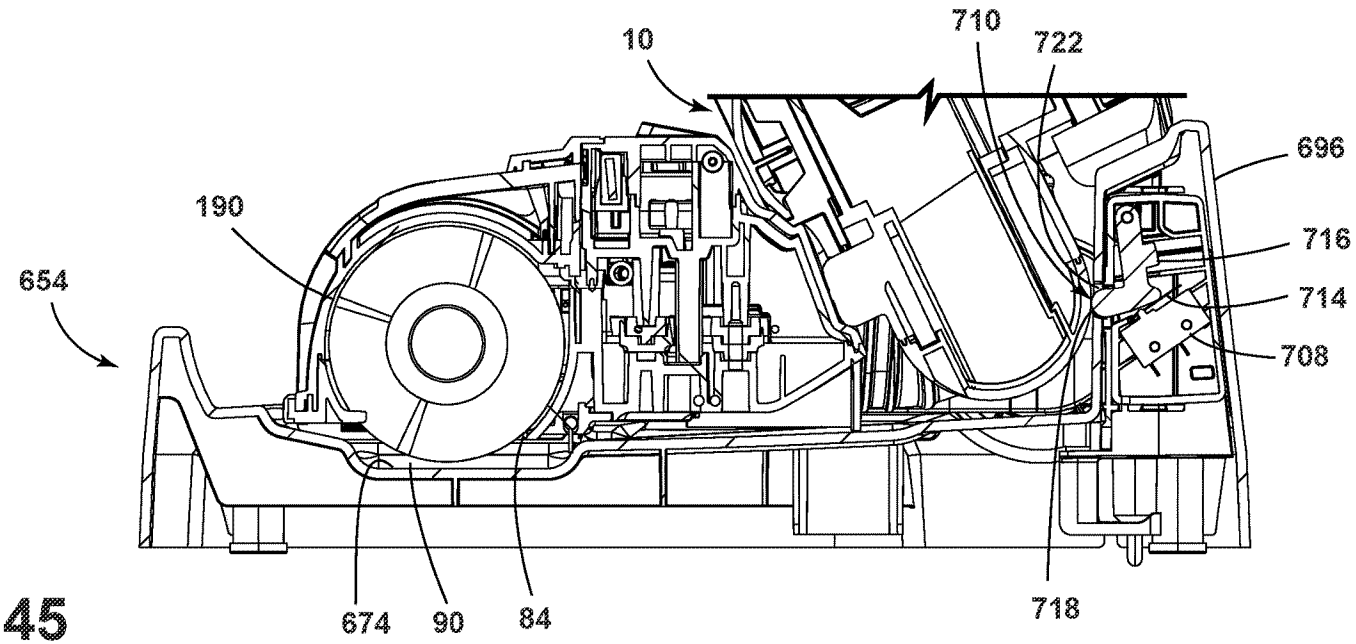
FIG. 45 is a cross-sectional view taken through line XLV-XLV of FIG. 43.

Referring additionally to FIG. 45, during use, the apparatus 10 can get very dirty, particularly in the brush chamber 190 and extraction pathway, and can be difficult for the user to clean. The storage tray 654 can function as a cleaning tray during a self-cleaning mode of the apparatus 10, which can be used to clean the brushroll 90 and internal components of the recovery pathway of apparatus 10. Self-cleaning using the storage tray 654 can save the user considerable time and may lead to more frequent use of the apparatus 10.

The storage tray 654 can optionally be adapted to contain a liquid for the purposes of cleaning the interior parts of apparatus 10 and/or receiving liquid that may leak from the apparatus 10 when not in active operation. The tray 654 can have a recessed portion in the form of a sump 674 in register with at least one of the suction nozzle 84 or brushroll 90. Optionally, the sump 674 can sealingly receive the suction nozzle 84 and brushroll 90, such as by sealingly receiving the brush chamber 190. The sump 674 can fluidly isolate, or seal, the suction nozzle 84 and distributor 178 (FIG. 9) within the brush chamber 190 to create a closed loop between the fluid delivery and recovery systems of the apparatus 10. The sump 674 can collect excess liquid for eventual extraction by the suction nozzle 84. This also serves to flush out a recovery pathway between the suction nozzle 84 and the recovery tank 22 during self-cleaning.

When operation has ceased, the apparatus 10 can be locked upright and placed into the storage tray 654 for cleaning, for example as shown in FIGS. 43 and 45. The apparatus 10 can be prepared for self-cleaning by ensuring that the supply tank 20 contains a sufficient amount of cleaning liquid, such as water. The user can select the self-cleaning mode via the self-cleaning mode input control 40 (FIG. 1). In one example, during the self-cleaning mode, the vacuum motor 98, pump 180, and brush motor 182 (FIG. 2) are activated in a predetermined sequence. Liquid is dispensed to the brushroll 90, at least some of which collects in the sump 674, the brushroll 90 is rotated, and liquid and debris are drawn off the brushroll 90 and out of the storage tray 654 into the recovery pathway for collection in the recovery tank 22. During the cleanout cycle, the vacuum motor 98, pump 180, and brush motor 182 can be active individually or simultaneously, and for any predetermined times, including overlapping and non-overlapping times. For example, the vacuum motor 98, pump 180, and brush motor 182 can be activated at once. In other example, the pump 180 and brush motor can be activated for a first predetermined period, and the vacuum motor 98 activated after. Other sequences are possible. The self-cleaning mode can be configured to last for a predetermined amount of time or until the cleaning liquid in the supply tank 20 has been depleted.

Referring to FIGS. 2 and 44, in the illustration embodiment, the storage tray 654 functions as a docking station for recharging the battery 45 of the apparatus 10. The storage tray 654 can have pair of charging contacts 676, and at least one corresponding pair of charging contacts 678 can be provided on the apparatus 10. In the embodiment shown, the tray charging contacts 676 on are a rear side of the tray 654, and the apparatus charging contacts 678 are positioned to automatically engage with the tray charging contacts 676 when the apparatus is docked with the tray 654. Other locations for the charging contacts 676, 678 on the tray 654 and apparatus 10 are possible. When operation has ceased, the apparatus 10 can be locked upright and placed into the storage tray 654 for recharging the battery 45, and the charging contacts 676, 678 automatically engage to begin recharging.

The charging contacts 676, 678 may each be fixed or compliant. In the embodiment shown, the apparatus charging contacts 678 are fixed and the tray charging contacts 676 are compliant.

A charging unit 680 is provided on the storage tray 654 and comprises the charging contacts 676. The charging unit 680 can electrically couple with the battery 45 when the base 14 of the apparatus 10 is docked with the storage tray 654. The charging unit 680 can be electrically coupled to a power source including, but not limited to, a household power outlet. In one example, a power cord 682 can be coupled with the charging unit 680 to connect the storage tray 654 to the power source, and can, for example include a wall charger 684 at one end thereof for connection to a household power outlet and a DC connector 686 (FIG. 2) at the other end thereof for connection to a DC jack 688 of the charging unit 680. Other types of power connectors are possible.

Referring to FIG. 6, the apparatus charging contacts 678 can be provided on a lower rear side of the apparatus 10. In one embodiment, the apparatus charging contacts 678 can be integrated with the joint assembly 94. The charging contacts can be disposed rearwardly of the barrels 120, 122, such as on a lower end 690 of the rear cover 146. Electrical wiring 692 connected to the charging contacts 678 can extend upwardly within the rear cover 146 and can enter the chase 168 through an opening 694 at a lower end thereof, and can be electrically coupled with the battery 45 (FIG. 2) to supply electricity thereto.

The joint assembly 94 and the charging unit 680 of the storage tray 654 can possess complementary shapes, with the lower end 690 of the rear cover 146 fitting against the charging unit 680 to help support the apparatus 10 on the storage tray 654. In the illustrated embodiment, the lower end 690 of the rear cover 146 can just downwardly and/or outwardly to space the charging contacts 678 away from the rear wheels 106.

Referring to FIG. 44, the tray 654 can include an upstanding tower 696 forming a cover for the charging unit 680. The tower 696 can be molded with, or otherwise joined to, the tray 654. The tower 696 can have a socket 698 at an upper end 700 thereof containing the charging contacts 676. Within the socket 698, the charging contacts 676 are recessed with respect to the upper end 700 of the tower 696 to protect the charging contacts 676. The lower end 690 of the apparatus 10 can be at least partially received by the socket 698 when the apparatus 10 is docked with the tray 654.

The tower 696 extends upwardly from the tray base 656 and can have a height larger than at least one of its lateral dimensions (e.g., width or depth). The tower 696 can be generally perpendicular to the ground surface on which the tray 654 rests to provide a backstop against which the apparatus 10 is seated to prevent the apparatus 10 from tipping backward off the tray 654, but may have a slight backwards or forwards angle. The tower 696 can comprise an angled upper end 700 to complement the rear side of the apparatus 10 that meets the tower 696 when docked with the tray 654. Other shapes for the tower 696 are possible, including a shape that is low in proportion to its lateral dimensions, and shapes that are complementary or non-complementary to the portion of the apparatus 10 that meets the tower 696 when docked.

Figure 47:
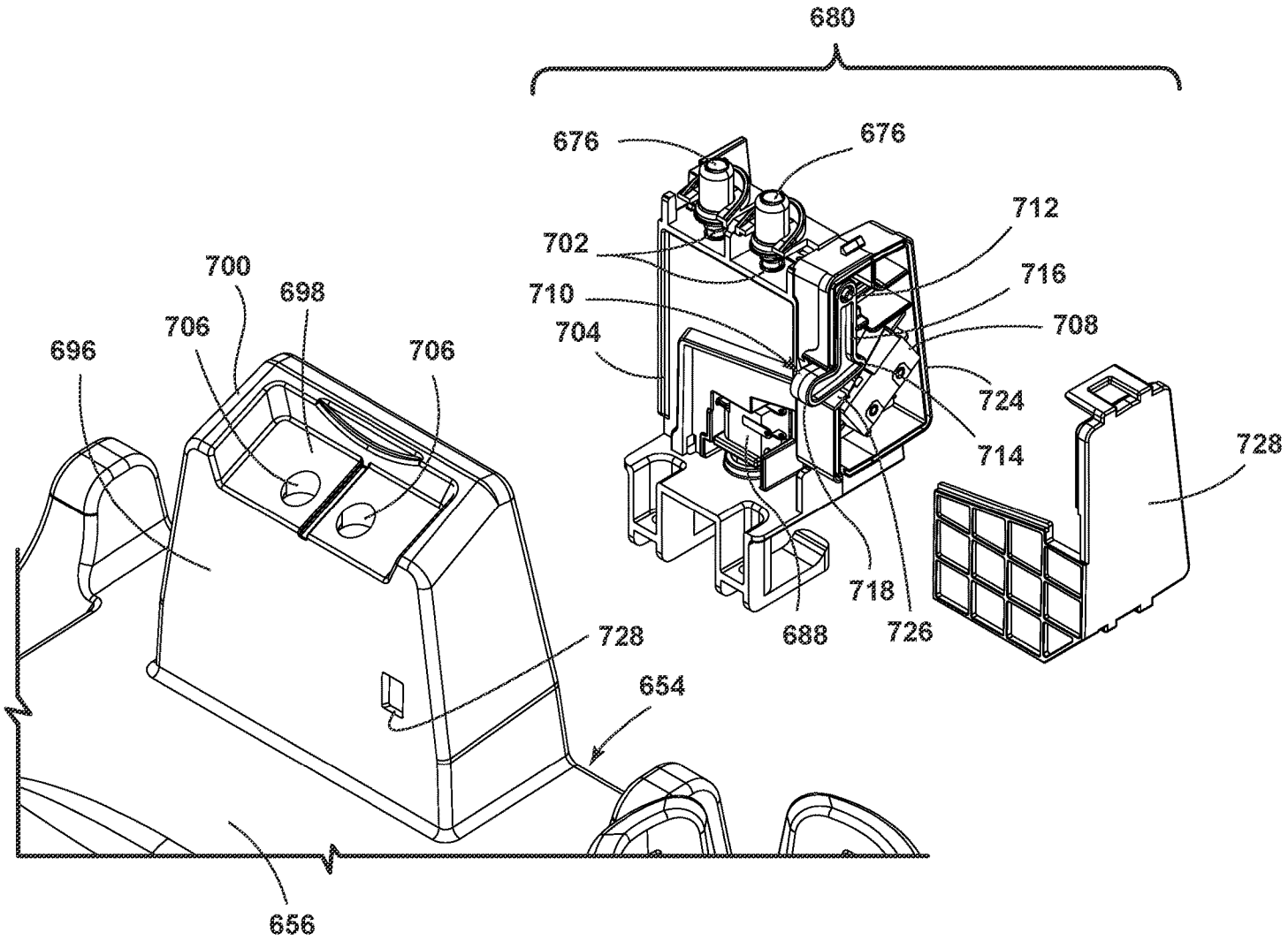
FIG. 47 is an exploded view of the storage tray, showing a charging unit and apparatus sensing mechanism.

Referring to FIG. 47, the tray charging contacts 676 can be biased by springs 702 to a neutral position, one example of which is shown in FIG. 44, which can correspond to a condition in which the apparatus 10 is not docked with the tray 654. A bracket 704 can support the contacts 676 within the tower 696 and in alignment with the springs 702. Other elements for resiliently-mounting the charging contacts 676 are possible. By virtue of the compliant or resilient mounting, the charging contacts 676 are urged outwardly away from the tower 696 so that the charging contacts 676 protrude through openings 706 provided in the socket 698. A force applied to the charging contacts 676, i.e. the docking of the apparatus 10 with the tray 654, causes the charging contacts 678 to recede into the socket 698 and move to a contact position, which can establish a positive electrical contact between the apparatus charging contacts 678 and the tray charging contacts 676.

In the neutral position, the charging contacts 676 may protrude slightly within the socket 698, and may be recessed within the tower 696, depending on the mounting within the tower 696 and the biasing force of the springs 702. In the contact position, the charging contacts 676 recede relative to the tower 696 in comparison to the neutral position, but may still slightly protrude within the socket 698 or may be flush with the bottom of the socket 698, depending on the neutral position and the compression of the charging contacts 676.

In some embodiments, the storage tray 654 can include an apparatus sensing mechanism. By detecting whether the apparatus 10 is seated on the storage tray 654, for example, power to the tray charging contacts 676 can accordingly be turned on or off.

The apparatus sensing mechanism can be integrated with the charging unit 680, such that electrical power is supplied to the tray charging contacts 676 only when the apparatus 10 is docked. The apparatus sensing mechanism can include or be operably coupled with an activating switch 708 that controls the supply of power to the charging contacts 676. The activating switch 708 is operable to open and close, and when the activating switch 708 is closed, power is applied to the charging contacts 676. The activating switch 708 can normally be open, i.e. when the apparatus 10 is not docked with the tray 654, so that no power is supplied to the tray charging contacts 676. The activating switch 708 is configured to be actuated, i.e. close, when the apparatus 10 docks with the tray 654.

The apparatus sensing mechanism can include various components for detecting when the apparatus 10 is docked and closing the activating switch 708. In one embodiment, the apparatus sensing mechanism can include a mechanical sensing component, such as a moveable actuator 710, provided on the tray 654. When the apparatus 10 is docked (see FIG. 45), the actuator 710 is forced to move and the activating switch 708 is closed. In the absence of the apparatus 10 (see FIG. 46), the activating switch 708 is open, such that power cannot be supplied to the tray charging contacts 676.

Figure 46:
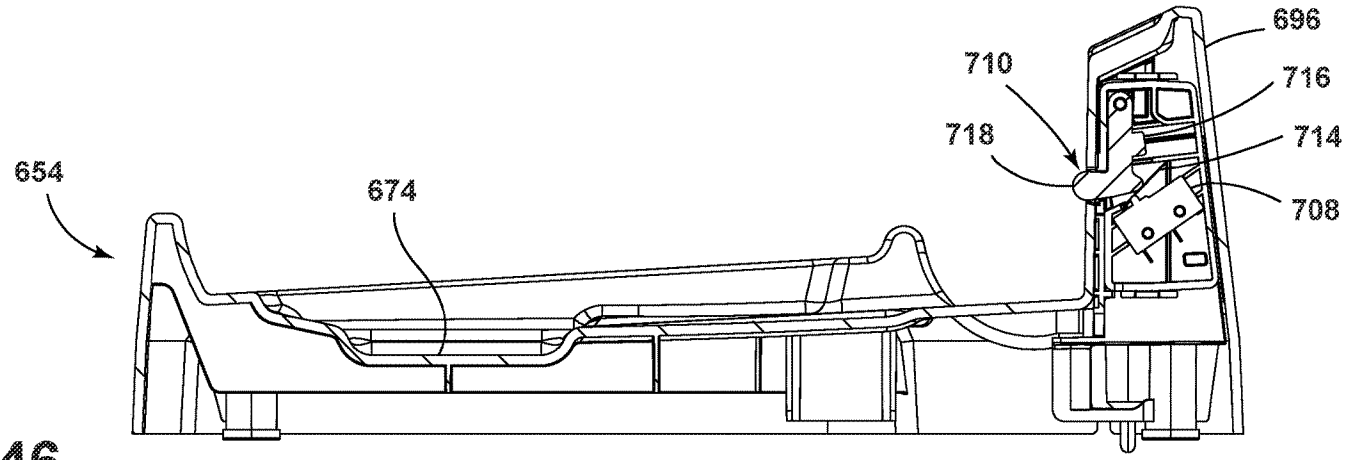
FIG. 46 is a cross-sectional view taken through line XLVI-XLVI of FIG. 44.

The actuator 710 is operable to move between an off position, an example of which is shown in FIG. 46, in which the actuator 710 is disengaged from the switch 708, and an on position, an example of which is shown in FIG. 45, in which the actuator 710 is engaged with the switch 708 to close the switch 708. In one embodiment, the actuator 710 can be pivotally supported by the bracket 704, such as by being mounted on a post 712 of the bracket 704, for movement between the on and off positions Other suitable mounting arrangements that permit the actuator 710 to move into and out of engagement with the activating switch 708 are possible.

The switch actuator 710 can include a contact end 714 in register with the switch 708. The contact end 714 can be carried by a pivot arm 716, which is coupled to the post 712 or otherwise pivotally mounted to the bracket 704. A cam end 718 on the switch actuator 710 is configured for engagement by the apparatus 10, when present. The cam end 718 can also be carried by the pivot arm 716 and can be disposed generally opposite the contact end 714.

A rearward and lower side of the apparatus 10 includes a cam actuator 722. The cam actuator 722 can, for example, be provided by the rearward and lower side of the apparatus 10 itself, as shown in FIG. 45. Other configurations for the cam actuator 722 on the apparatus 10 are possible. For example, the cam actuator 722 can be an outwardly extending projection on the rearward and lower side of the apparatus 10.

As the apparatus 10 is docked with the tray 654, the cam actuator 722 engages the projecting cam end 718 of the actuator 710, thereby pivoting the actuator 710 counterclockwise as viewed in FIG. 45. This action causes the contact end 714 to move and engage the activating switch 708 to thereby power the charging contacts 676.

It is noted that while a cammed actuator 710 is shown, the tray 654 can include any suitable mechanical or non-mechanical sensing component configurable to provide input to actuate the switch 708 upon docking of the apparatus 10. For example, in other embodiments, the sensing component can be an optical switch that is occluded by the apparatus 10 when docked to indicate that the apparatus 10 is present on the tray 654, a Hall Effect sensor, or a reed switch for example. The apparatus 10 is likewise suitably configured to be detected by any of these sensing components.

The switch 708 and switch actuator 710 can be enclosed within a switch housing 724 that includes an opening 726 through which the cam end 718 of the actuator 710 projects. The tower 696 includes a corresponding opening 728, and the openings 726, 728 are aligned with each other when the charging unit 680 is mounted within the tower 696 for projection of the cam end 718 on the actuator 710 to an exterior of the tray 654, e.g. to a position where the actuator 710 can be engaged by the apparatus 10 when docked.

The bracket 704 can support one or more components of the charging unit 680. As shown in FIG. 47, the bracket 704 can support the charging contacts 676, the DC jack 688, the activating switch 708, and the actuator 710. In the embodiment shown, the switch housing 724 is integrally formed with the bracket 704, and a cover 730 is mounted to the switch housing 724 to enclose the activating switch 708 and actuator 710. In other embodiments, the switch housing 724 can be separately formed and joined with the bracket 704 using any suitable joining method. The bracket 704 can be attached to the tray 654 using any suitable attachment mechanism, such as by using one or more mechanical fasteners or screws, with the bracket 704 and components supported thereon substantially covered by the tower 696. Other configurations for connecting the components of the charging unit 680 to the tray 654 are possible.

Figure 48:
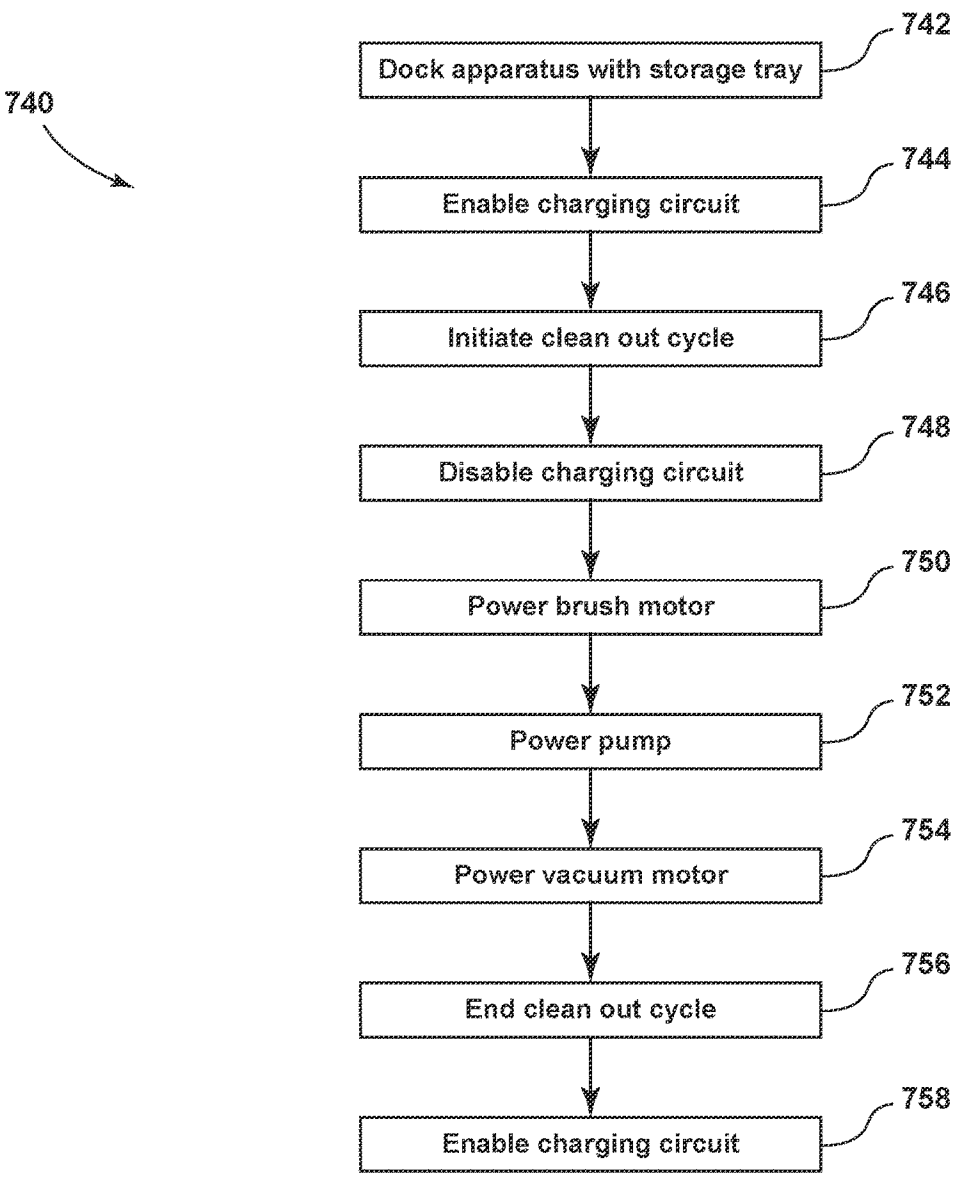
FIG. 48 is a flow chart showing one embodiment of a self-cleaning method for the apparatus.

FIG. 48 depicts one embodiment of a self-cleaning method 740 for the apparatus 10 using the storage tray 654. In use, the apparatus 10 is docked with the storage tray 654 at step 742. The docking may include parking the base 14 on the tray 654 and establishing a closed loop between the fluid delivery and recovery systems of the apparatus 10. For example, the docking can include sealing the brush chamber 190 to establish a sealed cleaning pathway between the distributor 178 and the suction nozzle 84.

At step 744, the battery 45 begins recharging. The apparatus 10 can include a battery monitoring circuit (not shown) for monitoring the status of the battery 45 and a battery charging circuit (not shown) that controls recharging of the battery 45. Feedback from the battery monitoring circuit can be used by the controller 42 to optimize the discharging and recharging process, as well as for displaying battery charge status on the UI 32. When the apparatus 10 is docked with the storage tray 654 and the charging contacts 676, 678 couple, the battery charging circuit is active.

At step 746, the cleanout cycle for the self-cleaning mode of operation is initiated. The controller 42 can initiate the cleanout cycle based on input from the user, such as by the user pressing the self-cleaning mode input control 40 on the UI 32. The self-cleaning cycle may be locked-out by the controller 42 when the apparatus 10 is not docked with the storage tray 654 to prevent inadvertent initiation of the self-cleaning cycle. If the self-cleaning mode input control 40 is pressed when the apparatus 10 is not docked with the tray 654, the self-cleaning cycle does not start.

At step 748, upon initiation of the self-cleaning cycle, such as upon the user pressing the self-cleaning mode input control 40, the battery 45 can stop recharging. During a self-cleaning cycle during which the vacuum motor 98, pump 180, and brush motor 182 may be energized, the required power draw can exceed the operating power of the wall charger 684, and the self-cleaning cycle is powered by the onboard battery 445. The controller 42 can therefore disable or shut off the battery charging circuit, during self-cleaning, i.e. the battery 45 does not recharge during the self-cleaning.

During the self-cleaning cycle, one or more components of the apparatus 10 energize and can be powered by the onboard battery 45. The self-cleaning cycle may begin at step 750 in which the brush motor 182 activates to rotate the brushroll 90. At step 752, the pump 180 activates to deliver cleaning liquid from the supply tank 20 to the distributor 178 that sprays the brushroll 90. The brushroll 90 can rotate while applying cleaning liquid to the brushroll 90 to flush the brush chamber 190 and cleaning lines, and wash debris from the brushroll 90. The self-cleaning cycle may use the same cleaning liquid normally used by the apparatus 10 for surface cleaning, or may use a different detergent focused on cleaning the recovery system of the apparatus 10.

The vacuum motor can be actuated at step 754, during or after steps 750, 752, to extract the liquid via the suction nozzle 84. During extraction, liquid and debris in the tray sump 674 can be sucked through the suction nozzle 84 and the downstream recovery path. The flushing action also cleans the entire recovery path of the apparatus 10, including the suction nozzle 84 and downstream conduits.

While steps 750, 752, 754 are shown as individual steps in FIG. 48, it is noted that the steps 750, 752, 754 may occur individually or simultaneously, and for any predetermined times, including overlapping and non-overlapping times. For example, the vacuum motor 98, pump 180, and brush motor 182 can be activated at once. In other example, the pump 180 and brush motor can be activated for a first predetermined period, and the vacuum motor 98 activated after. Other sequences are possible.

At step 756, the self-cleaning cycle ends. The end of the self-cleaning cycle can be time-dependent, or can continue until the recovery tank 22 is full or the supply tank 20 is empty.

For a timed self-cleaning cycle, the pump 180, brush motor 182, and vacuum motor 98 are energized and de-energized for predetermined periods of time. Optionally, the pump 180 or brush motor 182 can pulse on/off intermittently so that any debris is flushed off of the brushroll 90 and extracted into the recovery tank 22. Optionally, the brushroll 90 can be rotated at slower or faster speeds to facilitate more effective wetting, shedding of debris, and/or spin drying. Near the end of the cycle, the pump 180 can de-energize to end liquid dispensing while the brush motor 182 and vacuum motor 98 can remain energized to continue extraction. This is to ensure that any liquid remaining in the sump 674, on the brushroll 90, or in the recovery path is completely extracted into the recovery tank 22.

After the end of the self-cleaning cycle, the battery 45 can resume recharging at step 758. The charging circuit can be enabled to continue to recharging the battery 45.

Figure 49:
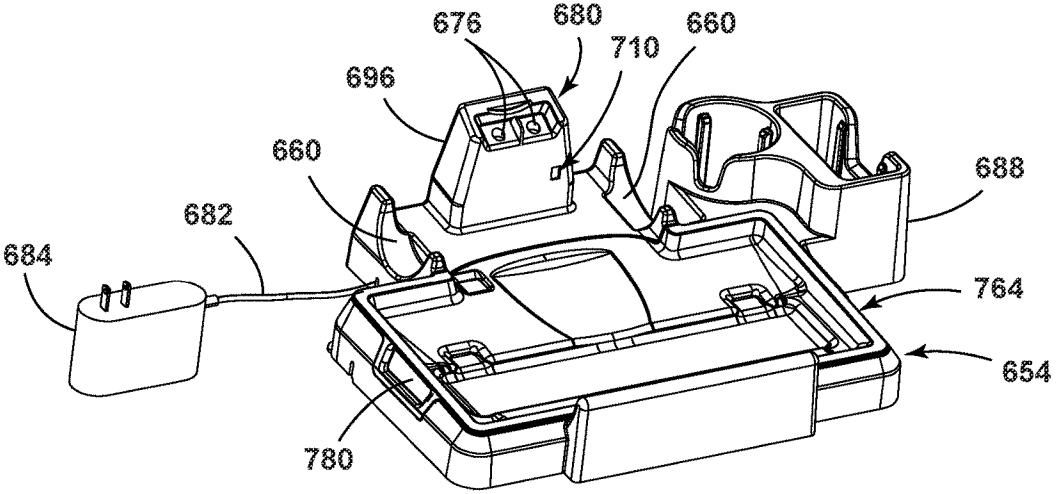
FIG. 49 is a perspective view of another embodiment of a storage tray.
Figure 50:
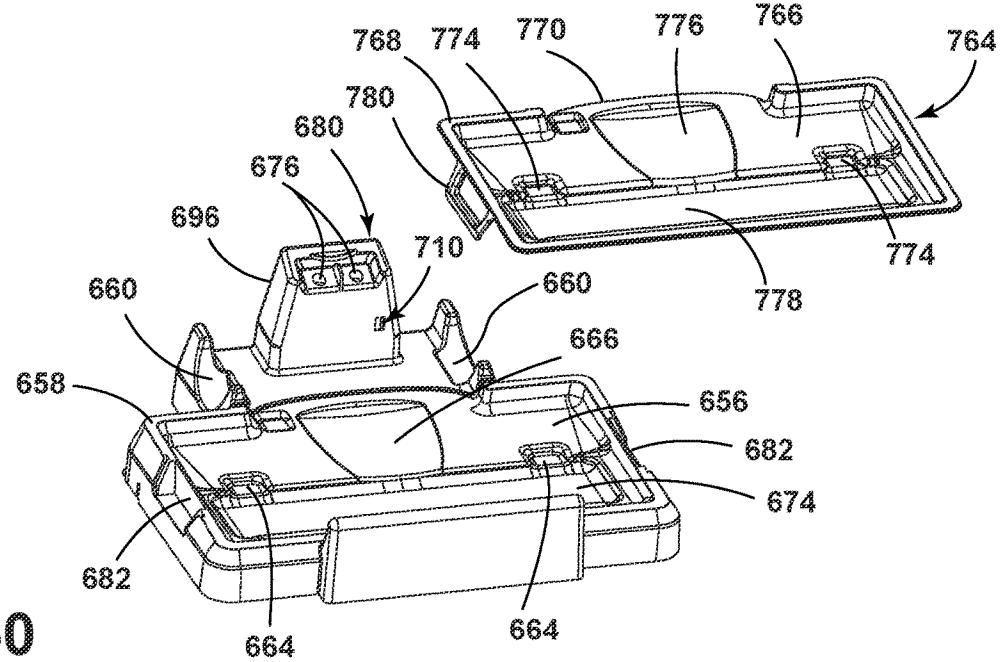
FIG. 50 is an exploded view of the storage tray from FIG. 49.

FIGS. 49-50 show another embodiment of the tray 654. To improve the cleanability of the tray 654, a removable tray liner 764 can be provided. The tray liner 764 is inserted into the tray 654, and can cover surfaces of the tray 654, such as the tray base 656 and the sump 674, which are exposed to dirt and liquid from the apparatus 10. The tray liner 764 can effectively eliminate, or at least greatly reduce, the need to clean the tray 654. The tray liner 764 can be lifted out of the tray 654, cleaned, and reinserted into the tray 654 for reuse.

The liner 764 can include a liner bottom 766 configured to cover the tray base 656 and a lip 768 configured to at least partially cover the guide walls 658 of the tray 654. The lip 768 can extend at least partially around the periphery of the liner 764. A rear edge 770 of the liner 764 can extend between ends of the lip 786.

The liner bottom 766 can include molded features having a complementary shape to features of the tray 654, such as one or more of complementary front wheel locators 774 for the tray front wheel locators 664, complementary joint locator 776 for the tray joint locator 666, and a complementary sump 778 for the tray sump 674.

The liner 764 can include grips 780 to aid in removal of the liner 764 from the tray 654. The grips 780 can be provided at opposing sides of the liner 764, such as extending downwardly from the lip 768. The tray 654 can include corresponding recesses 782 in the sides thereof to receive the grips 780. Via the grips 780, a user can hold both sides of the liner 764 while lifting the liner 764 away from the tray 654 to ensure the liner 764 stays generally level, and any liquid and/or debris collected by the liner 764 does not spill out.

In one embodiment, the liner 764 is formed from silicone, rubber, or other elastomeric material, and is substantially unitary. The liner 764 can be molded or otherwise formed with a complementary shape to the tray 654. In another embodiment, the tray liner 764 can be a thermoformed plastic sheet.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Furthermore, while the surface cleaning apparatus 10 shown herein has an upright configuration, the surface cleaning apparatus can be configured as a canister surface cleaning apparatus or a hand-held surface cleaning apparatus. For example, in a canister arrangement, foot components such as the suction nozzle and brushroll can be provided on a cleaning head coupled with a canister unit. In a hand-held arrangement, the components of the surface cleaning apparatus are provided as portable unit adapted to be hand carried by a user. Still further, the surface cleaning apparatus can additionally have steam delivery capability. Thus, the various features of the different embodiments may be mixed and matched in various vacuum cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus, comprising:

a housing;

a brushroll on the housing to agitate a surface to be cleaned;

a fluid distributor to deliver cleaning fluid to at least one of the brushroll and the surface to be cleaned;

a suction nozzle defining a dirty inlet to a recovery pathway and including a nozzle cover removably attached to the housing to partially enclose the brushroll;

a headlight to illuminate the surface to be cleaned;

a sensing component to sense whether the nozzle cover is attached to the housing; and a headlight power switch operable to close and supply power to the headlight when the nozzle cover is attached to the housing, and operable to open when the nozzle cover is removed from the housing;

wherein, when the sensing component senses that the nozzle cover is separated from the housing, the headlight power switch deactivates the headlight.

2. The surface cleaning apparatus of claim 1, wherein:

the housing includes a magnet, and the sensing component detects the magnet when the nozzle cover is attached to the housing.

3. The surface cleaning apparatus of claim 2, wherein the sensing component is a Hall Effect sensor.

4. The surface cleaning apparatus of claim 2, wherein the headlight power switch comprises the sensing component, and wherein the headlight power switch closes in the presence of the magnet and opens in the absence of the magnet.

5. The surface cleaning apparatus of claim 1, wherein the sensing component is a Hall Effect sensor provided on one of the nozzle cover and the housing, and a magnet is positioned on the other one of the nozzle cover and base housing in a location to be detected by the Hall Effect sensor when the nozzle cover is attached to the housing.

6. The surface cleaning apparatus of claim 1, wherein the headlight comprises a light source covered by the nozzle cover when the nozzle cover is attached to the housing and exposed when the nozzle cover is removed from the housing, and wherein the headlight power switch is coupled with the light source of the headlight.

7. The surface cleaning apparatus of claim 6, wherein the headlight comprises a light pipe configured to convey light emitted from the light source to an exterior of the housing.

8. The surface cleaning apparatus of claim 7, wherein the nozzle cover comprises the light pipe.

9. The surface cleaning apparatus of claim 6, wherein the light source comprises a light emitting diode module.

10. The surface cleaning apparatus of claim 1, comprising a user interface and a printed circuit board electrically coupled with the headlight and the sensing component, wherein, when the sensing component senses that the nozzle cover is separated from the housing, the sensing component sends a signal to the printed circuit board and the user interface issues a status update that the nozzle cover is missing.

11. The surface cleaning apparatus of claim 1, comprising:

a brushroll motor coupled with the brushroll to drive the brushroll; and a brushroll motor switch operable to close and supply power to the brushroll motor when the nozzle cover is attached to the housing, and operable to open when the nozzle cover is removed from the housing.

12. The surface cleaning apparatus of claim 11, comprising a user interface and a printed circuit board electrically coupled with the brushroll motor and the sensing component, wherein, when the sensing component senses that the nozzle cover is separated from the housing, the sensing component sends a signal to the printed circuit board and the user interface issues a status update that the nozzle cover is missing.

13. The surface cleaning apparatus of claim 1, comprising a battery to power the headlight.

14. The surface cleaning apparatus of claim 1, comprising a latch holding the nozzle cover to the housing and a hand grip on the cover adjacent to the latch.

15. The surface cleaning apparatus of claim 1, wherein the nozzle cover comprises a light transmissive polymeric material, and the brushroll is at least partially visible to a user through the nozzle cover.

16. The surface cleaning apparatus of claim 1, comprising:

a recovery system comprising the suction nozzle, a suction source in fluid communication with the suction nozzle, a recovery tank, and a clean air outlet; and a fluid delivery system comprising a supply tank and the fluid distributor.

17. The surface cleaning apparatus of claim 1, wherein the brushroll comprises a plurality of bristles and a microfiber material between the bristles.

18. The surface cleaning apparatus of claim 1, comprising:

a pump in fluid communication with the fluid distributor; and a brushroll motor coupled with the brushroll to drive the brushroll;

wherein the pump and brushroll motor are mounted in the housing.

19. The surface cleaning apparatus of claim 1, comprising an upright body and a base coupled with the upright body and adapted for movement across the surface to be cleaned, the base including the housing.

20. The surface cleaning apparatus of claim 19, wherein the nozzle cover wraps around and in front of the brushroll to define a front of the base at an exterior side thereof.

* * * * *